US007095390B2

(12) United States Patent
Otobe et al.

(10) Patent No.: US 7,095,390 B2
(45) Date of Patent: Aug. 22, 2006

(54) DISPLAY DRIVING METHOD AND APPARATUS

(75) Inventors: Yukio Otobe, Kawasaki (JP); Masahiro Yoshida, Kawasaki (JP); Nobuaki Otaka, Kawasaki (JP); Masaya Tajima, Kawasaki (JP); Katsuhiro Ishida, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1287 days.

(21) Appl. No.: 09/548,362

(22) Filed: Apr. 12, 2000

(65) Prior Publication Data

US 2001/0045923 A1 Nov. 29, 2001

Related U.S. Application Data

(62) Division of application No. 08/735,750, filed on Oct. 23, 1996, now Pat. No. 6,144,364.

(30) Foreign Application Priority Data

Oct. 24, 1995 (JP) ..... 7-275911
May 16, 1996 (JP) ..... 8-122075
Oct. 3, 1996 (JP) ..... 8-263398

(51) Int. Cl.
*G09G 3/28* (2006.01)

(52) U.S. Cl. ..... 345/63; 345/89
(58) Field of Classification Search ..... 345/20, 345/41, 42, 60, 63, 77, 147–149, 153, 154; 348/254, 671
See application file for complete search history.

(56) References Cited

U.S. PATENT DOCUMENTS

| | | | | |
|---|---|---|---|---|
| 4,414,544 | A | | 11/1983 | Suste |
| 4,980,678 | A | | 12/1990 | Zenda |
| 5,014,124 | A | | 5/1991 | Fujisawa |
| 5,034,990 | A | | 7/1991 | Klees |
| 5,075,683 | A | | 12/1991 | Ghis |
| 5,196,839 | A | | 3/1993 | Johary et al. |
| 5,198,803 | A | | 3/1993 | Shie et al. |
| 5,229,762 | A | | 7/1993 | Itoh et al. |
| 5,311,169 | A | | 5/1994 | Inada et al. |
| 5,317,334 | A | | 5/1994 | Sano |
| 5,400,044 | A | | 3/1995 | Thomas |
| 5,475,448 | A | | 12/1995 | Saegusa |
| 5,483,634 | A | | 1/1996 | Hasegawa |
| 5,491,496 | A | | 2/1996 | Tomiyasu |
| 5,541,618 | A | | 7/1996 | Shinoda |
| 5,572,236 | A | | 11/1996 | Feig et al. |
| 5,585,818 | A | | 12/1996 | Shibamiya |
| 5,604,514 | A | | 2/1997 | Hancock |
| 5,684,499 | A | * | 11/1997 | Shimizu et al. ..... 345/60 |
| 5,757,343 | A | * | 5/1998 | Nagakubo ..... 345/63 |
| 5,874,932 | A | * | 2/1999 | Nagaoka et al. ..... 345/63 |
| 6,097,358 | A | * | 8/2000 | Hirakawa et al. ..... 34/63 |

FOREIGN PATENT DOCUMENTS

| | | | |
|---|---|---|---|
| EP | 0 264 302 | | 4/1988 |
| EP | 0 488 891 | | 6/1992 |
| EP | 0 525 527 | | 2/1993 |
| EP | 0833299 | * | 1/1998 |
| JP | 92-22814 | | 12/1992 |
| JP | 5-108026 | | 4/1993 |
| JP | 7-44127 | | 2/1995 |
| JP | 7-175439 | | 7/1995 |
| JP | 7-261696 | | 10/1995 |
| JP | 7-261699 | | 10/1995 |
| JP | 7-271325 | | 10/1995 |
| JP | 7-302061 | | 11/1995 |
| WO | 94/09473 | | 4/1994 |

* cited by examiner

*Primary Examiner*—Amare Mengistu
(74) *Attorney, Agent, or Firm*—Staas & Halsey LLP

(57) ABSTRACT

A display driving method drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level. The display driving method includes the steps of setting the sustain times of each of the sub fields approximately constant within 1 field, and displaying image data on the display using N+1 gradation levels from a luminance level 0 to a luminance level N.

30 Claims, 75 Drawing Sheets

$$P(n,m)+E(n,m) = G(n,m) + 7/16\ E(n-1,m) + 1/16\ E(n-1,m-1) + 5/16\ E(n,m-1) + 3/16\ E(n+1,m-1)$$

FIG. 26

| ADDRESS | DATA | | | | | |
|---|---|---|---|---|---|---|
| | SF1 | SF2 | SF3 | SF4 | SF5 | SF6 |
| 0 | 0 | 0 | 0 | 0 | 0 | 0 |
| 1 | 0 | 0 | 1 | 0 | 0 | 0 |
| 2 | 0 | 0 | 1 | 1 | 0 | 0 |
| 3 | 0 | 1 | 1 | 1 | 0 | 0 |
| 4 | 0 | 1 | 1 | 1 | 1 | 0 |
| 5 | 1 | 1 | 1 | 1 | 1 | 0 |
| 6 | 1 | 1 | 1 | 1 | 1 | 1 |
| 7 | — | — | — | — | — | — |
| 8 | 0 | 0 | 0 | 0 | 0 | 0 |
| 9 | 0 | 0 | 0 | 1 | 0 | 0 |
| 10 | 0 | 0 | 1 | 1 | 0 | 0 |
| 11 | 0 | 0 | 1 | 1 | 1 | 0 |
| 12 | 0 | 1 | 1 | 1 | 1 | 0 |
| 13 | 0 | 1 | 1 | 1 | 1 | 1 |
| 14 | 1 | 1 | 1 | 1 | 1 | 1 |
| 15 | — | — | — | — | — | — |

FIG. 42

| | 16 EQUALLY DIVIDED PARTS | 256 GRADATION LEVELS | REQUIRED NO. OF ACTUAL GRADATION LEVELS |
|---|---|---|---|
| LOW LUMINANCE | REGION 0 | 0～15 | 50 GRADATION LEVELS |
| | REGION 1 | 16～31 | 40 GRADATION LEVELS |
| | REGION 2 | 32～47 | 30 GRADATION LEVELS |
| | REGION 3 | 48～63 | 20 GRADATION LEVELS |
| | REGION 4～7 | 64～127 | 16 GRADATION LEVELS |
| HIGH LUMINANCE | REGION 8～15 | 128～255 | 8 GRADATION LEVELS |

FIG. 48

| LUMINANCE LEVEL | SF1 | SF2 | SF3 | SF4 | SF5 | SF6 | SF7 | SF8 |
|---|---|---|---|---|---|---|---|---|
| 0 | ○ | ○ | ○ | ○ | ○ | ○ | ○ | ○ |
| 1 | ● | ○ | ○ | ○ | ○ | ○ | ○ | ○ |
| 2 | ● | ● | ○ | ○ | ○ | ○ | ○ | ○ |
| 3 | ● | ● | ● | ○ | ○ | ○ | ○ | ○ |
| 4 | ● | ● | ● | ● | ○ | ○ | ○ | ○ |
| 5 | ● | ● | ● | ● | ● | ○ | ○ | ○ |
| 6 | ● | ● | ● | ● | ● | ● | ○ | ○ |
| 7 | ● | ● | ● | ● | ● | ● | ● | ○ |
| 8 | ● | ● | ● | ● | ● | ● | ● | ● |

FIG. 53

| LUMINANCE LEVEL | SF1 | SF2 | SF3 | SF4 | SF5 | SF6 | SF7 | SF8 |
|---|---|---|---|---|---|---|---|---|
| 0 | ○ | ○ | ○ | ○ | ○ | ○ | ○ | ○ |
| 1 | ○ | ○ | ○ | ○ | ○ | ○ | ○ | ● |
| 2 | ○ | ○ | ○ | ○ | ○ | ○ | ● | ● |
| 3 | ○ | ○ | ○ | ○ | ○ | ● | ● | ● |
| 4 | ○ | ○ | ○ | ○ | ● | ● | ● | ● |
| 5 | ○ | ○ | ○ | ● | ● | ● | ● | ● |
| 6 | ○ | ○ | ● | ● | ● | ● | ● | ● |
| 7 | ○ | ● | ● | ● | ● | ● | ● | ● |
| 8 | ● | ● | ● | ● | ● | ● | ● | ● |

FIG. 54

| LUMINANCE LEVEL | SF1 | SF2 | SF3 | SF4 | SF5 | SF6 | SF7 | SF8 |
|---|---|---|---|---|---|---|---|---|
| 0 | ○ | ○ | ○ | ○ | ○ | ○ | ○ | ○ |
| 1 | ○ | ○ | ○ | ○ | ● | ○ | ○ | ○ |
| 2 | ○ | ○ | ○ | ● | ● | ○ | ○ | ○ |
| 3 | ○ | ○ | ○ | ● | ● | ● | ○ | ○ |
| 4 | ○ | ○ | ● | ● | ● | ● | ○ | ○ |
| 5 | ○ | ○ | ● | ● | ● | ● | ● | ○ |
| 6 | ○ | ● | ● | ● | ● | ● | ● | ○ |
| 7 | ○ | ● | ● | ● | ● | ● | ● | ● |
| 8 | ● | ● | ● | ● | ● | ● | ● | ● |

FIG. 55

| LUNMINANCE LEVEL | SF1 | SF2 | SF3 | SF4 | SF5 | SF6 | SF7 | SF8 |
|---|---|---|---|---|---|---|---|---|
| 0 | ○ | ○ | ○ | ○ | ○ | ○ | ○ | ○ |
| 1 | ○ | ○ | ○ | ○ | ○ | ○ | ○ | ● |
| 2 | ● | ○ | ○ | ○ | ○ | ○ | ○ | ● |
| 3 | ● | ○ | ○ | ○ | ○ | ○ | ● | ● |
| 4 | ● | ● | ○ | ○ | ○ | ○ | ● | ● |
| 5 | ● | ● | ○ | ○ | ○ | ● | ● | ● |
| 6 | ● | ● | ● | ○ | ○ | ● | ● | ● |
| 7 | ● | ● | ● | ○ | ● | ● | ● | ● |
| 8 | ● | ● | ● | ● | ● | ● | ● | ● |

FIG. 56

| LUMINANCE LEVEL | SF1 | SF2 | SF3 | SF4 | SF5 | SF6 | SF7 | SF8 |
|---|---|---|---|---|---|---|---|---|
| 0 | ○ | ○ | ○ | ○ | ○ | ○ | ○ | ○ |
| 1 | ○ | ○ | ○ | ○ | ● | ○ | ○ | ○ |
| 2 | ○ | ● | ○ | ○ | ● | ○ | ○ | ○ |
| 3 | ○ | ● | ○ | ○ | ● | ○ | ○ | ● |
| 4 | ● | ● | ○ | ○ | ● | ○ | ○ | ● |
| 5 | ● | ● | ● | ○ | ● | ○ | ○ | ● |
| 6 | ● | ● | ● | ● | ● | ○ | ○ | ● |
| 7 | ● | ● | ● | ● | ● | ○ | ● | ● |
| 8 | ● | ● | ● | ● | ● | ● | ● | ● |

FIG. 81

| LUMINANCE LEVEL OF SUB PATH 62 | SF1 | SF2 | SF3 | SF4 | SF5 | SF6 | SF7 | SF8 | EQUIVALENT LUMINANCE LEVEL OF MAIN PATH 61 |
|---|---|---|---|---|---|---|---|---|---|
| 0 | ○ | ○ | ○ | ○ | ○ | ○ | ○ | ○ | 0 |
| 1 | ● | ○ | ○ | ○ | ○ | ○ | ○ | ○ | 1 |
| 2 | ● | ● | ○ | ○ | ○ | ○ | ○ | ○ | 3 |
| 3 | ● | ● | ● | ○ | ○ | ○ | ○ | ○ | 7 |
| 4 | ● | ● | ● | ● | ○ | ○ | ○ | ○ | 15 |
| 5 | ● | ● | ● | ● | ● | ○ | ○ | ○ | 31 |
| 6 | ● | ● | ● | ● | ● | ● | ○ | ○ | 63 |
| 7 | ● | ● | ● | ● | ● | ● | ● | ○ | 127 |
| 8 | ● | ● | ● | ● | ● | ● | ● | ● | 255 |

DISPLAY DRIVING METHOD AND APPARATUS

This application is a divisional application of application Ser. No. 08/735,750, filed Oct. 23, 1996, now allowed.

BACKGROUND OF THE INVENTION

The present invention generally relates to display driving methods and apparatuses, and more particularly to a display driving method and apparatus suited to drive a plasma display panel (hereinafter simply referred to as a PDP).

The PDP is expected to become one of the display devices of the next generation and to replace the conventional cathode ray tube (CRT), because the PDP can easily realize reduction in the thickness of the panel, reduction in the weight of the panel, flat screen shape and large screen.

A PDP which makes a surface discharge has been proposed, and according to such a PDP, all pixels on the screen simultaneously emit light depending on display data. In the PDP which makes the surface discharge, a pair of electrodes are formed on an inner surface of a front glass substrate and a rare gas is filled within the panel. When a voltage is applied across the electrodes, a surface discharge occurs at the surface of a protection layer and a dielectric layer formed on the electrode surface, thereby generating ultraviolet rays. Fluorescent materials of the three primary colors red (R), green (G) and blue (B) are coated on an inner surface of a back glass substrate, and a color display is made by exciting the light emission from the fluorescent materials responsive to the ultraviolet rays. In other words, fluorescent materials of R, G and B are provided with respect to each pixel forming the screen.

FIG. 1 is a diagram showing an example of a gradation driving sequence of the PDP which makes the surface discharge as described above. As shown in FIG. 1, 1 field which is the time in which 1 image is displayed, is divided into a plurality of sub fields, and the gradation display of the image is made by controlling a light emission time (hereinafter referred to as a sustain time) in each sub field. 1 sub field is made up of an address display-time in which a wall charge is formed with respect to all of the pixels which are to make the light emission within the sub field, and the sustain time in which a luminance level is determined. In this specification, the "wall charge" refers to the charge induced at the dielectric layer and the protection layer on the electrodes and at the surface of the fluorescent materials. For this reason, if the number of sub fields within 1 field increases, the number of address display-times increases depending on the increase of the sub fields, thereby reducing the relative sustain times that may be provided for the light emission and deteriorating the luminance of the screen.

Accordingly, in order to increase the number of displayable gradation levels of the PDP using the limited number of sub fields, the PDP is generally driven with the sustain time proportional to the bit weighting as shown in FIG. 1. In the case shown in FIG. 1, 1 field is made up of 6 sub fields SF1 through SF6, and the display is made with 64 gradation levels based on 6-bit image data corresponding to each of the sub fields SF1 through SF6. For the sake of convenience, the sustain times within the sub fields SF1 through SF6 are indicated by the hatching to indicate the ON state, that is, the light emission state. The duration ratios or length ratios of the sub fields SF1 through SF6 are set to satisfy a relation SF1:SF2:SF3:SF4:SF5:SF6=1:2:4:8:16:32. In this particular case, 1 field is approximately 16.7 ms.

When displaying a moving image on the PDP using the above described gradation driving sequence, a contour of an unnatural color which originally does not exist is generated at the surface of the moving object in the image due to the residual image effect and the like of the human eyes. In this specification, such a contour of the unnatural color caused by the residual image effect and the like will be referred to a "pseudo contour". The pseudo contour becomes particularly conspicuous when a person on the screen moves. The pseudo contour appears to the human eyes as a band of green or red color at the skin-colored portion such as the face of the person, and the pseudo contour greatly deteriorates the image quality.

A description will be given of the mechanism by which the pseudo contour is generated in conjunction with FIGS. 2 through 7, by referring to phenomenons (1) through (3). For the sake of convenience, FIGS. 2 through 7 show a case where 1 field is made up of 4 sub fields. In addition, in FIGS. 2 through 5, the length ratios the sustain times in the 4 sub fields are set to 1:2:4:8 in the sequence in which the light emission state is determined. In FIGS. 6 and 7, the length ratios of the sustain times in the 4 sub fields are set to 1:4:8:2 in the sequence in which the light emission state is determined. In FIGS. 2 through 7, those sustain times which assume the light emission state, that is, the light emission state, are indicated by the hatching. In this case, it is possible to display 16 gradation levels from a level 0 to a level 15. In FIGS. 2 through 7, the abscissa indicates the time, and the ordinate towards the upward direction indicates the left side of the screen and the ordinate towards the downward direction indicates the right side of the screen. In addition, the numerals indicated along the ordinate indicate the luminance level. The illustration of the address display-times with the sub fields, that is, the non-light emission times, is omitted in FIGS. 2 through 7.

Phenomenon (1)

In a first case, it is assumed for the sake of convenience that a Gray scale image which becomes brighter from the left towards the right of the image, that is, an image in which the luminance increases from the left to right of the image, is displayed on the PDP. If this image continuously moves towards the left of the screen by an amount corresponding to 1 pixel for every 1 field, a portion where the light becomes sparse appears to the human eyes. On the other hand, if this image continuously moves towards the right of the screen by an amount corresponding to 1 pixel for every 1 field, a portion where the light becomes dense appears to the human eyes. These sparse and dense portions where the light appears sparse and dense, respectively, occur when the human eyes focus on the moving object displayed on the screen, because the human eyes follow the moving direction and moving speed of the moving object and the visual point moves along loci indicated by bold arrows in FIGS. 2 and 3. FIG. 2 is a diagram showing a locus of a visual field of human eyes in a case where a Gray scale image in which the luminance increases from the left to right of the image is displayed on a PDP and this image continuously moves towards the left of the screen by an amount corresponding to 1 pixel for every 1 field.

FIG. 3 is a diagram showing a locus of the visual field of the human eyes in a case where a Gray scale image in which the luminance increases from the left to right of the image is displayed on a PDP and this image continuously moves towards the right of the screen by an amount corresponding to 1 pixel for every 1 field.

Phenomenon (2)

In a second case, it is assumed for the sake of convenience that a Gray scale image which gradually becomes brighter from the left towards the right of the image, that is, an image in which the luminance gradually increases from the left to right of the image, is displayed on the PDP. If this image moves towards the left of the screen at a constant speed by an amount corresponding to 1 pixel for every 1 field, a portion where the light becomes sparse appears to the human eyes. On the other hand, if this image moves towards the right of the screen at a constant speed by an amount corresponding to 1 pixel for every 1 field, a portion where the light becomes dense appears to the human eyes. These sparse and dense portions where the light appears sparse and dense, respectively, occur when the human eyes focus on the moving object displayed on the screen, because the human eyes follow the moving direction and moving speed of the moving object and the visual point moves along loci indicated by bold arrows in FIGS. 4 and 5. Such a phenomenon occurs when the image displayed on the screen during 1 field moves at a high speed or at a low speed.

FIG. 4 is a diagram showing a locus of the visual field of the human eyes in a case where a Gray scale image which has a gradation with a width of 3 pixels and in which the luminance gradually increases from the left to right of the image is displayed on a PDP and this image moves at a constant speed towards the left of the screen by an amount corresponding to 1 pixel for every 1 field. FIG. 5 is a diagram showing a locus of the visual field of the human eyes in a case where a Gray scale image which has the gradation with the width of 3 pixels and in which the luminance increases from the left to right of the image is displayed on a PDP and this image moves at a constant speed towards the left of the screen by an amount corresponding to 3 pixels for every 1 field.

Phenomenon (3)

In a third case, it is assumed for the sake of convenience that a Gray scale image which becomes brighter from the left towards the right of the image, that is, an image in which the luminance increases from the left to right of the image, is displayed on the PDP. In this case, even when the sub field structure is changed and the length ratios of the sustain times in the 4 sub fields are set to 1:4:8:2 in the sequence in which the light emission state is determined, as shown in FIGS. 6 and 7, portions where the light becomes sparse and dense to the human eyes occur if this image continuously moves towards the left of the screen by an amount corresponding to 1 pixel for every 1 field. On the other hand, portions where the light becomes dense and sparse to the human eyes occur if this image continuously moves towards the right of the screen by an amount corresponding 1 pixel for every 1 field. These portions where the light appears sparse and dense or vice versa, respectively, occur when the human eyes focus on the moving object displayed on the screen, because the human eyes follow the moving direction and moving speed of the moving object and the visual point moves along loci indicated by bold arrows in FIGS. 6 and 7.

FIG. 6 is a diagram showing a locus of the visual field of the human eyes in a case where a Gray scale image in which the luminance increases from the left to right of the image is displayed on a PDP by changing the sub field structure from that of FIGS. 3 through 6 and this image moves towards the left of the screen by an amount corresponding to 1 pixel for every 1 field. FIG. 7 is a diagram showing a locus of the visual field of the human eyes in a case where a Gray scale image in which the luminance increases from the left to right of the image is displayed on a PDP by changing the sub field structure from that of FIGS. 3 through 6 and this image moves towards the left of the screen by an amount corresponding to 1 pixel for every 1 field.

The above described phenomenons (1) through (3) become particularly notable at the luminance levels where the sub fields of the light emission state greatly deviate along the time base (or axis). Hence, in the case where the display can be made using 16 gradation levels as shown in FIGS. 2 through 7, the phenomenons (1) through (3) become notable at the portion where the luminance level changes from the level 7 to the level 8 and at the portion where the luminance level changes from the level 8 to the level 7.

Next, a description will be given of the mechanism by which the pseudo contour becomes visible to the human eyes when the moving object displayed on the screen is a person's face having the skin tone, for example, based on the phenomenons (1) through (3).

For the sake of convenience, it is assumed that the ratios of the luminance levels of R, G and B for the skin tone is R:G:B:=4:3:2. In this case, the gradation characteristic becomes as shown in FIG. 8. In FIG. 8, the ordinate indicates the signal level in arbitrary units, and the abscissa indicates the luminance level. In FIG. 8, the luminance of the skin tone becomes darker towards the left and brighter towards the right. Portions where the light appears sparse or dense to the human eyes exist depending on the moving direction of the moving object displayed on the screen, and in FIG. 8, a portion indicated by a black circular mark where the luminance level is R1=0.5 and a portion indicated by a black circular mark where the luminance level is G1=0.5 correspond to such portions.

FIG. 9 shows a case where the moving object displayed on the screen moves towards the left of the screen, where the moving object has the skin tone having the above described ratios of the luminance levels of R, G and B. An upper half of FIG. 9 indicates the display on the screen, and a lower half of FIG. 9 indicates the luminance levels of each of the primary colors R, G and B. In FIG. 9, an oval shaded portion corresponds to the moving object which has the skin tone, and it is assumed that the luminance becomes higher towards the central portion of the oval portion. The signal characteristics of R, G and B indicated in the lower half of FIG. 9 are with respect to the double lines passing the central portion of the oval portion.

In the case of the sub field structure described above, the portion where the luminance level is R1 in FIG. 8 corresponds to portions indicated by P1 and P4 in FIG. 9. Accordingly, when the moving object moves towards the left of the screen and the human eyes follow this moving object, the light becomes sparse at the portion P1 while the light becomes dense at the portion P4. In addition, the portion where the luminance level is G in FIG. 8 corresponds to portions indicated by P2 and P3 in FIG. 9. Thus, when the moving object moves towards the left of the screen and the human eyes follow this moving object, the light becomes sparse at the portion P2 while the light becomes dense at the portion P3. In other words, the luminance level of R decreases at the portion P1 and a band of G (or B) moves towards the left of the screen, and the luminance level of G decreases at the portion P2 and a band of R (or B) moves towards the left of the screen. On the other hand, the luminance level of G increases at the portion P3 and a band of G moves towards the left of the screen, and the luminance level of R increases at the portion P4 and a band of R moves towards the left of the screen.

As a result, even if the moving object has a skin tone with a smooth or gradual change in gradation level, a band of a color which originally does not exist appears to the human eyes at the contour portion of the moving object. As described above, this pseudo contour is notably generated at the skin tone portion such as the person's face and makes the image extremely unnatural, thereby deteriorating the image quality.

On the other hand, in the PDP using the sub field structure described above, a change in a least significant bit (LSB) of the image data may result in a large change of the position (time) on the time base of the sub field having the light emission state depending on the luminance level. This large change in the position of the sub field having the light emission state generates a flicker having a frequency lower than the frame frequency which is 60 Hz, for example, thereby deteriorating the image quality.

When it is assumed that the length ratios the sustain times in the 4 sub fields which make up 1 field are set to 1:2:4:8 in the sequence in which the ON state is determined, it is possible to display 16 gradation levels from the level 0 to the level 15, as described above. However, if the luminance level of a pixel changes between the levels 7 and 8 for every field, that is, changes to levels 7, 8, 7, 8, . . . for every field as shown in FIG. 10, a luminance level change of 0 (all black), 15 (all white), 0 (all black), 15 (all white), . . . appears at a frequency of 30 Hz to the human eyes, thereby generating the flicker.

Hence, the generation of the flicker is conspicuous at the portions where the sub fields having the light emission state greatly changes on the time base. When a pixel of an original image represented by 256 gradation levels has a luminance level in a vicinity of 128 and is displayed on a PDP which can display 16 gradation levels, the flicker is easily generated due to quantization error, video noise and the like even though the original image is a still image, and the image quality is deteriorated as a result.

Therefore, when the conventional gradation driving sequence is used for the PDP, a band of a color which originally does not exist appears to the human eyes at the contour portion of the moving object, even when the skin tone of the moving object undergoes a gradual change in gradation, thereby resulting in a problem in that the pseudo contour is visible to the human eyes. In addition, the pseudo contour is notably generated at the skin tone portion such as the person's face, and the image becomes extremely unnatural and the image quality is deteriorated thereby.

On the other hand, there is another problem in that the generation of the flicker is notable at portions where the sub fields having the light emission state greatly change on the time base. For example, when a pixel of an original image represented by 256 gradation levels has a luminance level in a vicinity of 128 and is displayed on a PDP which can display 16 gradation levels, the flicker is easily generated due to quantization error, video noise and the like even though the original image is a still image, and the image quality is deteriorated as a result.

SUMMARY OF THE INVENTION

Accordingly, it is a general object of the present invention to provide a novel and useful display driving method and apparatus in which the problems described above are eliminated.

Another and more specific object of the present invention is to provide a display driving method which drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level, comprising the steps of setting the sustain times of each of the sub fields approximately constant within 1 field, and displaying image data on the display using N+1 gradation levels from a luminance level 0 to a luminance level N. According to the display driving method of the present invention, it is possible to effectively prevent the generation of the pseudo contour and the generation of the flicker, and the present invention is thus suited for realizing a high image quality on a plasma display panel or the like.

Still another object of the present invention is to provide a display driving method which drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level, comprising the steps of dividing 1 field into a first sub field group and a second sub field group and alternately arranging a sub field belonging to the first sub field group and a sub field belonging to the second sub field group within 1 field, setting the sustain times of each of the sub fields belonging to the first sub field group approximately constant within 1 field, and setting the sustain times of each of the sub fields belonging to the second sub field group approximately constant within 1 field, and displaying image data on the display using $[(N-1)/2+1]^2+[(N-1)/2]+1$ gradation levels from a level 0 to a level $[(N-1)/2+1]^2+[(N-1)/2]$ by setting the ratios of luminance levels of the N sub fields SF1 through SFN to satisfy a relation SF1:SF2: SF3: . . . :SF(N−2):SF(N−1):SFN=(N−1)/2+1:1:(N−1)/2+1: . . . :(N−1)/2+1:1:(N−1)/2+1. According to the display driving method of the present invention, it is possible to effectively prevent the generation of the pseudo contour and the generation of the flicker. Furthermore, it is possible to make the apparent number of gradation levels relatively large even when the number of sub fields within 1 field is small. Hence, the present invention is suited for realizing a high image quality on a plasma display panel or the like.

A further object of the present invention is to provide a display driving method which drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level, comprising the steps of displaying input image data on the display using N+1 gradation levels from a luminance level 0 to a luminance level N, and increasing a luminance quantity when displaying a luminance level m by adding 1 sub field which is to assume a light emission state in addition to all sub fields which assume the light emission state when displaying a luminance level m−1, where m is an integer satisfying $0<m<N$. According to the display driving method of the present invention, it is possible to effectively prevent the generation of the pseudo contour.

Another object of the present invention is to provide a display driving apparatus which drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level, comprising means for setting the sustain times of each of the sub fields approximately constant within 1 field, and means for displaying image data on the display using N+1 gradation levels from a luminance level 0 to a luminance level N. According to the display driving apparatus of the present invention, it is possible to effectively prevent the generation of the pseudo contour and the generation of the flicker, and the present invention is thus suited for realizing a high image quality on a plasma display panel or the like.

Still another object of the present invention is to provide a display driving apparatus which drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level, comprising means for dividing 1 field into a first sub field group and a second sub field group and alternately arranging a sub field belonging to the first sub field group and a sub field belonging to the second sub field group within 1 field, and setting the sustain times of each of the sub fields belonging to the first sub field group approximately constant within 1 field, and setting the sustain times of each of the sub fields belonging to the second sub field group approximately constant within 1 field, and means for displaying image data on the display using $[(N-1)/2+1]^2+[(N-1)/2]+1$ gradation levels from a level 0 to a level $[(N-1)/2+1]^2+[(N-1)/2]$ by setting the ratios of luminance levels of the N sub fields SF1 through SFN to satisfy a relation SF1:SF2:SF3: . . . :SF(N−2):SF(N−1):SFN=(N−1)/2+1:1:(N−1)/2+1: . . . : (N−1)/2+1:1:(N−1)/2+1. According to the display driving apparatus of the present invention, it is possible to effectively prevent the generation of the pseudo contour and the generation of the flicker. Furthermore, it is possible to make the apparent number of gradation levels relatively large even when the number of sub fields within 1 field is small. Hence, the present invention is suited for realizing a high image quality on a plasma display panel or the like.

A further object of the present invention is to provide a display driving apparatus which drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level, comprising means for displaying input image data on the display using N+1 gradation levels from a luminance level 0 to a luminance level N, and means for increasing a luminance quantity when displaying a luminance level m by adding 1 sub field which is to assume a light emission state in addition to all sub fields which assume the light emission state when displaying a luminance level m−1, where m is an integer satisfying 0<m<N. According to the display driving apparatus of the present invention, it is possible to effectively prevent the generation of the pseudo contour.

Another object of the present invention is to provide a display driving method which makes a luminance representation depending on a length of a light emission time, including the steps of (a) generating a first image signal having a gradation levels from an input image signal having n gradation levels while satisfying a≦n, where n, a and b are integers, (b) generating a second image signal having b gradation levels from the input image signal while satisfying b<a≦n, and (c) switching and outputting the first image signal and the second image signal in units of pixels. According to the display driving method of the present invention, it is possible to make a display on a display which can only have a single fixed driving sequence as if two different gradation driving systems are displayed with the same display characteristic. In addition, it is possible to select an optimum display control in units of pixels depending on the state of the image. Hence, it is possible to carry out a fine driving control, by selecting the driving control which uneasily generates the pseudo contour with respect to an image in which the pseudo contour is conspicuous and selecting the driving control which improves the gradation display capability with respect to an image in which the pseudo contour is originally inconspicuous. For this reason, it is possible to greatly improve the moving image display capability of the display, such as the PDP, which makes the luminance representation depending on the length of the light emission time.

Still another object of the present invention is to provide a display driving method which makes a luminance representation depending on a length of a light emission time, including the steps of (a) generating a first image signal having a gradation levels by carrying out an error diffusion process with respect to an input image signal having n gradation levels while satisfying a<n, where n, a and b are integers, (b) generating a second image signal having b gradation levels by carrying out an error diffusion process with respect to the input image signal while satisfying b<a<n, and (c) switching and outputting the first image signal and the second image signal in units of pixels. According to the display driving method of the present invention, it is possible to make a display on a display which can only have a single fixed driving sequence as if two different gradation driving systems are displayed with the same display characteristic. In addition, it is possible to select an optimum display control in units of pixels depending on the state of the image. Hence, it is possible to carry out a fine driving control, by selecting the driving control which uneasily generates the pseudo contour with respect to an image in which the pseudo contour is conspicuous and selecting the driving control which improves the gradation display capability with respect to an image in which the pseudo contour is originally inconspicuous. For this reason, it is possible to greatly improve the moving image display capability of the display, such as the PDP, which makes the luminance representation depending on the length of the light emission time.

A further object of the present invention is to provide a display driving apparatus which makes a luminance representation depending on a length of a light emission time, comprising a first processing path generating a first image signal having a gradation levels from an input image signal having n gradation levels while satisfying a≦n, where n, a and b are integers, a second processing path generating a second image signal having b gradation levels from the input image signal while satisfying b<a≦n, and switching means for switching and outputting the first image signal and the second image signal in units of pixels. According to the display driving apparatus of the present invention, it is possible to make a display on a display which can only have a single fixed driving sequence as if two different gradation driving systems are displayed with the same display characteristic. In addition, it is possible to select an optimum display control in units of pixels depending on the state of the image. Hence, it is possible to carry out a fine driving control, by selecting the driving control which uneasily generates the pseudo contour with respect to an image in which the pseudo contour is conspicuous and selecting the driving control which improves the gradation display capability with respect to an image in which the pseudo contour is originally inconspicuous. For this reason, it is possible to greatly improve the moving image display capability of the display, such as the PDP, which makes the luminance representation depending on the length of the light emission time.

Another object of the present invention is to provide a display driving apparatus which makes a luminance representation depending on a length of a light emission time, comprising a first processing path generating a first image signal having a gradation levels by carrying out an error diffusion process with respect to an input image signal having n gradation levels while satisfying a<n, where n, a and b are integers, a second processing path generating a second image signal having b gradation levels by carrying out an error diffusion process with respect to the input image signal while satisfying b<a<n, and switching means for switching and outputting the first image signal and the second image signal in units of pixels. According to the display driving apparatus of the present invention, it is possible to make a display on a display which can only have a single fixed driving sequence as if two different gradation driving systems are displayed with the same display characteristic. In addition, it is possible to select an optimum display control in units of pixels depending on the state of the image. Hence, it is possible to carry out a fine driving control, by selecting the driving control which uneasily generates the pseudo contour with respect to an image in which the pseudo contour is conspicuous and selecting the driving control which improves the gradation display capability with respect to an image in which the pseudo contour is originally inconspicuous. For this reason, it is possible to greatly improve the moving image display capability of the display, such as the PDP, which makes the luminance representation depending on the length of the light emission time.

Still another object of the present invention is to provide a display unit comprising a display which makes a luminance representation depending on a length of a light emission time, a first processing path generating a first image signal having a gradation levels from an input image signal having n gradation levels while satisfying a≦n, where n, a and b are integers, a second processing path generating a second image signal having b gradation levels from the input image signal while satisfying b<a≦n, and switching means for switching and outputting to said display the first image signal and the second image signal in units of pixels. According to the display unit of the present invention, it is possible to make a display on a display which can only have a single fixed driving sequence as if two different gradation driving systems are displayed with the same display characteristic. In addition, it is possible to select an optimum display control in units of pixels depending on the state of the image. Hence, it is possible to carry out a fine driving control, by selecting the driving control which uneasily generates the pseudo contour with respect to an image in which the pseudo contour is conspicuous and selecting the driving control which improves the gradation display capability with respect to an image in which the pseudo contour is originally inconspicuous. For this reason, it is possible to greatly improve the moving image display capability of the display, such as the PDP, which makes the luminance representation depending on the length of the light emission time.

A further object of the present invention is to provide a display unit comprising a display which makes a luminance representation depending on a length of a light emission time, a first processing path generating a first image signal having a gradation levels by carrying out an error diffusion process with respect to an input image signal having n gradation levels while satisfying a<n, where n, a and b are integers, a second processing path generating a second image signal having b gradation levels by carrying out an error diffusion process with respect to the input image signal while satisfying b<a<n, and switching means for switching and outputting to said display the first image signal and the second image signal in units of pixels. According to the display unit of the present invention, it is possible to make a display on a display which can only have a single fixed driving sequence as if two different gradation driving systems are displayed with the same display characteristic. In addition, it is possible to select an optimum display control in units of pixels depending on the state of the image. Hence, it is possible to carry out a fine driving control, by selecting the driving control which uneasily generates the pseudo contour with respect to an image in which the pseudo contour is conspicuous and selecting the driving control which improves the gradation display capability with respect to an image in which the pseudo contour is originally inconspicuous. For this reason, it is possible to greatly improve the moving image display capability of the display, such as the PDP, which makes the luminance representation depending on the length of the light emission time.

Other objects and further features of the present invention will be apparent from the following detailed description when read in conjunction with the accompanying drawings.

BRIEF DESCRIPTION OF THE DRAWINGS

FIG. 26 is a diagram for explaining a data map of a table;

FIG. 42 is a diagram showing judgement results indicating the display gradation which may be considered as being of a level equivalent to a case where the actual display gradation has 50 gradation levels, with respect to each region which is obtained by dividing an entire luminance region to be displayed into 16 equal parts;

FIG. 48 is a diagram showing sub fields having the light emission state for each luminance level;

FIG. 53 is a diagram showing a setting of the sub fields having the light emission state in the light emission time control circuit for each luminance level;

FIG. 54 is a diagram showing a setting of the sub fields having the light emission state in the light emission time control circuit for each luminance level;

FIG. 55 is a diagram showing a setting of the sub fields having the light emission state in the light emission time control circuit for each luminance level;

FIG. 56 is a diagram showing a setting of the sub fields having the light emission state in the light emission time control circuit for each luminance level;

FIG. 81 is a diagram showing an arragement of the sub fields having the light emission state for each luminance level in the sub path of the eighth embodiment and a main path luminance level having an equivalent amount of luminance on the main path.

DESCRIPTION OF THE PREFERRED EMBODIMENTS

The present inventors found that when an object having a gradation change Δx on a screen moves and the human eyes follow this moving object, the pseudo contour will not be generated if measures are taken so that to the human eyes the moving object appears to maintain the original gradation change Δx. In addition, the present inventors found that the possibility of the pseudo contour being detected becomes low if the gradation change Δx appears to the human eyes as a gradation change which closely approximates the gradation change Δx as much as possible.

Figure 1:
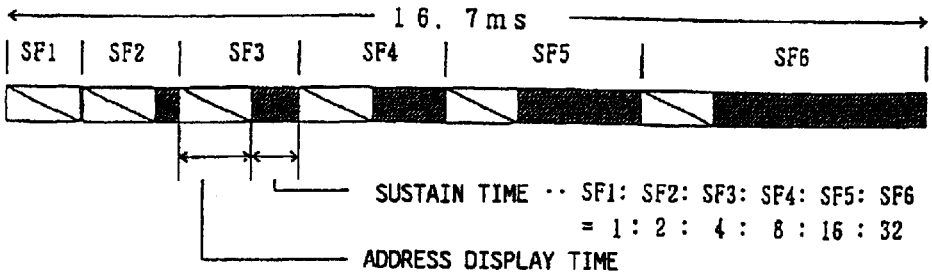
FIG. 1 PRIOR ART
FIG. 1 is a diagram for explaining an example of a gradation driving sequence of a PDP which makes a surface discharge.
Figure 2:
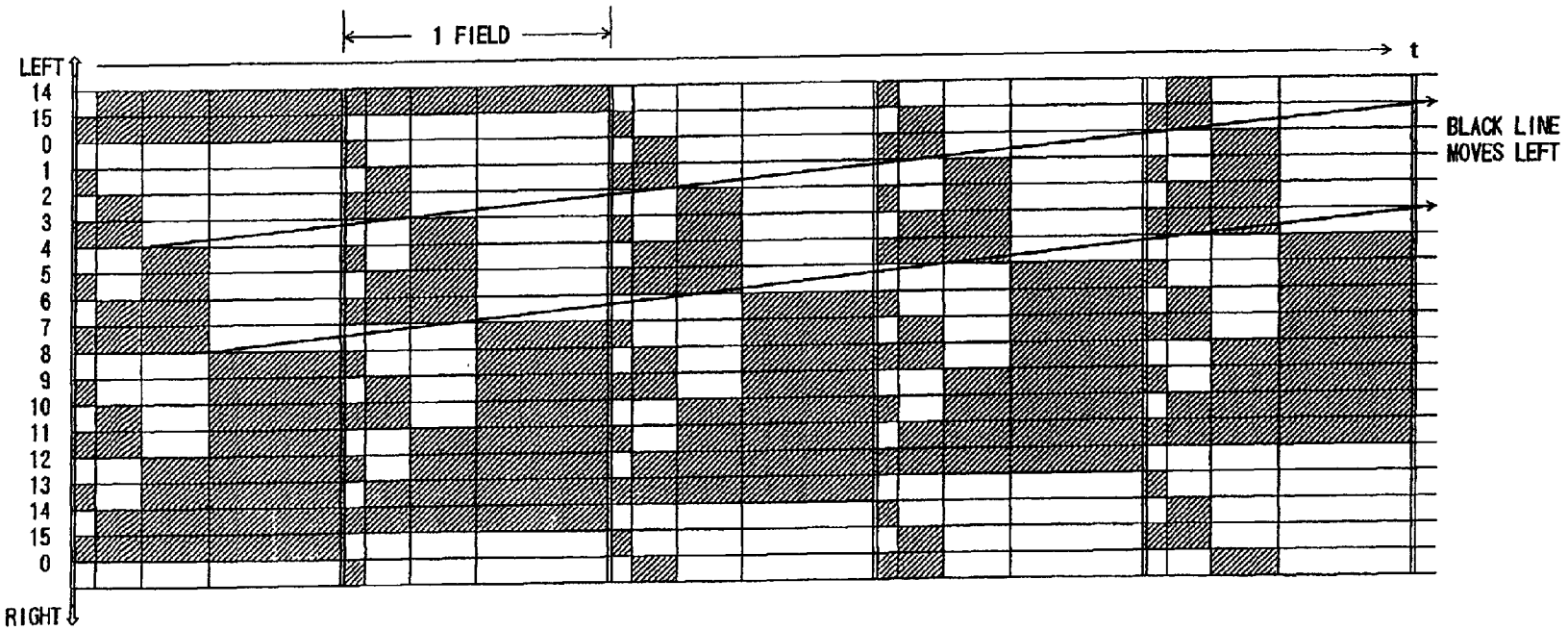
FIG. 2 PRIOR ART
FIG. 2 is a diagram showing a locus of a visual field of human eyes in a case where a Gray scale image in which the luminance increases from the left to right of the image is displayed on a PDP and this image continuously moves towards the left of the screen by an amount corresponding to 1 pixel for every 1 field.
Figure 3:
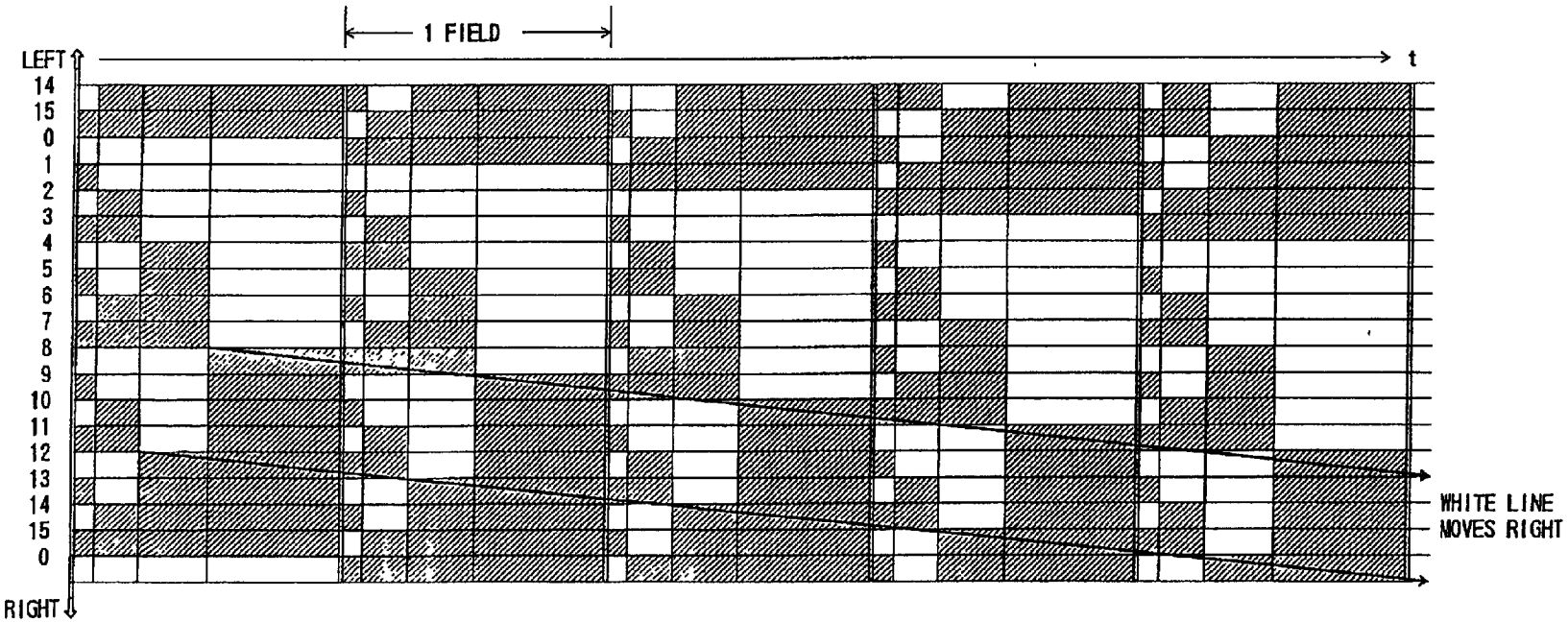
FIG. 3 PRIOR ART
FIG. 3 is a diagram showing a locus of the visual field of the human eyes in a case where a Gray scale image in which the luminance increases from the left to right of the image is displayed on a PDP and this image continuously moves towards the right of the screen by an amount corresponding to 1 pixel for every 1 field.
Figure 4:
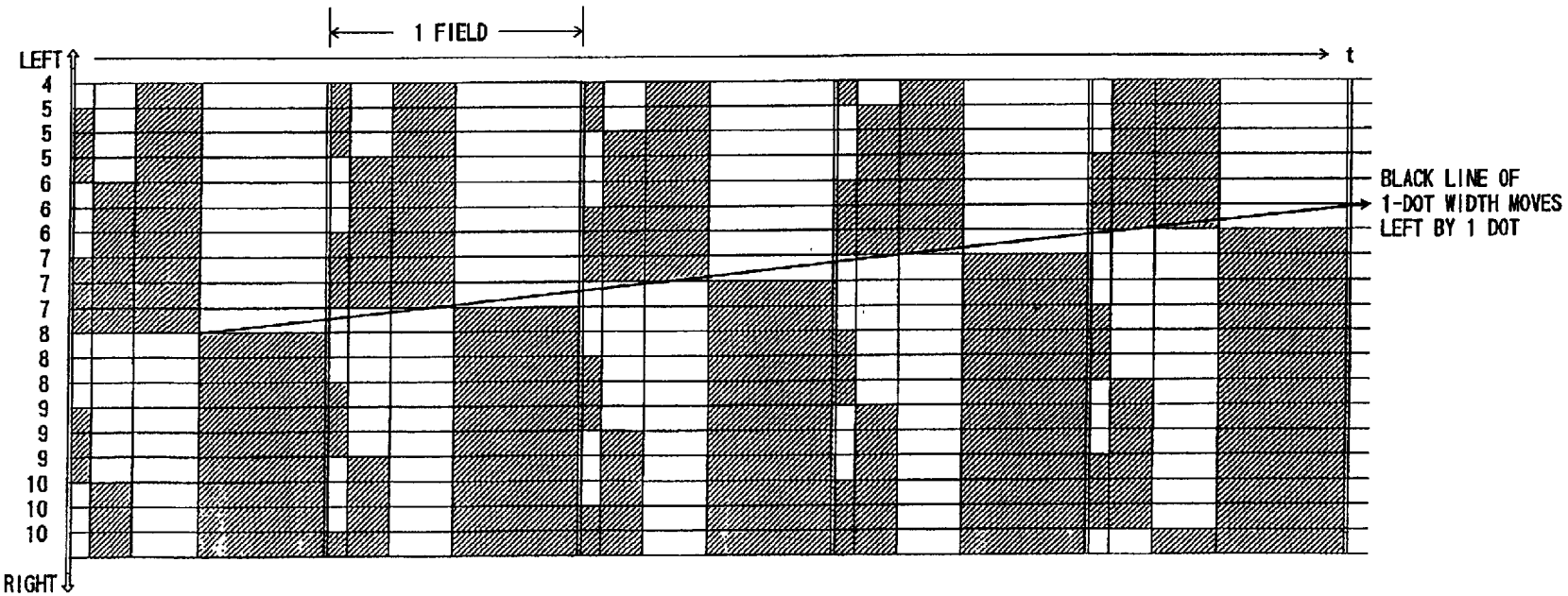
FIG. 4 PRIOR ART
FIG. 4 is a diagram showing a locus of the visual field of the human eyes in a case where a Gray scale image which has a gradation with a width of 3 pixels and in which the luminance gradually increases from the left to right of the image is displayed on a PDP and this image moves at a constant speed towards the left of the screen by an amount corresponding to 1 pixel for every 1 field.
Figure 5:
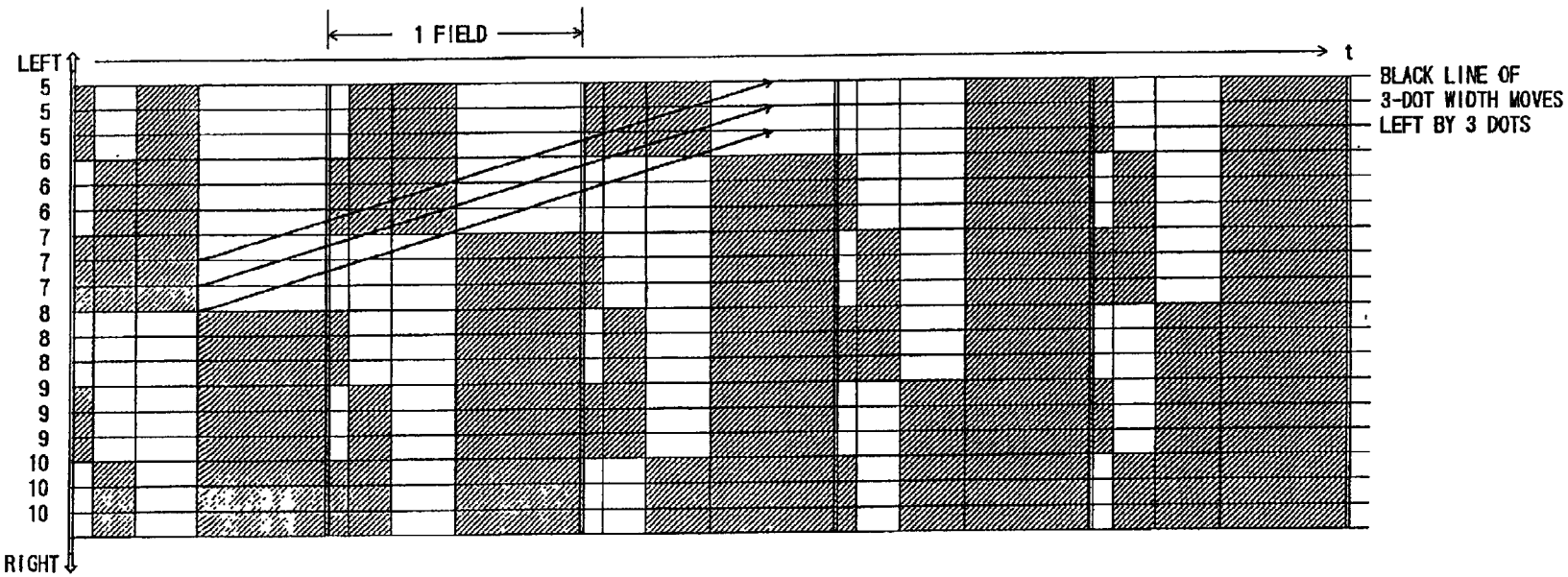
FIG. 5 PRIOR ART
FIG. 5 is a diagram showing a locus of the visual field of the human eyes in a case where a Gray scale image which has the gradation with the width of 3 pixels and in which the luminance increases from the left to right of the image is displayed on a PDP and this image moves at a constant speed towards the left of the screen by an amount corresponding to 3 pixels for every 1 field.
Figure 6:
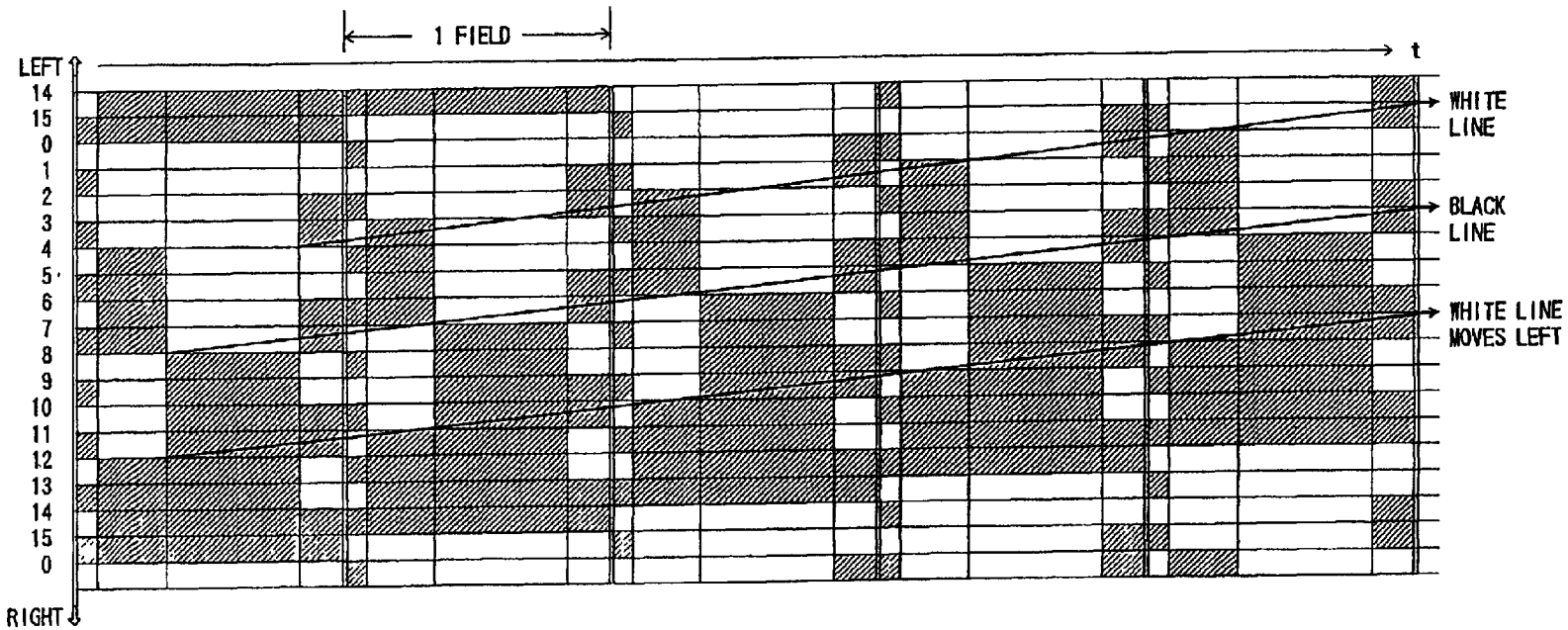
FIG. 6 PRIOR ART
FIG. 6 is a diagram showing a locus of the visual field of the human eyes in a case where a Gray scale image in which the luminance increases from the left to right of the image is displayed on a PDP by changing the sub field structure from that of FIGS. 3 through 6 and this image moves towards the left of the screen by an amount corresponding to 1 pixel for every 1 field.
Figure 7:
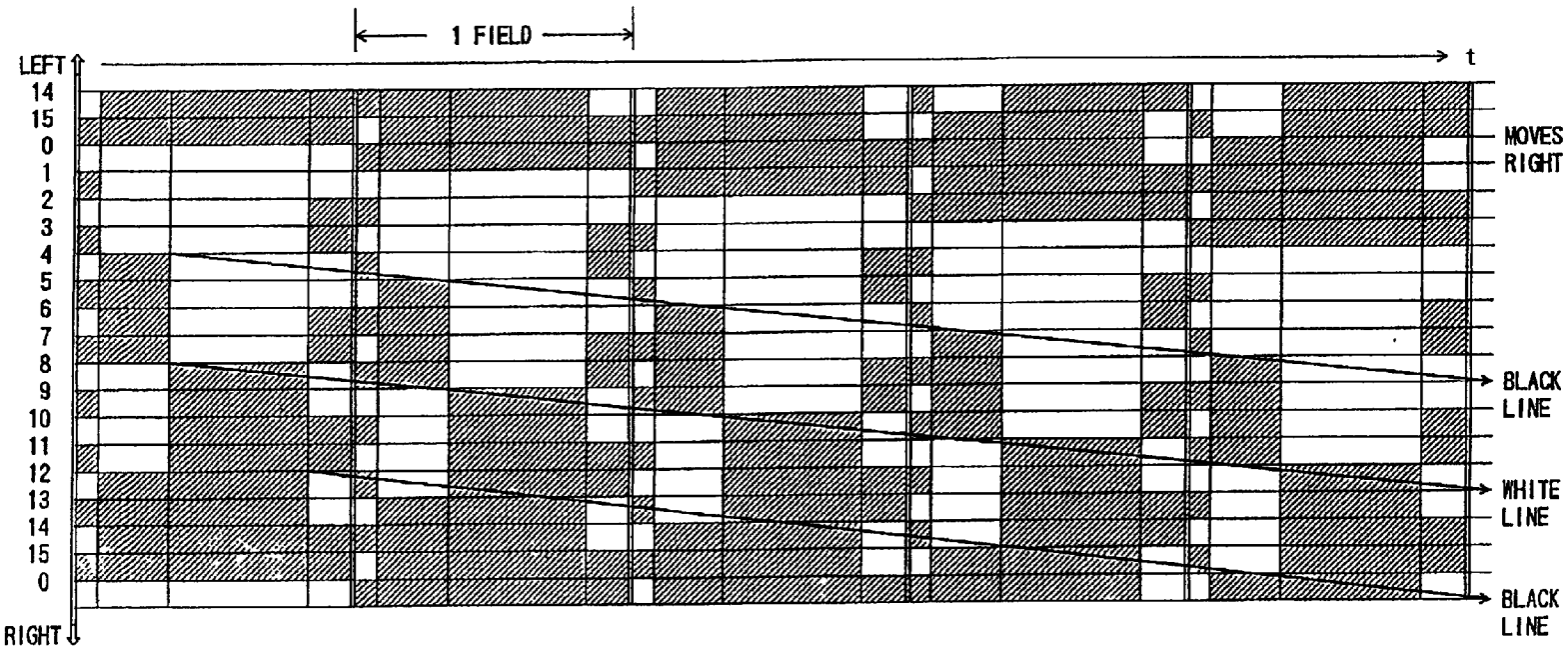
FIG. 7 PRIOR ART
FIG. 7 is a diagram showing a locus of the visual field of the human eyes in a case where a Gray scale image in which the luminance increases from the left to right of the image is displayed on a PDP by changing the sub field structure from that of FIGS. 3 through 6 and this image moves towards the left of the screen by an amount corresponding to 1 pixel for every 1 field.
Figure 8:
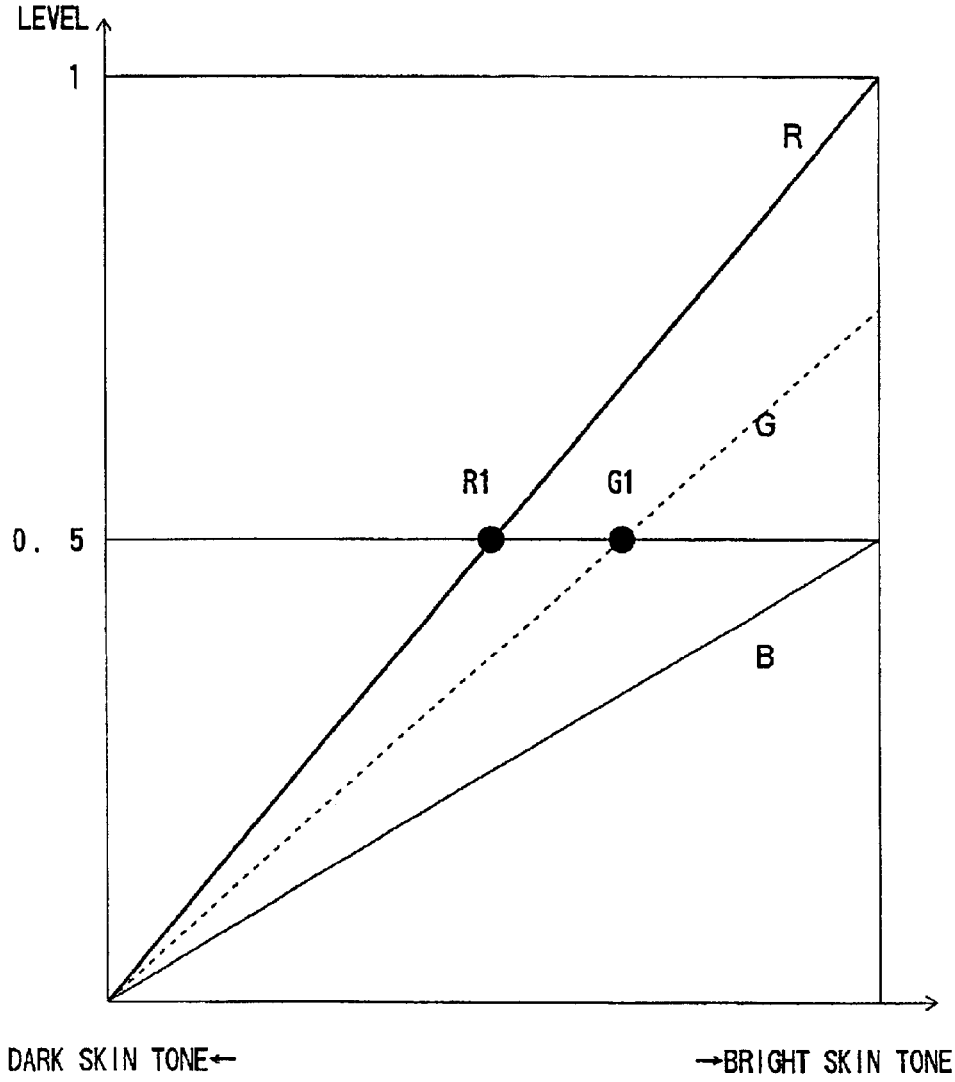
FIG. 8 PRIOR ART
FIG. 8 is a diagram showing a gradation characteristic in a case where ratios of luminance levels of R, G and B for a skin tone are R:G:B:=4:3:2.
Figure 9:
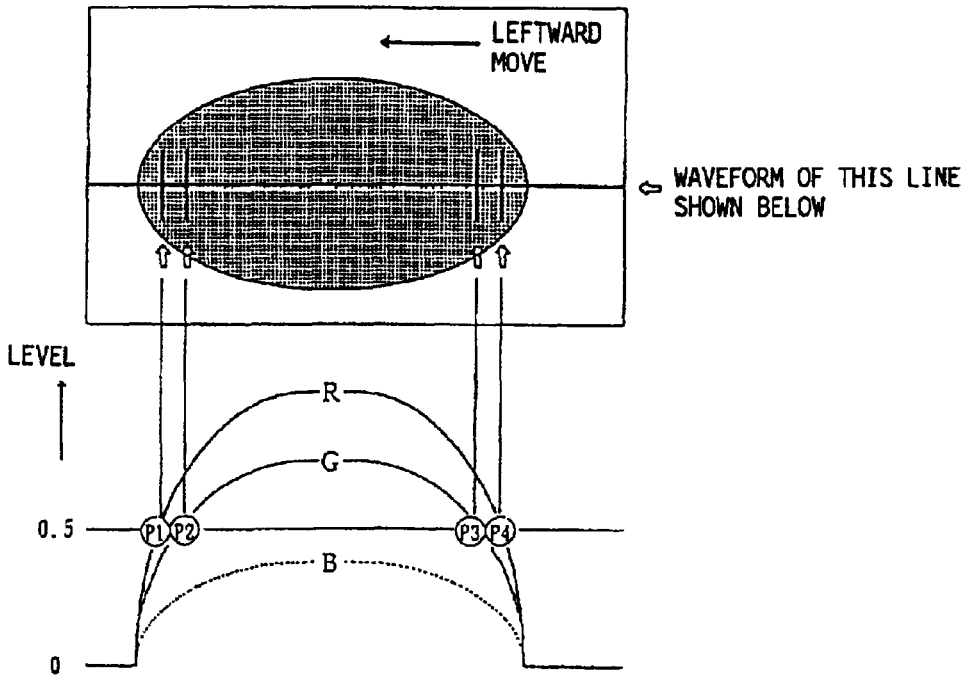
FIG. 9 PRIOR ART
FIG. 9 is a diagram for explaining a case where a moving object having a skin tone moves towards the left of the screen.
Figure 10:
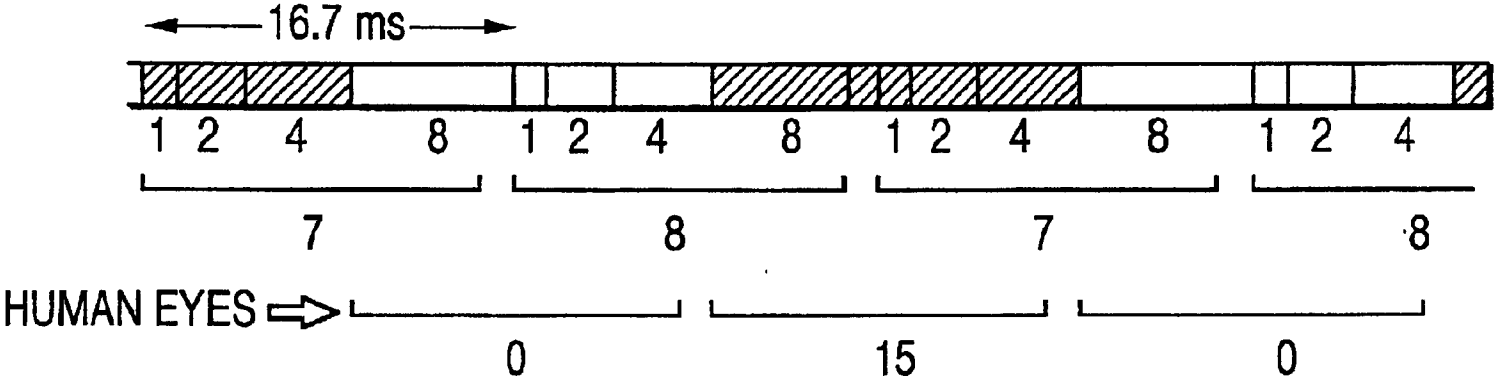
FIG. 10 PRIOR ART
FIG. 10 is a diagram for explaining a flicker which is generated when the luminance level of a pixel changes as 7, 8, 7, 8, . . . for every field.
Figure 11:
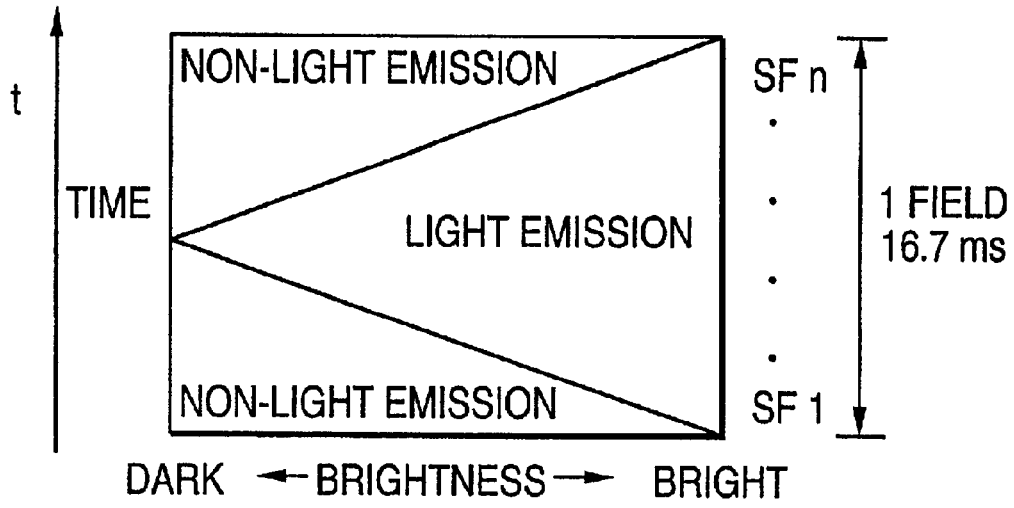
FIG. 11 is a diagram for explaining a sub field structure used in the present invention.

FIG. 11 is a diagram for explaining a sub field structure used in the present invention. In FIG. 11, the ordinate indicates the time, and SF1 through SFn denote sub fields. In addition, the abscissa in FIG. 11 indicates the luminance level, and the luminance of a color becomes darker towards the left and brighter towards the right.

As shown in FIG. 11, the sub fields having the light emission state are arranged on the time base so that the light emission times are uniformly distributed from a central point on the time base towards the front and rear of the time base depending on the luminance level, that is, so that the amount of light increases uniformly from the central point on the time base towards the front and rear of the time base depending on the luminance level. In this particular case, 1 field is approximately 16.7 ms. Hence, the sub field structure is such that the light emission times increase from a time in a vicinity of 8.4 ms towards the front and rear of the time base depending on the luminance level.

Figure 12:
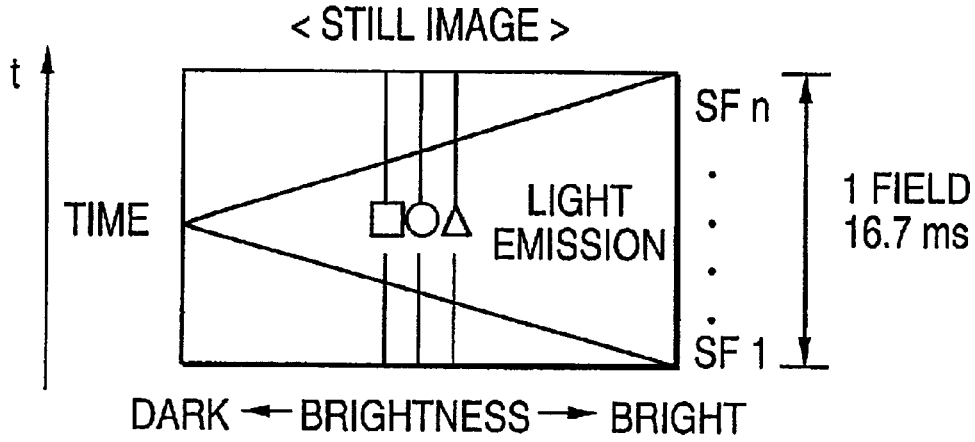
FIG. 12 is a diagram showing a sub field structure of a still Gray scale image.

Next, a description will be given of how a moving object appears to the human eyes when the sub field structure shown in FIG. 11 is used. FIG. 12 shows the sub field structure for a still image, and 3 pixels which are adjacent on the screen and have changing brightness are respectively indicated by a plain square mark, a plain circular mark and a plain triangular mark. FIG. 13A is a diagram showing a case where the image shown in FIG. 12 moves towards the right of the screen, and FIG. 13B is a diagram showing a case where the image shown in FIG. 12 moves towards the left of the screen.

Figure 13B:
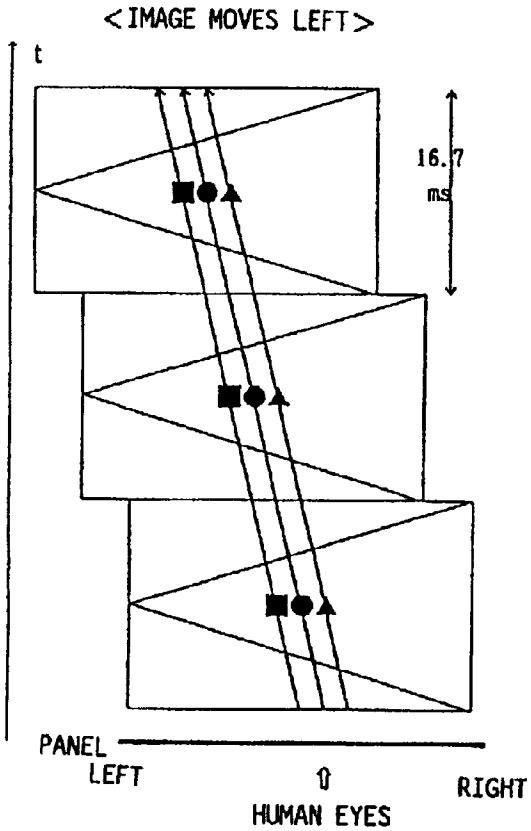
FIGS. 13A and 13B respectively are diagrams for explaining cases where the image shown in FIG. 12 moves towards the right and left of a screen.
Figure 13A:
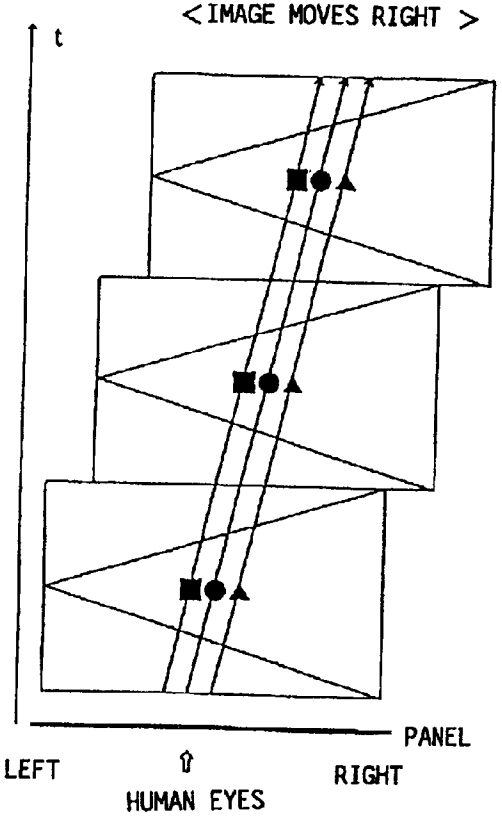

The human line of vision follows the moving object, and traces loci indicated by bold arrows in FIGS. 13A and 13B. Light emission times (amounts of light) of the 3 pixels for this case are respectively indicated by a black (filled) square mark, a black circular mark and a black triangular mark in FIGS. 13A and 13B. In this case, even when the image having the uniform gradation change moves and the human eyes follow this image, the extent of the gradation change of the image does not change. For this reason, a relationship PSM:PCM:PTM=BSM:BCM:BTM stands independently of the moving direction and the moving speed of the moving object, where PSM, PCM, PTM, BSM, BCM and BTM respectively correspond to the plain square mark, plain circular mark, plain triangular mark, black square mark, black circular mark and black triangular mark.

Accordingly, by using the sub field structure described above, the phenomenon in which the light appears sparse or dense when the conventional gradation driving method is employed will not occur, and no pseudo contour will be generated. In addition, in the sub field structure described above, there exists on the time base no portion where the sub fields having the light emission state greatly change, and thus, no flicker will be generated.

Figure 14A:
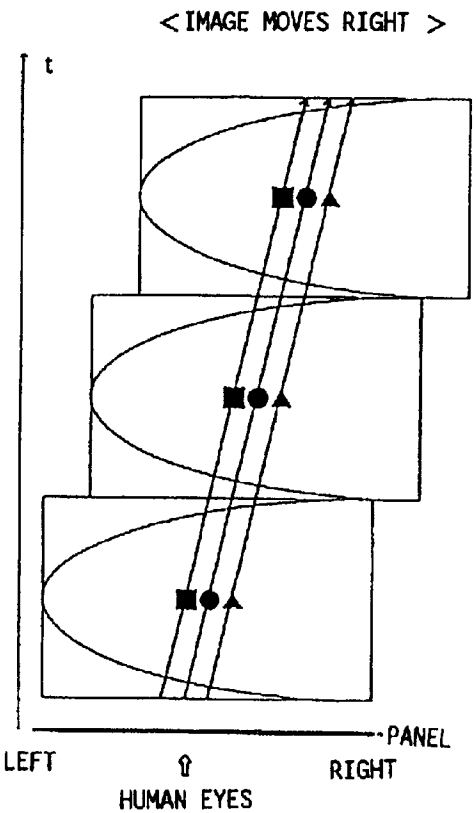
FIGS. 14A and 14B respectively are diagrams for explaining cases where an image in which a light emission time does not increase uniformly from a vicinity of a center point on a time base towards the front and rear of the time base depending on the luminance level, that is, an image in which a change in gradation is not constant, moves towards the right and left of the screen.

Next, a description will be given of an image in which the light emission time does not increase uniformly from a vicinity of a center point on the time base towards the front and rear of the time base depending on the luminance level, that is, an image in which a change in the gradation is not constant. FIG. 14A is a diagram for explaining a case where this still image moves towards the right of the screen, and FIG. 14B is a diagram for explaining a case where this still image moves towards the left of the screen.

In these cases, ratios of the light emission times (amounts of light) of the 3 pixels which are adjacent on the screen and have changing brightness are indicated by PSM:PCM:PTM. In addition, when the ratios of the light emission times (amounts of light) of the 3 pixels when the image moves are indicated by BSM:BCM:BTM, a relationship PSM:PCM:PTM≈BSM:BCM:BTM stands. The light emission times of the 3 pixels for these cases where the image moves are indicated by the black (filled) square mark, the black circular mark and the black triangular mark in FIGS. 14A and 14B, and these black square, circular and triangular marks respectively correspond to BSM, BCM and BTM.

Figure 14B:
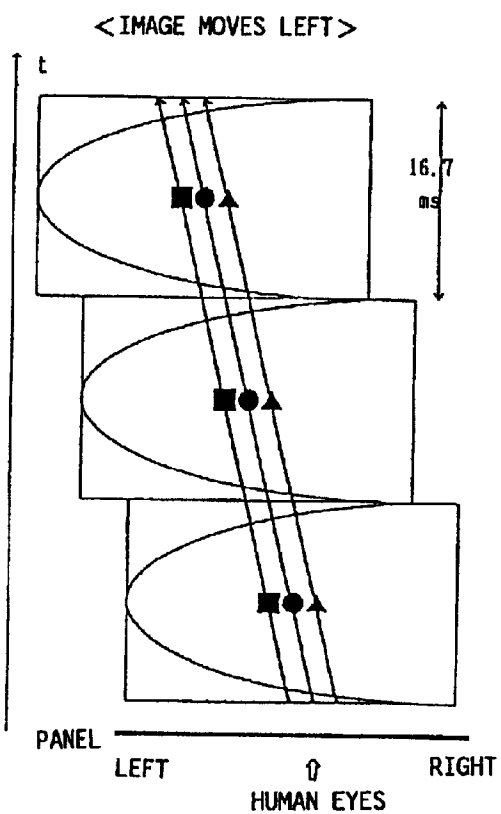

The human line of vision moves and follows the moving object along loci indicated by bold arrows in FIGS. 14A and 14B. Even when the human eyes follow this image, the extent of the gradation change of this image does not change greatly. For this reason, the relationship PSM:PCM:PTM≈BSM:BCM:BTM stands independently of the moving direction and moving speed of the moving object.

Therefore, by using the sub field structure described above, the phenomenon in which the light appears sparse or dense when the conventional gradation driving method is employed is unlikely to occur, and the pseudo contour is unlikely to be generated. In addition, in the sub field structure described above, portions on the time base where the sub fields having the light emission state are likely to change greatly are reduced, thereby reducing the possibility of the flicker being generated.

Next, a description will be given of a first embodiment of a display driving apparatus according to the present invention. This embodiment of the display driving apparatus employs a first embodiment of a display driving method according to the present invention. In addition, it is assumed for the sake of convenience that a sufficient number of sub fields, that is, n sub fields, can be provided within 1 field, and the input image is displayed on the PDP using n+1 gradation levels.

Figure 15:
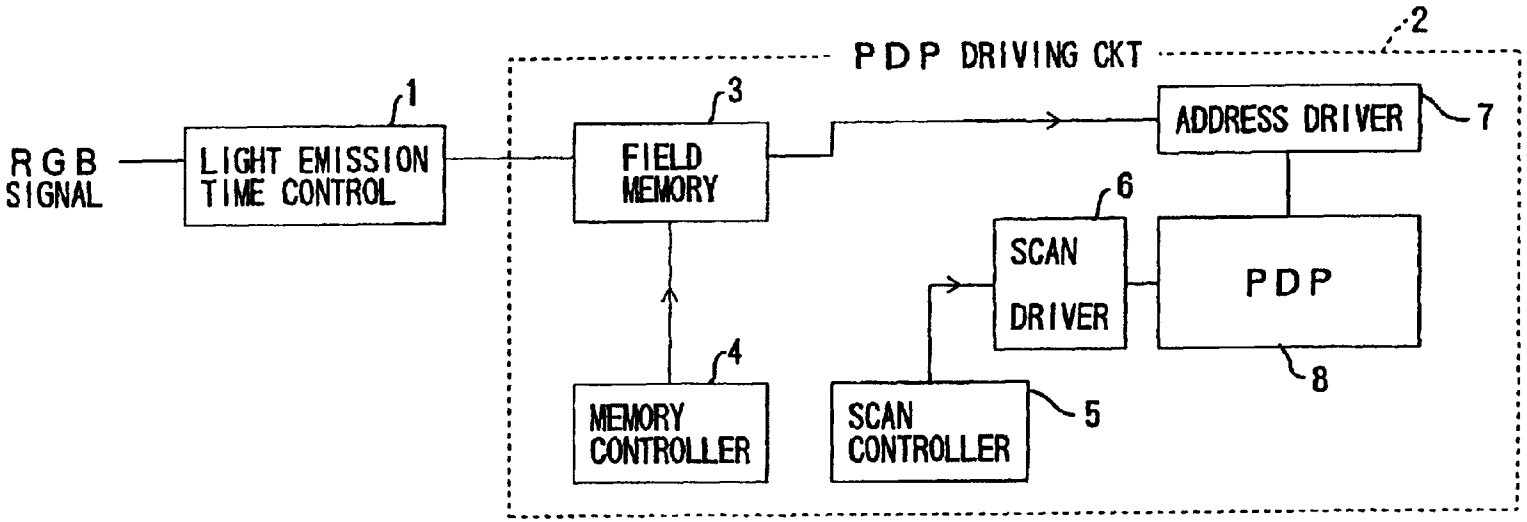
FIG. 15 is a system block diagram showing a first embodiment of a display driving apparatus according to the present invention.

FIG. 15 is a system block diagram showing the first embodiment of the display driving apparatus. The display driving apparatus shown in FIG. 15 generally includes a light emission time control circuit 1 and a PDP driving circuit 2. The PDP driving circuit 2 generally includes a field memory 3, a memory controller 4, a scan controller 5, a scan driver 6, and an address driver 7. In FIG. 15, a PDP 8 is shown within the PDP driving circuit 2 for the sake of convenience.

The light emission time control circuit 1 receives RGB signals as the input image signal, and converts the RGB signals into converted data indicating the times and the sub fields that assume the light emission state for the gradation levels of the RGB signals. The converted data are supplied to the PDP driving circuit 2. This embodiment is particularly characterized by the data conversion carried out in the light emission time control circuit 1. A known circuit may be used for the PDP driving circuit 2, and for this reason, a detailed description of the PDP driving circuit 2 will be omitted. In this embodiment, the converted data are written in and read from the field memory 3 under the control of the memory controller 4. The address driver 7 drives the PDP 8 based on the data read from the field memory 3.

The scan controller 5 controls the driving of the PDP 8 by controlling the scan driver 6. When the PDP 8 is driven by the scan driver 6 and the address driver 7, the wall charge is formed with respect to the pixel which is to emit light within each sub field and sustain (light emission) pulses are generated.

Figure 16:
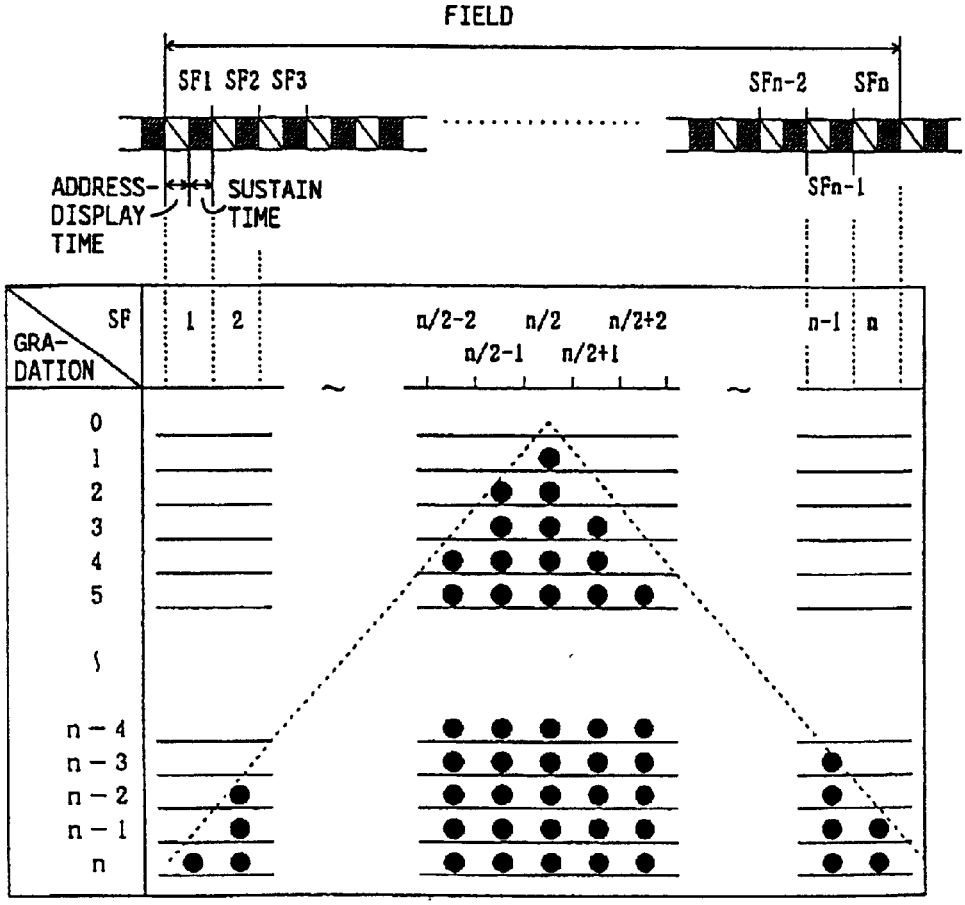
FIG. 16 is a diagram for explaining n sub fields forming 1 field in the first embodiment.

In this embodiment, the sustain times of each of the sub fields are approximately uniform (constant) as shown in FIG. 16. Accordingly, it is possible to display n+1 gradation levels from the level 0 to the level n using the n sub fields which make up 1 field. When the conventional gradation driving sequence is used with respect to the PDP, it is possible to display $2^n$ gradation levels from the level 0 to the level $2_{-1}$ when n sub fields respectively have a width of $2^n$.

In FIG. 16, the light emission state (or light emission time) of the sub fields is indicated by a black circular mark. When n is an odd number, the light emission starts from a sub field number (n+1)/2 which is the center point within 1 field on the time base. On the other hand, when n is an even number, the center point within 1 field does not correspond to a sub field, and for this reason, the light emission is started from a sub field number n/2 or n/2+1 which is closest to the center point. FIG. 16 shows a case where n is an even number, and the light emission is shown as starting from the sub field number n/2.

In this embodiment, the relationship between the gradation levels and the light emission times are set as shown in FIG. 16. Hence, the light emission times increase as indicated by a dotted line in FIG. 16 as the gradation level increases, and it is possible to obtain a sub field structure which approximates an optimum sub field structure for preventing the generation of the pseudo contour and for preventing the generation of the flicker.

The first embodiment described above is effective when a considerable number of sub fields can be provided within 1 field. For example, if 255 sub fields can be provided within 1 field to display an image using 256 gradation levels, it is possible to prevent both the generation of the pseudo contour and the generation of the flicker while securing a sufficiently large number of gradation levels.

However, when the number of sub fields within 1 field is increased, the address display-times (non-light emission times) increase by a corresponding amount. When the number of address display-times increases, the sustain times which can be used for the light emission within 1 field are relatively shortened, thereby deteriorating the screen luminance. Accordingly, there is a limit to the number of sub fields that can be provided within 1 field, and by taking into consideration the increase of the address display-times, it is desirable that the number of sub fields within 1 field is set within a range of approximately 5 to 20.

In the case of the first embodiment, when only 6 fields can be provided within 1 field, for example, the number of displayable gradation levels is 7, and the number of displayable gradation levels is insufficient for the purposes of displaying a natural image.

In addition, as the brightness of the image increases, the light emission times (amounts of light) of the sub fields become relatively large because the light emission times are obtained by equally dividing 1 field into 6 equal parts with respect to all of the gradation levels, that is, 7 gradation levels in this case. For this reason, the light emission times in this case are not exactly increased uniformly from the center point on the time base for the purpose of balancing the sustain times relative to the center point on the time base.

Next, a description will be given of a second embodiment of the display driving apparatus according to the present invention capable of also eliminating the above described inconveniences. In this second embodiment of the display driving apparatus, even when a large number of sub fields cannot be provided within 1 field, it is possible to obtain substantially the same effects as in the case where the optimum sub field structure is employed to prevent the generation of the pseudo contour and to prevent the generation of the flicker. This second embodiment of the display driving apparatus employs a second embodiment of the display driving method according to the present invention.

Figure 17:
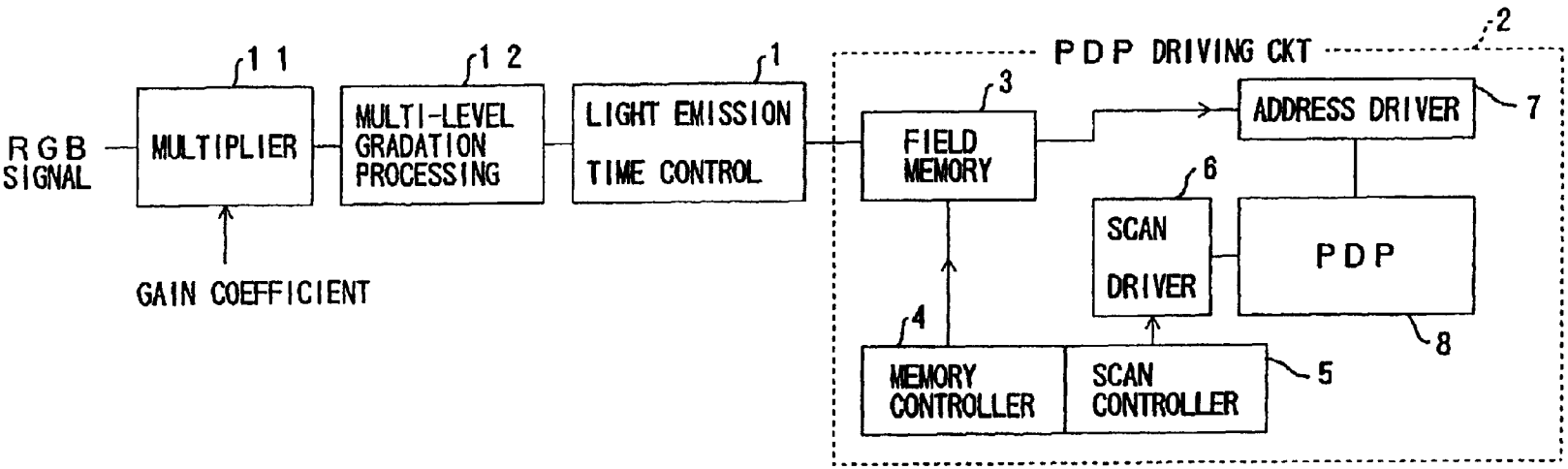
FIG. 17 is a system block diagram showing a second embodiment of the display driving apparatus according to the present invention.

FIG. 17 is a system block diagram showing the second embodiment of the display driving apparatus. The display driving apparatus shown in FIG. 17 generally includes a multiplier (gain control circuit) 11, a multi-level gradation processing circuit 12, the light emission time control circuit 1, and the PDP driving circuit 2. Similarly as in the case shown in FIG. 15, the PDP driving circuit 2 generally includes the field memory 3, the memory controller 5, the scan driver 6, and the address driver 7. For the sake of convenience, the PDP 8 is shown in FIG. 17 as being provided within the PDP driving circuit 2.

First, a description will be given of the multi-level gradation processing circuit 12 shown in FIG. 17. According to the error diffusion technique, an error component E(x, y) is diffused to the peripheral pixels at a constant ratio, where the error component E(x, y) is a difference between a luminance g(x, y) of the original image to be originally displayed and a luminance P(x, y) that can actually be displayed on the PDP 8 or the like and is described by E(x, y)=g(x, y)−P(x, y). The diffused error component is added with an original luminance (x+n, y+n) of the pixel at each position, and a difference between the added result and a luminance P(x+n, y+n) that can actually be displayed becomes the error component (x+n, y+n) of this pixel. By repeating such a process, the error diffusion technique artificially describes the luminance of the original image by a plurality of pixels, that is, by a certain area.

Figure 18:
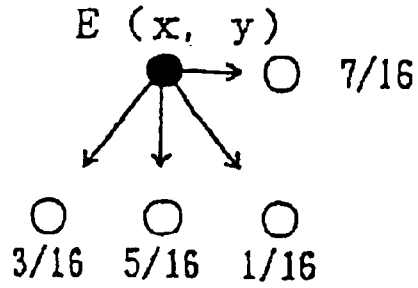
FIG. 18 is a diagram for explaining distribution ratios of an error component with respect to peripheral pixels.

In this embodiment, the distribution ratios of the error component to the peripheral pixels are set so as to obtain a satisfactory image quality. In other words, as shown in FIG. 18, the distribution ratio of the error component with respect to the pixel adjacent to the right is 7/16, 1/16 with respect to the pixel adjacent to the bottom right, 5/16 with respect to the pixel immediately adjacent to the bottom, and 3/16 with respect to the pixel adjacent to the bottom left.

Figure 19:
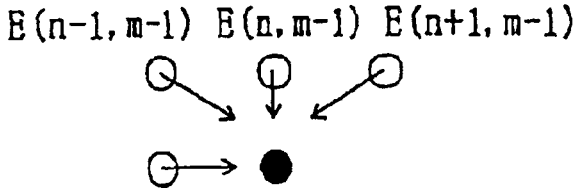
FIG. 19 is a diagram for explaining an error calculation using an error diffusion technique.

According to the error diffusion technique, error calculation results E(n−1, m), E(n−1, m−1), E(n, m−1) and E(n+1, m−1) are used to determine the display level of P(n, m) as shown in FIG. 19. In this case, G(n, m)=P(n, m)+E(n, m)=(7/16)E(n−1, m)+(1/16)E(n−1, m−1)+(5/16)E(n, m−1)+(3/16)E(n+1, m−1). For this reason, in order to apply the above to the display of a moving image, it is necessary to complete the calculation for 1 pixel within 1 dot (pixel) clock cycle, because it is impossible to employ the technique of providing a double pipeline structure and reducing the processing speed to one-half. In this case, the process of adding the data E(n−1, m) which is 1 pixel to the left in the horizontal direction and G(n, m) particularly becomes a problem, and this calculation loop is the drawback to the process.

In addition, the separation of the display data and the error data also becomes a problem according to the error diffusion technique. However, this embodiment employs a bit boundary data separation method which is considered effective from the point of view of the moving speed. For example, when the input image data has 8 bits and the number of bits of the actually displayable gradation levels on the PDP 8 is 6 bits, the upper 6 bits are used as they are as the display data in accordance with the number of bits of the displayable gradation levels, and the remaining lower 2 bits are used as the error data. Hence, the separation of the display data and the error data can be realized by the use of a simple bit shift register, and the bit boundary data separation method is effective from the point of view of improving the operation speed of the error accumulation part and the like.

Figure 20:
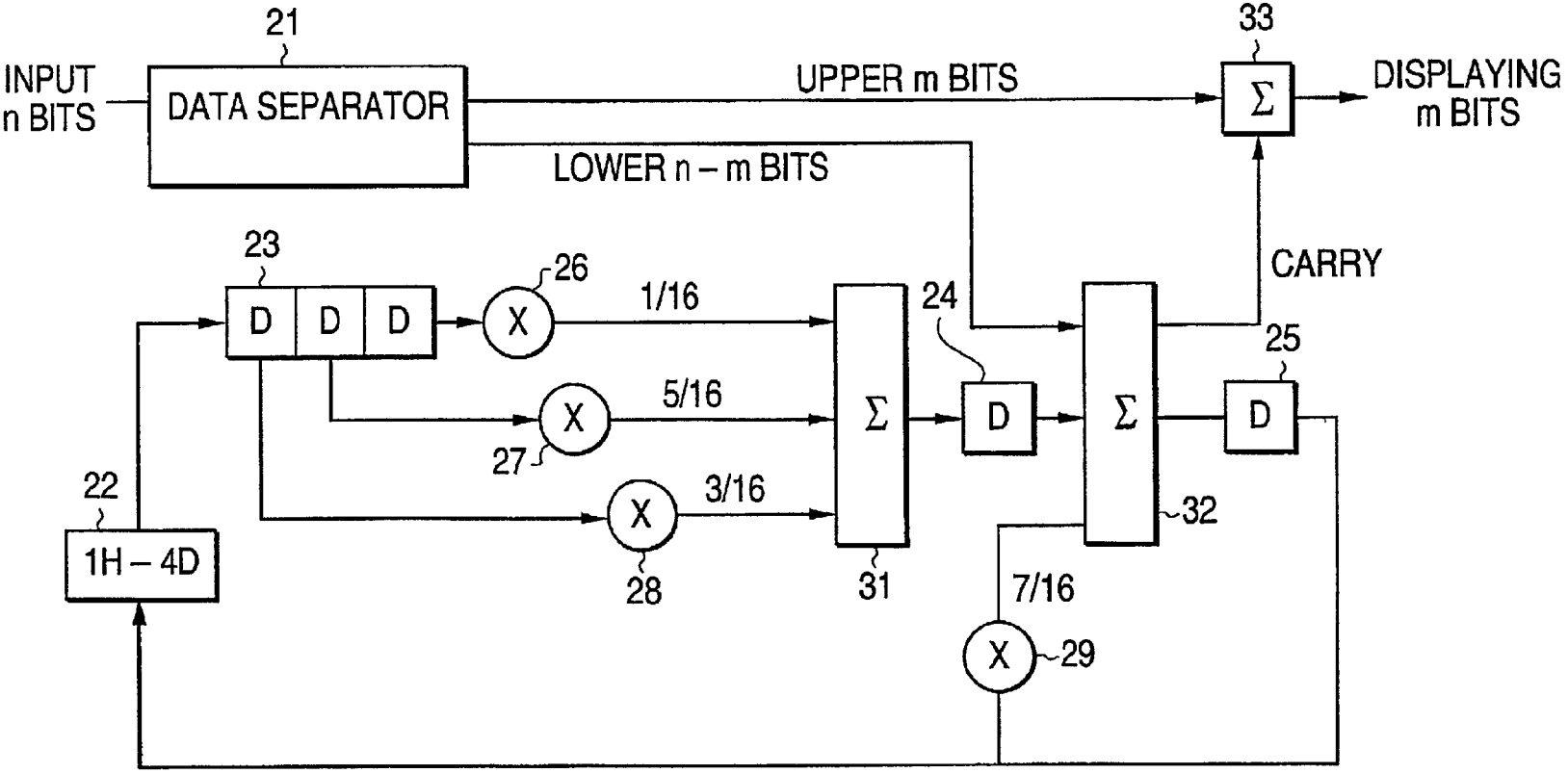
FIG. 20 is a system block diagram showing an embodiment of the construction of a multi-level gradation processing circuit.

FIG. 20 is a system block diagram showing an embodiment of the construction of the multi-level gradation processing circuit 12. The multi-level gradation processing circuit 12 shown in FIG. 20 generally includes a data separator 21, delay circuits 22 through 25, multipliers 26 through 29, and adders 31 through 33 which are connected as shown. In FIG. 20, D denotes a delay of 1 dot (pixel) clock, and H denotes a delay of 1 line.

In FIG. 20, an n-bit data related to the original image is input to the data separator 21, and upper m bits of the n-bit data are supplied to the adder 33 while lower n-m bits of the n-bit data are supplied to the adder 32. The adder 32 adds the lower n−m bits, an output of the delay circuit 24 having a delay time D and an output of the multiplier 29, and supplies an added result to the delay circuit 25 having a delay time D. In addition, a carry bit output from the adder 32 is supplied to the adder 33. An output of the delay circuit 25 is supplied to the adder 32 via the multiplier 29 which multiplies a coefficient 7/16 on one hand, and is supplied to the delay circuit 22 having a delay time 1H–4D on the other.

An output of the delay circuit 22 is supplied to the delay circuit 23. The delay circuit 23 delays the output of the delay circuit 22 by a delay time 3D and supplies the delayed output to the multiplier 26 which multiplies a coefficient 1/16. The delay circuit 23 also delays the output of the delay circuit 22 by a delay time 2D and supplies the delayed output to the multiplier 27 which multiplies a coefficient 5/16. In addition, the delay circuit 23 delays the output of the delay circuit 22 by a delay time 1D and supplies the delayed output to the multiplier 28 which multiplies a coefficient 3/16. Outputs of the multipliers 26 through 28 are all supplied to the adder 31, and an output of the adder 31 is supplied to the delay circuit 24. As a result, an m-bit display data is output from the adder 33.

Figure 21:
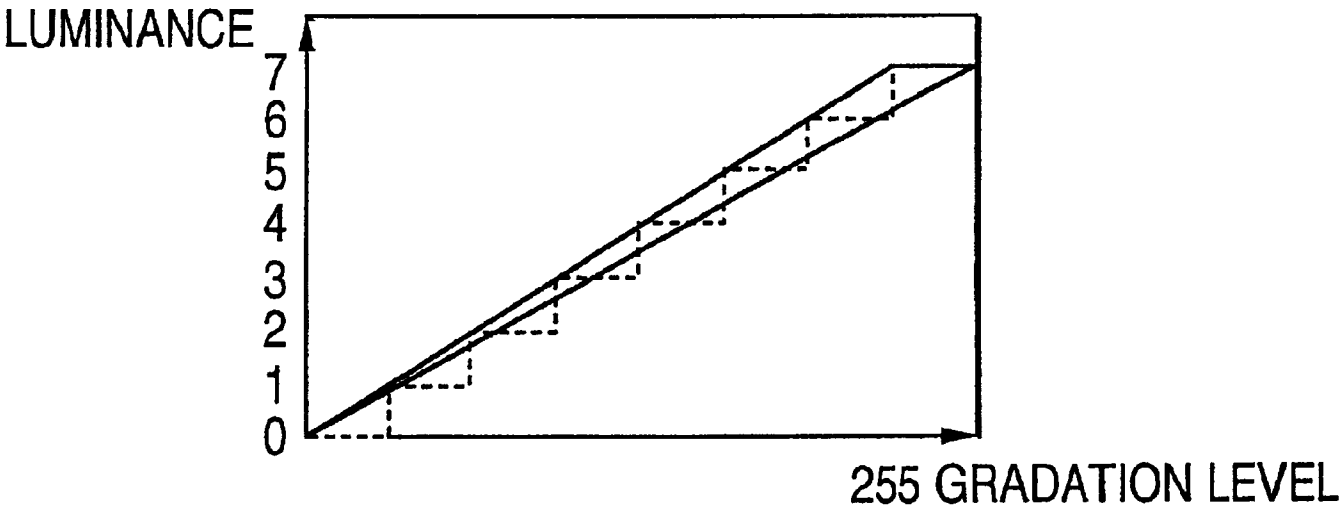
FIG. 21 is a diagram for explaining a mechanism by which a gradation distortion occurs.

The multi-level gradation processing circuit 12 is satisfactory from the point of view of the processing speed and the circuit scale. However, a gradation distortion may be generated depending on the number of gradation levels to be displayed. FIG. 21 is a diagram for explaining the mechanism by which the gradation distortion is generated. In FIG. 21, the ordinate indicates the luminance level, and the abscissa indicates the number of gradation levels. For the sake of convenience, it is assumed in FIG. 21 that an 8-bit input image data is displayed in 8 luminance levels (display gradation levels) from the level 0 to the level 7, that is, by 3 bits. When no error diffusion process is carried out, a staircase waveform indicated by a dotted line in FIG. 21 and having 8 steps is obtained. But when the error diffusion process is carried out in the multi-level gradation processing circuit 12, the display characteristic is smoothened as indicated by a bold line in FIG. 21. In FIG. 21, a thin solid line indicates the display characteristic of the 256 gradation levels to be displayed.

In this case, however, the upper 3 bits of the 256 gradation levels "00000000" through "11111111" of the input data are used unchanged as the display data and the lower 5 bits which are ignored are used unchanged as the error data. For this reason, the display characteristic saturates at the bright portion of the image and the contrast undergoes an abrupt change at the dark portion. Such a tendency becomes notable particularly when the number of gradation levels (number of bits) actually displayable on the PDP 8 becomes small. FIG. 21 shows a case where the number of bits displayed is 3 bits, but for example, when approximately 6 bits (64 gradation levels) are secured as the number of display gradation levels in the conventional case, a flat portion of the display characteristic occupies 1/64 of the entire gradation region, and it was judged that no notable image quality deterioration occurs since the gradation characteristic only undergoes abrupt changes which are extremely small.

But in this embodiment, only N+1 gradation levels from the level 0 to the level N can be displayed even through 1 field is made up of N sub fields. For example, when N=6, only 7 gradation levels from the level 0 to the level 6 are displayable. In this case, the flat portion of the display characteristic occupies 1/4 of the entire gradation region, and the image quality deterioration of the display data with respect to the all of the gradation levels of the input image data can no longer be neglected.

Accordingly, in this embodiment, the multiplier 11 shown in FIG. 17 is provided, so as to obtain a display characteristic which is smooth throughout the entire gradation region of the input image data regardless of the number of displayable gradation levels of the PDP 8. In other words, the multiplier 11 is provided at a stage preceding the multi-level gradation processing circuit 12, so as to multiply to the input image data a gain coefficient which is set depending on the number of gradation levels displayable on the PDP 8. Hence, the data related to the original image, in which the upper bits are the display data and the lower bits are the error data, is output from the multiplier 11 and supplied to the multi-level gradation processing circuit 12. The multi-level gradation processing circuit 12 separates the display data and the error data at the bit boundary of the upper bits and the lower bits, and the error diffusion process is carried out based on the separated data.

As a result, it is possible to solve the problem of saturating display characteristic and the problem of the flat portion of the display characteristic when the display gradation level does not match the bit boundary. For example, when the original image data is represented in 256 gradation levels and the display gradation level has 5 bits (levels 0 through 31), the gain coefficient of the multiplier 11 is set to 31×8/255=248/255. On the other hand, when the original image data is represented in 256 gradation levels and the display gradation level has levels 0 through 6, the gain coefficient of the multiplier 11 is set to 6×32/255=192/255. In each of these cases, the upper bits of the data output from the multiplier 11 are the display data and the remaining lower bits are the error data. For this reason, it is possible to carry out the error diffusion process and obtain a desired display characteristic by supplying the output data of the multiplier 11 to the multi-level gradation processing circuit 12.

Figure 22:
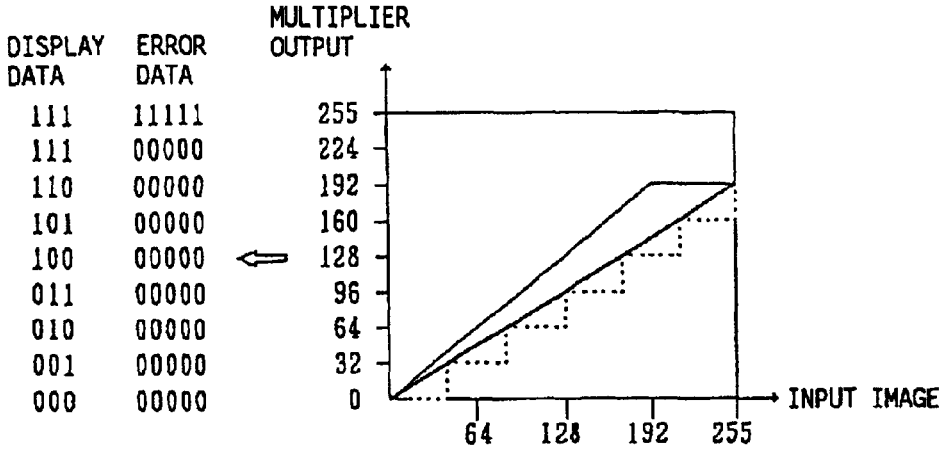
FIG. 22 is a diagram for explaining a difference in display characteristics between a case where a multiplier is provided and a case where no multiplier is provided.

FIG. 22 is a diagram for explaining a difference of the display characteristics between a case where the multiplier 11 is provided and the multiplier 11 is not provided. In FIG. 22, the ordinate indicates the data supplied to the multi-level gradation processing circuit 12, and the abscissa indicates the gradation level (luminance level) of the input original image data. In FIG. 22, a thin solid line indicates the display characteristic for the case where the multiplier 11 is not provided, a bold line indicates the display characteristic for the case where the multiplier 11 is provided as in this embodiment, and a dotted line indicates the actual display characteristic. For the sake of convenience, FIG. 22 shows the display characteristics assuming that the original image data is represented in 256 gradation levels, the display gradation levels are levels 0 to 6, and the gain coefficient of the multiplier 11 is 6×32/255=192/255.

As indicated by the thin solid line in FIG. 22, when the multiplier 11 is not provided, 1/4 of the display characteristic becomes flat throughout the entire gradation region of the input original image data 0 through 255. On the other hand, when the multiplier 11 is provided as in this embodiment, no flat portion is generated in the display characteristic for the entire gradation region of the input original image data 0 through 255, as indicated by the bold line in FIG. 22. Hence, it is possible to make a pseudo (or artificial) intermediate tone display by the error diffusion process.

In other words, the gain coefficient is multiplied to the original image data (RGB signals) input to the multiplier 11 and the multiplication result is output from the multiplier 11. In this state, the relationship of the input and the output of the multiplier 11 becomes as indicated by the bold line in FIG. 22. For example, when the upper 3 bits of the output data of the multiplier 11 are the display data and the lower 5 bits are the error data, the relationship of the display data and the error data becomes as shown on the left hand side of FIG. 22. Although dependent upon the construction of the multiplier 11, it is possible to obtain a smoother display characteristic in the multi-level gradation processing circuit 12 at the subsequent stage when the number of bits of the error data are set so that the bit extension to the lower bits due to the multiplication with respect to the original image data is made larger.

Next, a description will be given of the construction and operation of the light emission time control circuit 1 shown in FIG. 17. In this embodiment, the gradation level and the light emission time are set as follows in the light emission time control circuit 1.

Figure 23:
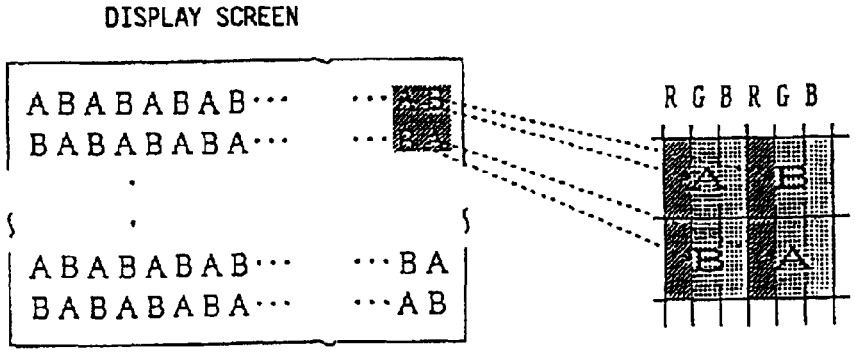
FIG. 23 is a diagram for explaining an operation of dividing all pixels on the screen into 2 groups so as to have a checker-board arrangement.

First, all of the pixels on the screen are divided into 2 groups A and B so as to have a checker-board arrangement as shown on the left hand side of FIG. 23. When a unit made up of pixels of R, G and B is taken as 1 pixel, 4 pixels shown on the top right of the screen on the left hand side of FIG. 23 have the structure shown on the right hand side of FIG. 23. However, in the following description, the data processing will be described for the pixel of one of the three primary colors R, G and B (that is, 1 channel), and the data processing related to the remaining 2 primary colors (that is, 2 channels) will be omitted for the sake of convenience.

Figure 24A:
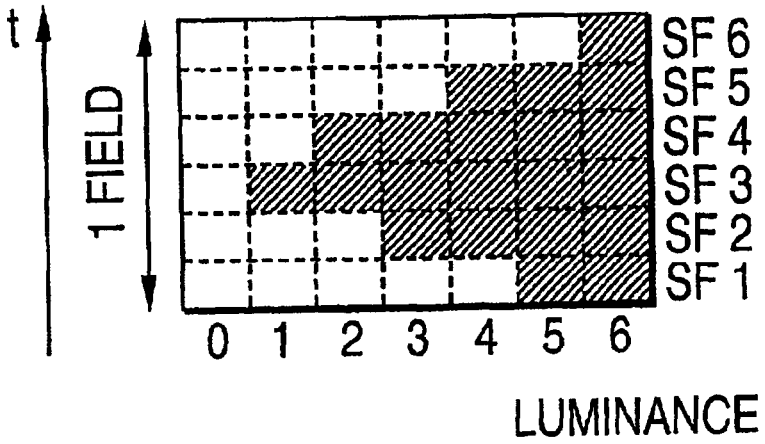
FIGS. 24A and 24B respectively are diagrams for explaining settings of sub fields which have a light emission state depending on an increase in brightness.
Figure 24B:
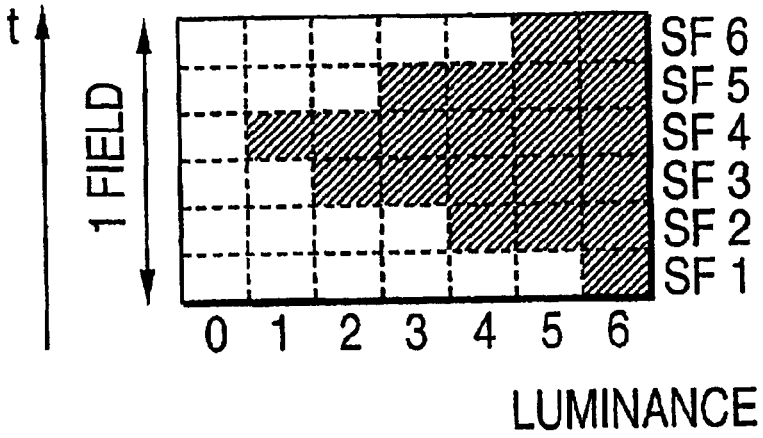

In this embodiment, the light emission sequence of the pixels of the groups A and B is set as follows. For example, when 1 field is made up of 6 sub fields SF1 through SF6, the number of sub fields making up 1 field is an even number, and a sub field matching the center point on the time base does not exist. Hence, the light emission with respect to a minimum luminance level 1 is started from the sub field SF3 for the group A and is started from the sub field SF4 for the group B. The light emission with respect to a luminance level 2 is made in the sub fields SF1 and SF2 for the group A and is made in the sub fields SF1 and SF2 for the group B. In other words, the sub fields (times) in which the light emission is to take place are set as shown in FIGS. 24A and 24B depending on the increase of the brightness. FIG. 24A shows the light emission state of the sub fields for the group A, and FIG. 24B shows the light emission state of the sub fields for the group B. In FIGS. 24A and 24B, the ordinate indicates the time, the abscissa indicates the luminance level having the 7 gradation levels 0 through 6, and the sub fields having the light emission state are indicated by the hatching.

When a person watches the image displayed on the screen, an averaged amount of light from the pixels of the groups A and B which are arranged in the checker-board pattern on the screen is sensed by the human eyes because the human eyes collectively look at a certain area on the screen. Accordingly, although the amount of light from the pixel does not increase uniformly about the center point on the time base for each of the groups A and B alone, the combined amount of light from the pixels of the groups A and B are sensed by the human eyes as increasing uniformly about the center point on the time base.

Figure 25:
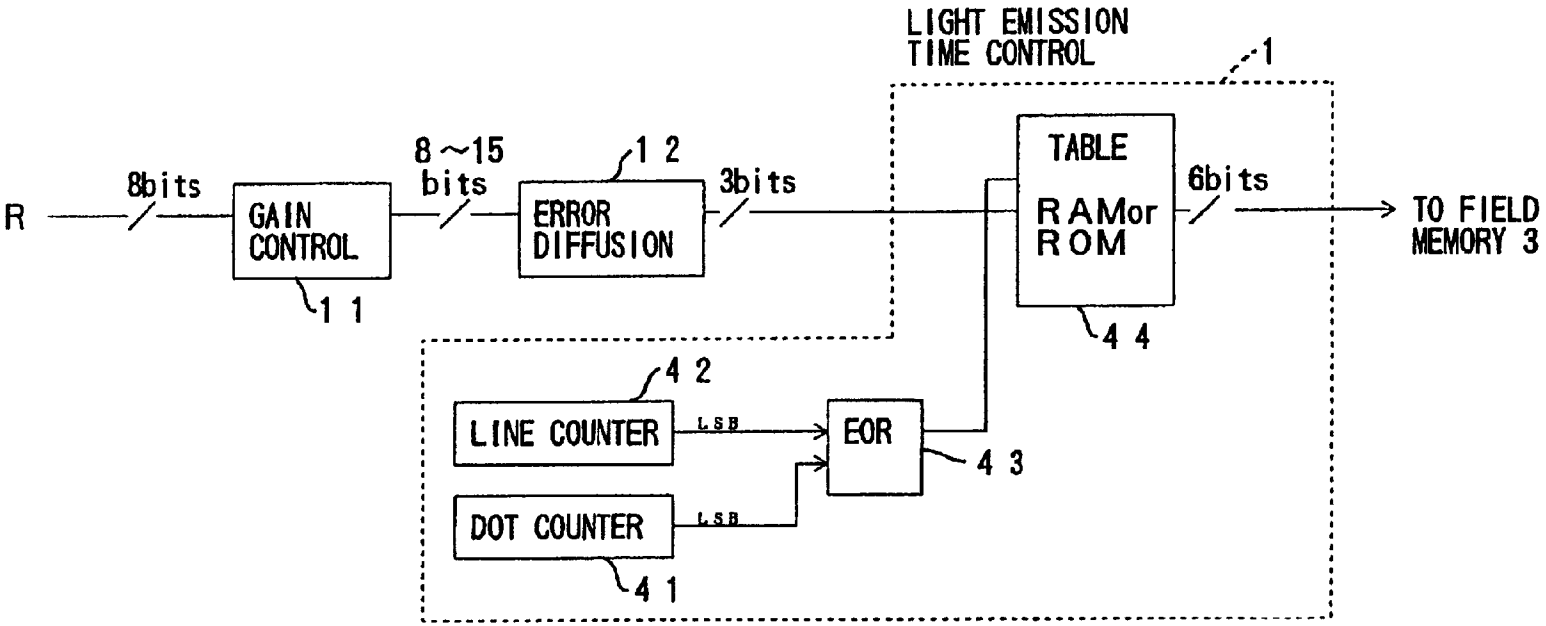
FIG. 25 is a system block diagram showing an embodiment of the construction of a light emission time control circuit together with the multiplier and the multi-level gradation processing circuit.

FIG. 25 is a system block diagram showing an embodiment of the construction of the light emission time control circuit 1 together with the multiplier 11 and the multi-level gradation processing circuit 12. In FIG. 25, only a processing system for the data related to the pixels of 1 of the three primary colors R, G and B (that is, 1 channel) is shown for the sake of convenience. For example, an 8-bit R data is supplied to the multiplier 11, and data having 8 to 15 bits is supplied from the multiplier 11 to the multi-level gradation processing circuit 12. A 3-bit data from the multi-level gradation processing circuit 12 is supplied to a processing system which is within the light emission time control circuit 1 and is provided with respect to the R data.

The light emission time control circuit 1 generally includes a dot counter 41, a line counter 42, an exclusive-OR circuit 43, and a table 44 made up of a random access memory (RAM) or a read only memory (ROM). The dot counter 41 counts the number of dots (pixels) in the horizontal direction based on a pixel clock or the like, and a LSB of the counted value is supplied to the exclusive-OR circuit 43. On the other hand, the line counter 42 counts the number of dots (pixels) in the vertical direction based on the pixel clock or the like, and supplies a LSB of the counted value to the exclusive-OR circuit 43. The exclusive-OR circuit 43 obtains an exclusive-OR of the LSBs from the counters 41 and 42, and supplies an output value to the table 44 as a most significant bit (MSB) of the address. The table 44 also receives the 3-bit data from the multi-level gradation processing circuit 12 as the remaining bits of the address. Hence, a 6-bit data related to the sub field to assume the light emission state is read from the specified address of the table 44 which has a data map shown in FIG. 26, for example, and the read 6-bit data is supplied to the field memory 3 shown in FIG. 17.

A memory capacity required of the RAM or ROM which forms the table 44 may be obtained as follows. When making the display in 7 gradation levels, that is, using the luminance levels 0 to 6, 3 bits are required for the address and 1 bit is required to select the pixels of the groups A and B. Hence, a total of 4 bits are required for the address. On the other hand, when 1 field is made up of 6 sub fields, a data width of 6 bits is required. Accordingly, the RAM or ROM which forms the table 44 must have a memory capacity of $15\times6=96$ bits in this case.

As described above, when 1 field is made up of 6 sub fields, for example, only 7 gradation levels using the luminance levels 0 to 6 can be displayed, and the number of displayable gradation levels is insufficient for the purpose of displaying a natural image. Hence, the multiplier 11 and the multi-level gradation processing circuit 12 are respectively provided at a stage preceding the light emission time control circuit 1 as shown in FIG. 17 and described above. By the provision of the multiplier 11 and the multi-level gradation processing circuit 12, it is possible to increase the number of apparent gradation levels. A description will be given in the following with respect to cases where the number of sub fields forming 1 field is an even number and an odd number.

Figure 27A:
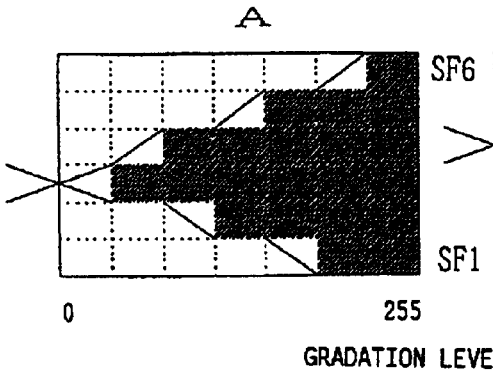
FIGS. 27A and 27B respectively are diagrams for explaining display gradation characteristics of pixels in groups A and B.
Figure 27B:
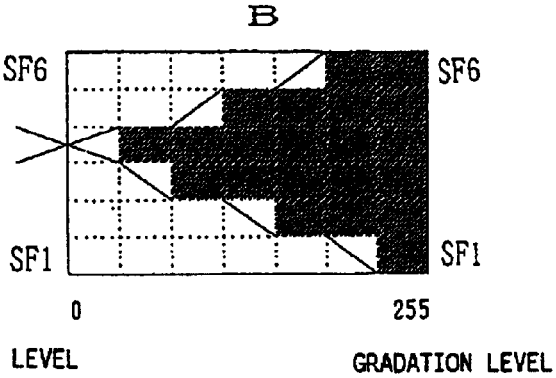

When an even number of sub fields form 1 field, such as the case where the even number is 6, a gradation interpolation is made by the error diffusion process of the multi-level gradation processing circuit 12, and the display gradation characteristics of the pixels of the groups A and B respectively become as shown in FIGS. 27A and 27B. In FIGS. 27A and 27B, the ordinate indicates the time, the abscissa indicates the number of gradation levels, and the sub fields which assume the light emission state are indicated by the hatching.

Figure 28:
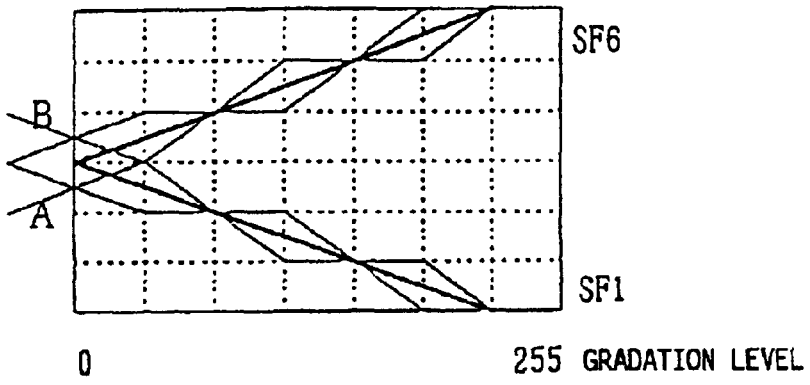
FIG. 28 is a diagram showing an apparent display gradation characteristic.
Figure 29:
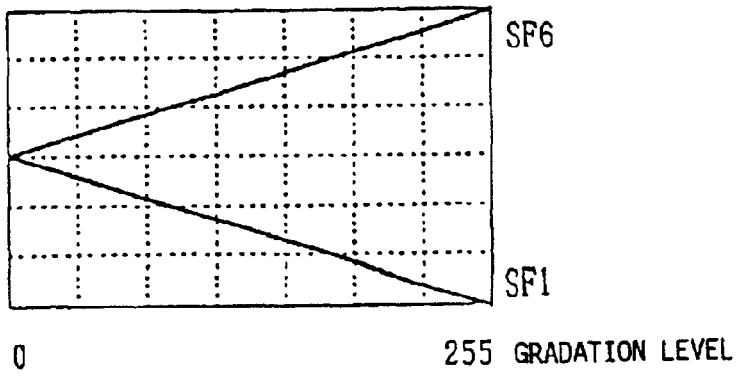
FIG. 29 is a diagram showing an apparent relationship between each gradation of input original image data and light emission time of sub fields.

To the human eyes, the pixels of the groups A and B having the display gradation characteristics shown in FIGS. 27A and 27B appear averaged, and the apparent display gradation characteristic becomes as indicated by a bold line in FIG. 28. For this reason, by multiplying the gain coefficient 192/255 (=32×6/255) in the multiplier 11 provided at the stage preceding the multi-level gradation processing circuit 12 for the purpose of matching the 7 display gradation levels and the number of gradation levels of the original image data, it becomes possible to set the apparent relationship between each gradation level of the input original image data and the light emission times of the sub fields as shown in FIG. 29. In FIGS. 28 and 29, the ordinate indicates the time, and the abscissa indicates the number of gradation levels of the input original image data.

In other words, even though 1 field is made up of a small number of sub fields, it is possible to set the structure of each field to approximate the optimum sub field structure (that is, the relationship of the gradation levels and the light emission times) that prevents the generation of the pseudo contour and prevents the generation of the flicker. As a result, it is possible to obtain basically the same effects as the first embodiment described above.

Figure 30A:
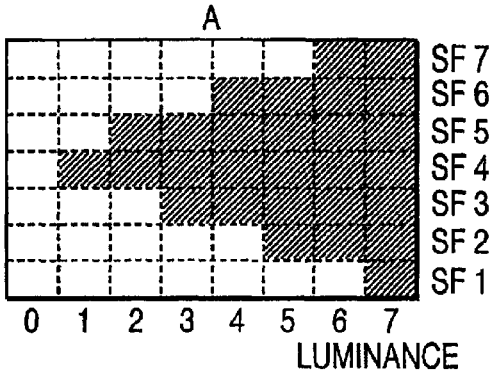
FIGS. 30A and 30B respectively are diagrams showing relationships of the sub fields and the light emission times of the pixels in the groups A and B for a case where 1 field is made up of 7 sub fields.
Figure 30B:
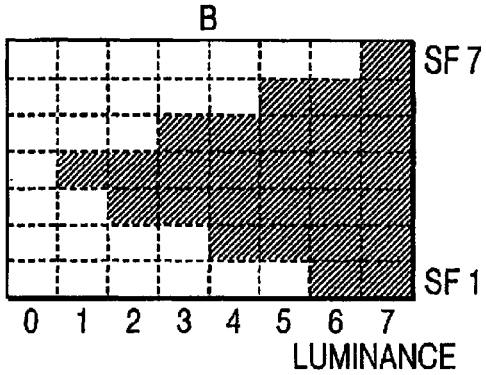

On the other hand, when an odd number of sub fields form 1 field, such as the case where the odd number is 7, the relationship between the light emission times of the pixels of the groups A and B and the sub fields becomes as shown in FIGS. 30A and 30B. FIG. 30A shows the sub fields which assume the light emission state for the pixel of the group A, and FIG. 30B shows the sub fields which assume the light emission state for the pixel of the group B. In FIGS. 30A and 30B, the ordinate indicates the time, the abscissa indicates the luminance level in 8 gradation levels 0 to 7, and the sub fields which assume the light emission state are indicated by the hatching.

Figure 31A:
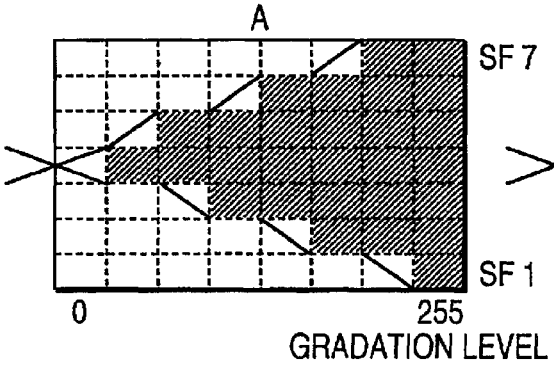
FIGS. 31A and 31B respectively are diagrams showing the display gradation characteristics of the pixels in the groups A and B.
Figure 31B:
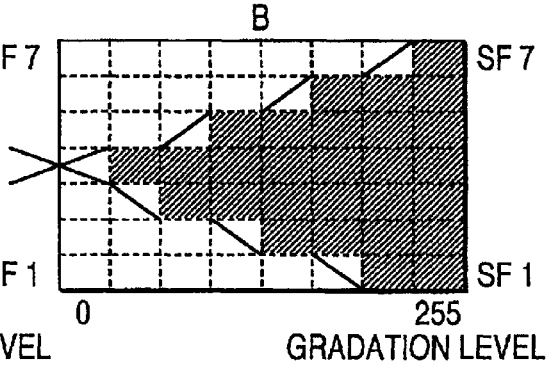

A gradation interpolation is made by the error diffusion process of the multi-level gradation processing circuit 12, and the display gradation characteristics of the pixels of the groups A and B respectively become as shown in FIGS. 31A and 31B. In FIGS. 31A and 31B, the ordinate indicates the time, the abscissa indicates the number of gradation levels, and the sub fields which assume the light emission state are indicated by the hatching.

Figure 32:
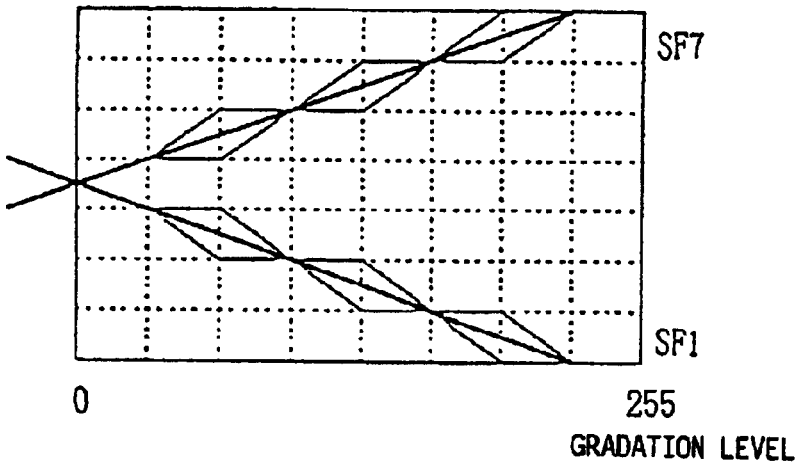
FIG. 32 is a diagram showing an apparent display gradation characteristic for a case where the pixels in the groups A and B having the display gradation characteristics shown in FIGS. 31A and 31B are viewed by human eyes and averaged.
Figure 33:
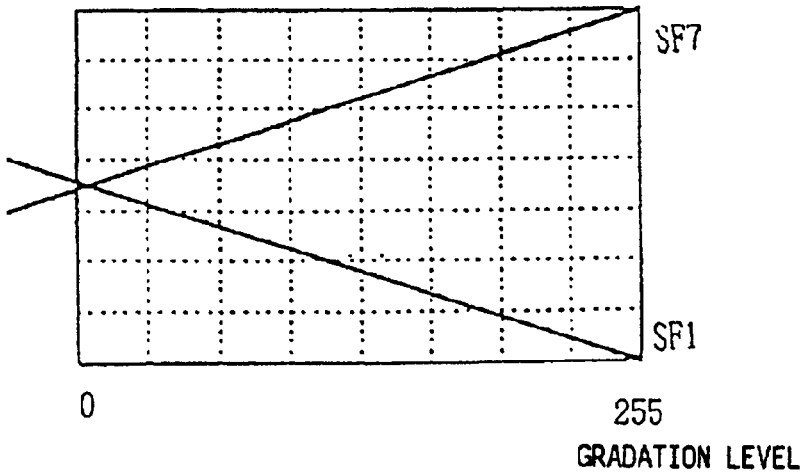
FIG. 33 is a diagram showing an apparent relationship between the light emission times of the sub fields and each gradation of the input original image data obtained through multiplication in the multiplier.

To the human eyes, the pixels of the groups A and B having the display gradation characteristics shown in FIGS. 31A and 31B appear averaged, and the apparent display gradation characteristic becomes as indicated by a bold line in FIG. 32. For this reason, by multiplying the gain coefficient 224/255 (=32×7/255) in the multiplier 11 provided at the stage preceding the multi-level gradation processing circuit 12 for the purpose of matching the 8 display gradation levels and the number of gradation levels of the original image data, it becomes possible to set the apparent relationship between each gradation level of the input original image data and the light emission times of the sub fields as shown in FIG. 33. In FIGS. 32 and 33, the ordinate indicates the time, and the abscissa indicates the number of gradation levels of the input original image data.

In other words, even though 1 field is made up of a small number of sub fields, it is possible to set the structure of each field to approximate the optimum sub field structure (that is, the relationship of the gradation levels and the light emission times) that prevents the generation of the pseudo contour and prevents the generation of the flicker. As a result, it is possible to obtain basically the same effects as the first embodiment described above.

Therefore, regardless of whether 1 field is made up of a relatively small odd number or even number of sub fields, it is possible to obtain substantially the same effects as those obtainable in the first embodiment described above.

Figure 34A:
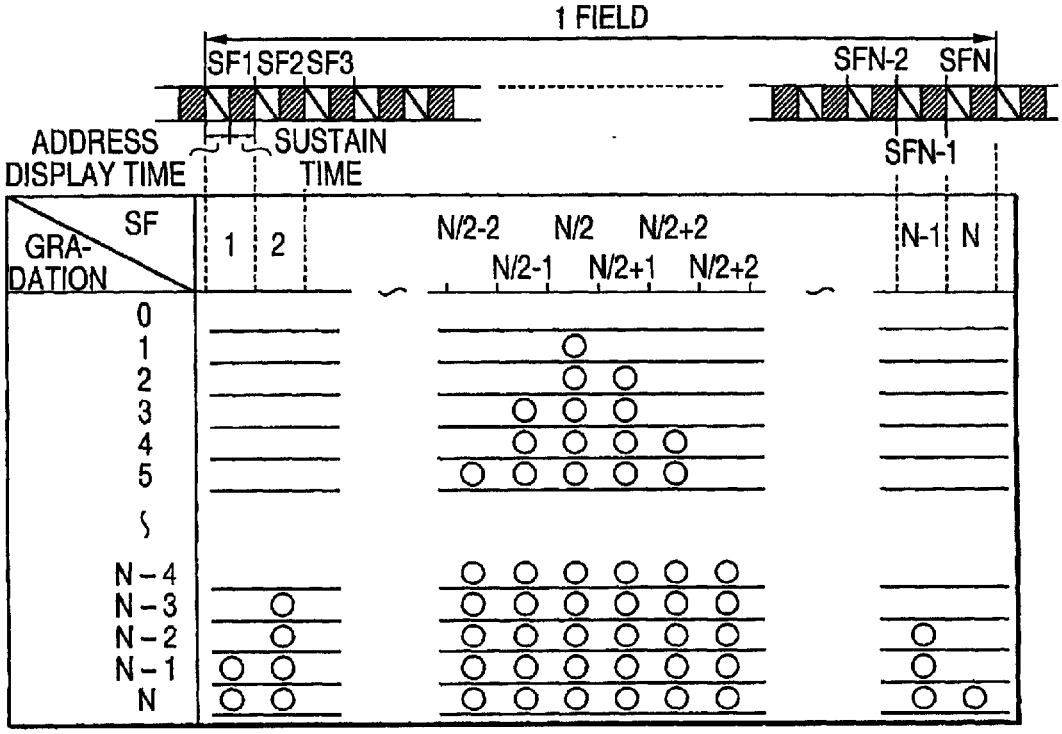
FIGS. 34A and 34B respectively are diagrams showing sustain times with respect to the pixels in the groups A and B for a case where an even number of sub fields make up 1 field.
Figure 34B:
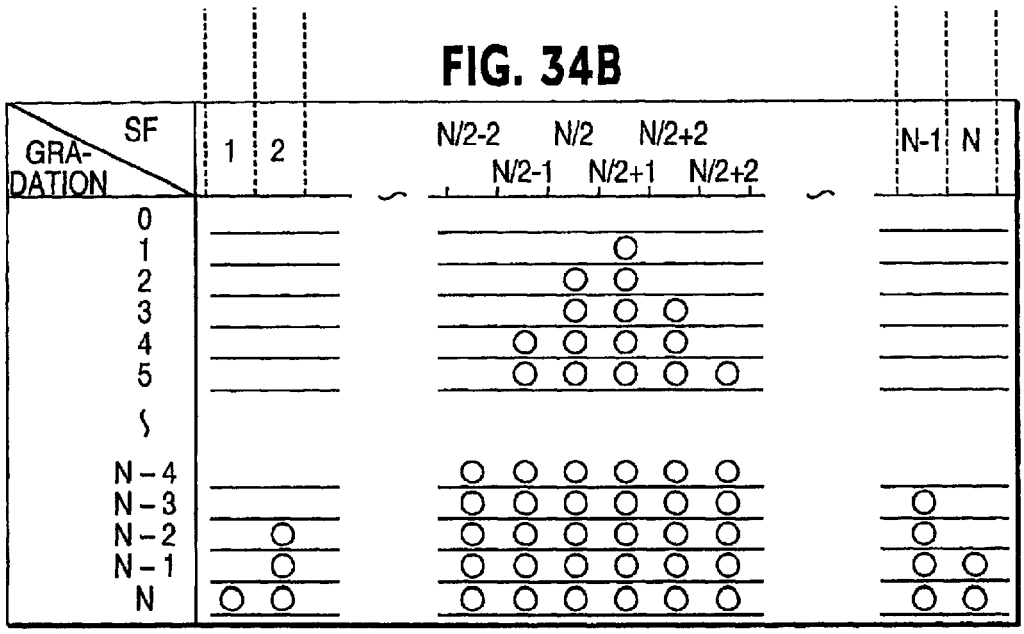
Figure 35A:
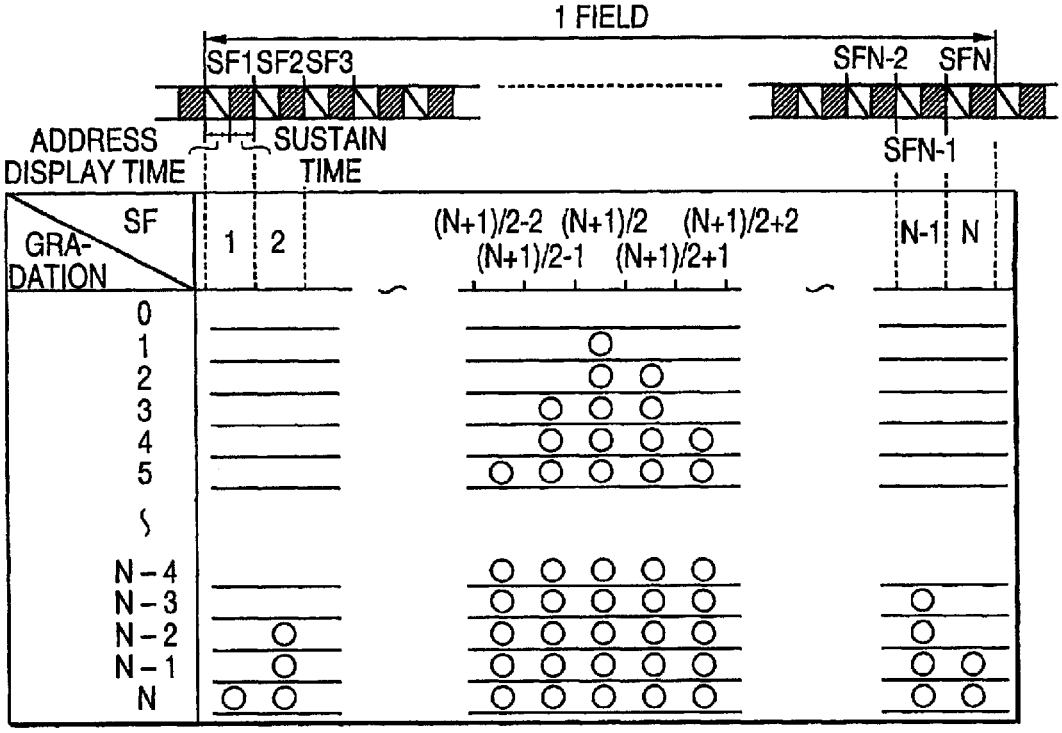
FIGS. 35A and 35B respectively are diagrams showing the sustain times with respect to the pixels in the groups A and B for a case where an odd number of sub fields make up 1 field.
Figure 35B:
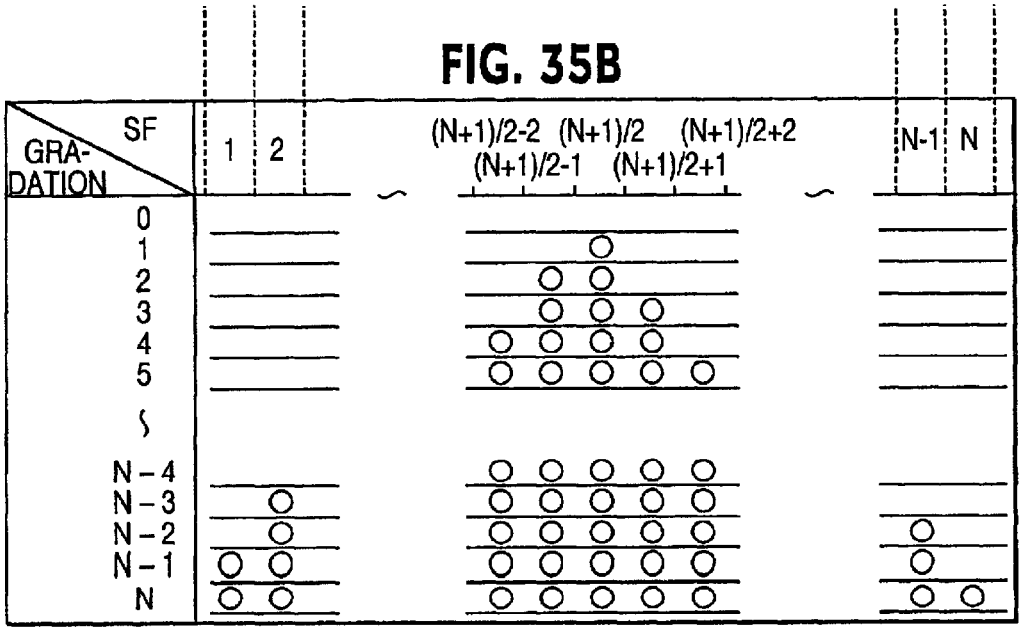

In this embodiment, the sustain times of each of the sub fields are made approximately uniform (constant) as shown in FIGS. 34A, 34B, 35A and 35B. FIGS. 34A and 34B respectively show the sustain times with respect to the pixels of the groups A and B for the case where the number of sub fields forming 1 field is an even number. FIGS. 35A and 35B respectively show the sustain times with respect to the pixels of the groups A and B for the case where the number of sub fields forming 1 field is an odd number. Accordingly, it is possible to display N+1 gradation levels from the level 0 to the level N using the N sub fields which form 1 field.

In FIGS. 34A, 34B, 35A and 35B, the sub fields assuming the light emission state are indicated by a black circular mark. When N is an even number, the light emission starts from the sub field number N/2 with respect to the pixels of the group A, and the light emission starts from the sub field number (N+1)/2 with respect to the pixels of the group B. On the other hand, when N is an odd number, the light emission starts from the sub field number (N+1)/2 with respect to the pixels of the group A, and the light emission starts from the sub field number N/2 with respect to the pixels of the group B.

In other words, as shown in FIG. 34A, with respect to the pixel of the group A for the case where N is an even number, no sub field assumes the light emission state for the gradation level (luminance level) 0, the sub field SF(N/2) assumes the light emission state for the gradation level 1, the sub field SF(N/2+1) assumes the light emission state for the gradation level 2 in addition to that which assumes the light emission state for the gradation level 1, the sub field SF(N/2−1) assumes the light emission state for the gradation level 3 in addition to those which assume the light emission state for the gradation level 2, . . . , the sub field SF1 assumes the light emission state for the gradation level N−1 in addition to those which assume the light emission state for the gradation level N−2, and the sub field SFN assumes the light emission state for the gradation level N in addition to those which assume the light mission state for the gradation level N−1, that is, all sub fields assume the light emission state for the gradation level N. Further, as shown in FIG. 34B, with respect to the pixel of the group B, no sub field assumes the light emission state for the gradation level 0, the sub field SF(N/2+1) assumes the light emission state for the gradation level 1, the sub field SF(N/2) assumes the light emission state for the gradation level 2 in addition to that which assumes the light emission state for the gradation level 1, the sub field SF(N/2+2) assumes the light emission state for the gradation level 3 in addition to those which assume the light emission state for the gradation level 2, . . . , the sub field SFN assumes the light emission state for the gradation level N−1 in addition to those which assume the light emission state for the gradation level N−2, and the sub field SF1 assumes the light emission state for the gradation level N in addition to those which assume the light emission state for the gradation level N−1, that is, all sub fields assume the light emission state for the gradation level N.

On the other hand, as shown in FIG. 35A, with respect to the pixel of the group A for the case where N is an odd number, no sub field assumes the light emission state for the gradation level (luminance level) 0, the sub field SF((N+1)/2) assumes the light emission state for the gradation level 1, the sub field SF((N+1)/2+1) assumes the light emission state for the gradation level 2 in addition to that which assumes the light emission state for the gradation level 1, the sub field SF((N+1)/2−1) assumes the light emission state for the gradation level 3 in addition to those which assume the light emission state for the gradation level 2, . . . , the sub field SFN assumes the light emission state for the gradation level N−1 in addition to those which assume the light emission state for the gradation level N−2, and the sub field SF1 assumes the light emission state for the gradation level N in addition to those which assume the light emission state for the gradation level N−1, that is, all sub fields assume the light emission state for the gradation level N. Further, as shown in FIG. 35B, with respect to the pixel of the group B, no sub field assumes the light emission state for the gradation level 0, the sub field SF((N+1)/2) assumes the light emission state for the gradation level 1, the sub field SF((N+1)/2−1) assumes the light emission state for the gradation level 2 in addition to that which assumes the light emission state for the gradation level 1, the sub field SF((N+1)/2+1) assumes the light emission state for the gradation level 3 in addition to those which assume the light emission state for the gradation level 2, . . . , the sub field SF1 assumes the light emission state for the gradation level N−1 in addition to those which assume the light emission state for the gradation level N−2, and the sub field SFN assumes the light emission state for the gradation level N in addition to those which assume the light emission state for the gradation level N−1, that is, all sub fields assume the light emission state for the gradation level N.

Next, a description will be given of modifications of the first and second embodiments described above.

Figure 36A:
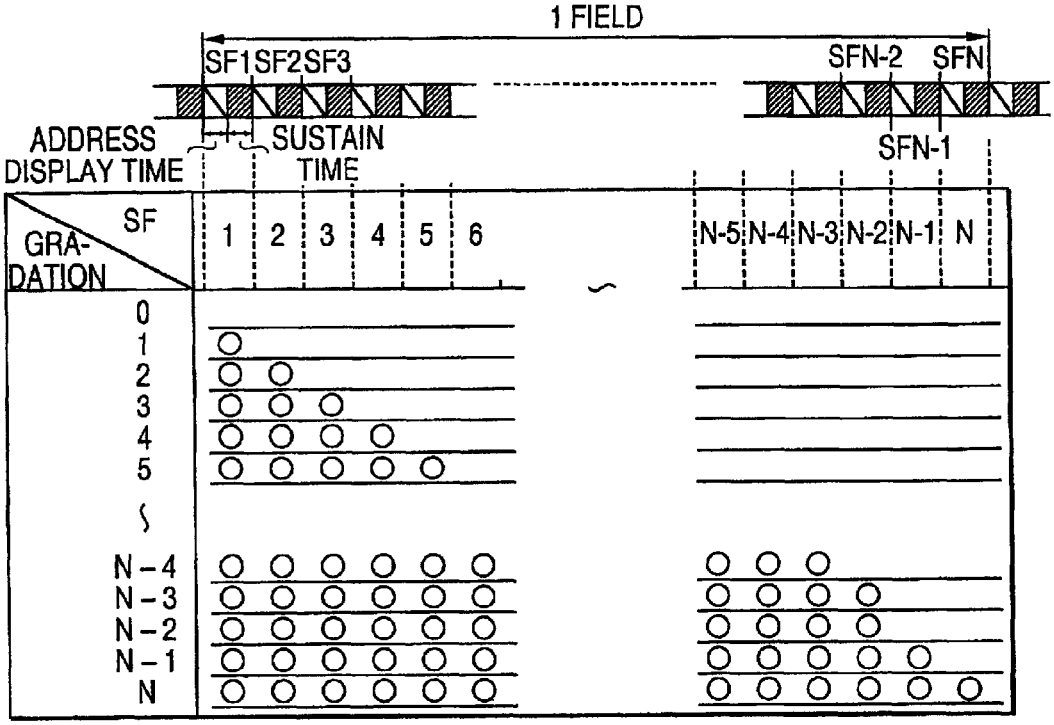
FIGS. 36A and 36B respectively are diagrams showing the sustain times with respect to the pixels in the groups A and B for modifications of the first and second embodiments.

In a first modification of the first embodiment of the display driving method and the first embodiment of the display driving apparatus, the sustain times of each of the sub fields are set approximately uniform (constant) as shown in FIG. 36A. As shown in FIG. 36A, no sub field assumes the light emission state for the gradation level (luminance level) 0, the sub field SF1 assumes the light emission state for the gradation level 1, the sub field SF2 assumes the light emission state for the gradation level 2 in addition to that which assumes the light emission state for the gradation level 1, the sub field SF3 assumes the light emission state for the gradation level 3 in addition to those which assume the light emission state for the gradation level 2, . . . , the sub field SF(N−1) assumes the light emission state for the gradation level N−1 in addition to those which assume the light emission state for the gradation level N−2, and the sub field SFN assumes the light emission state for the gradation level N in addition to those which assume the light emission state for the gradation level N−1, that is, all sub fields assume the light emission state for the gradation level N. Accordingly, it is possible to display N+1 gradation levels from the level 0 to the level N using the N sub fields which form 1 field. In FIG. 36A, the sub fields assuming the light emission state are indicated by a black circular mark.

Figure 36B:
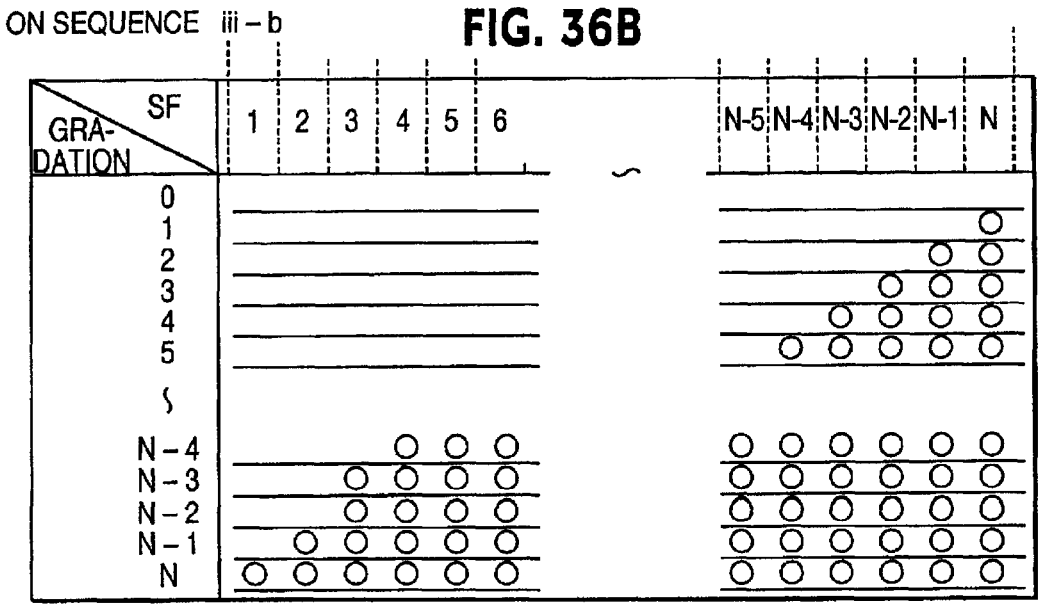

In a second modification of the first embodiment of the display driving method and the first embodiment of the display driving apparatus, the sustain times of each of the sub fields are set approximately uniform (constant) as shown in FIG. 36B. As shown in FIG. 36B, no sub field assumes the light emission state for the gradation level (luminance level) 0, the sub field SFN assumes the light emission state for the gradation level 1, the sub field SF(N−1) assumes the light emission state for the gradation level 2 in addition to that which assumes the light emission state for the gradation level 1, the sub field SF(N−2) assumes the light emission state for the gradation level 3 in addition to those which assume the light emission state for the gradation level 2, . . . , the sub field SF2 assumes the light emission state for the gradation level N−1 in addition to those which assume the light emission state for the gradation level N−2, and the sub field SF1 assumes the light emission state for the gradation level N in addition to those which assume the light emission state for the gradation level N−1, that is, all sub fields assume the light emission state for the gradation level N. Accordingly, it is possible to display N+1 gradation levels from the level 0 to the level N using the N sub fields which form 1 field. In FIG. 36B, the sub fields assuming the light emission state are indicated by a black circular mark.

In a modification of the second embodiment of the display driving method and the second embodiment of the display driving apparatus, the sustain times of each of the sub fields are set approximately uniform (constant) with respect to the pixel of the group A as shown in FIG. 36A, and the sustain times of each of the sub fields are set approximately uniform (constant) with respect to the pixel of the group B as shown in FIG. 36B. Of course, it is possible to set the sustain times of each of the sub fields approximately uniform (constant) as shown in FIG. 36B, and to set the sustain times of each of the sub fields approximately uniform (constant) as shown in FIG. 36A.

Next, a description will be given of a third embodiment of the display driving apparatus according to the present invention. This embodiment of the display driving apparatus employs a third embodiment of the display driving method according to the present invention. In this embodiment. the display driving apparatus has the same construction as that of the second embodiment shown in FIG. 17, and thus, the illustration of the display driving apparatus for this embodiment will be omitted.

In this embodiment, it is assumed for the sake of convenience that 1 field is made up of 7 sub fields SF1 through SF7. In addition, it is assumed that the ratios of the luminance levels of the sub fields SF1 through SF7 are set to satisfy SF1:SF2:SF3:SF4:SF5:SF6:SF7=4:1:4:1:4:1:4.

In this case, the sub fields SF2, SF4 and SF6 belong to a sub field group L, while the sub fields SF1, SF3, SF5 and SF7 belong to a sub field group M. A minute change in the luminance, that is, the lower bits of the data, is described by the sub fields belonging to the sub field group L. On the other hand, a large change in the luminance, that is, the upper bits of the data, is described by the sub fields belonging to the sub field group M.

In other words, the luminance ratios of the 3 sub fields SF2, SF4 and SF6 belonging to the sub field group L are the same. Similarly, the luminance ratios of the 4 sub fields SF1, SF3, SF5 and SF7 belonging to the sub field group M are the same. The luminance quantity of each sub field belonging to the sub field group M corresponds to the luminance quantity amounting to one plus all of the sub fields belonging to the sub field group L. Furthermore, with respect to each of the sub field groups L and M, the light emission times are set similarly to the first or second embodiment described above so that the sustain times (light emission times) increase uniformly from the center point on the time base as the luminance within sub field group increases. In addition, the sub fields which form 1 field are arranged so that the sub field belonging to the sub field group L and the sub field belonging to the sub field group M alternately exist.

When the luminance ratios of the sub fields are all set the same as in the first and second embodiments described above, it is only possible to display 8 gradation levels from the level 0 to the level 7 when 1 field is made up of 7 sub fields. However, according to this embodiment, it is possible to display 20 gradation levels from the level 0 to the level 19 by setting the luminance ratios of the sub fields in the above described manner.

Similarly, when 1 field is made up of 9 sub fields SF1 through SF9, for example, the ratios of the luminance levels of the 9 sub fields SF1 through SF9 are set to satisfy SF1:SF2:SF3:SF4:SF5:SF6:SF7:SF8:SF9=5:1:5:1:5:1:5:1:5. In this case, it is possible to display 30 gradation levels from the level 0 to the level 29. Accordingly, when 1 field is made up of N sub fields SF1 through SFN, it is possible to display $[(N-1)/2+1]^2+[(N-1)/2]+1$ gradation levels from the level 0 to the level $[(N-1)/2+1]^2+[(N-1)/2]$ by setting the ratios of the luminance levels of the N sub fields SF1 through SFN to satisfy SF1:SF2:SF3: . . . :SF(N−2):SF(N−1):SFN=(N−1)/2+1:1:(N−1)/2+1: . . . :(N−1)/2+1:1:(N−1)/2+1.

Figure 37B:
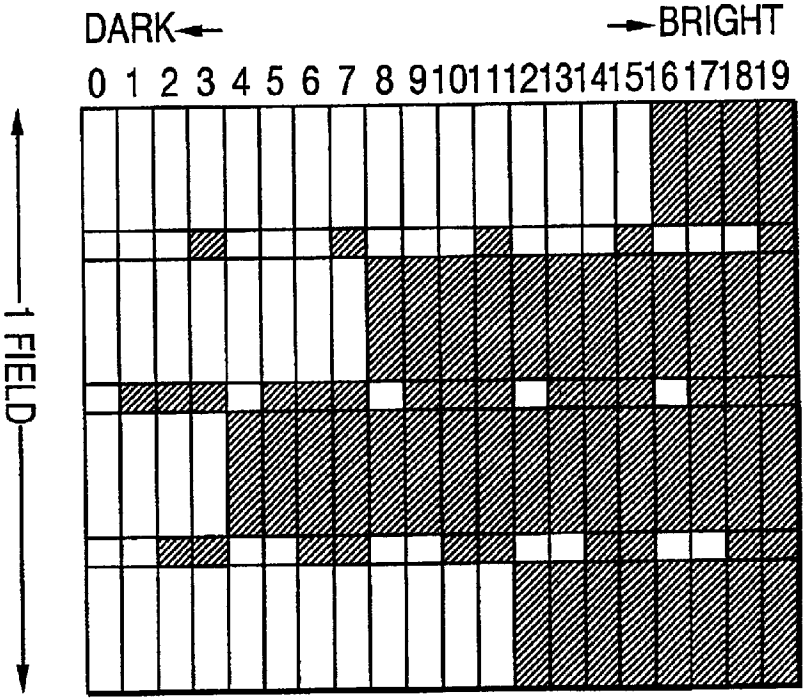
FIGS. 37A and 37B respectively are diagrams showing relationships of the sub fields and the light emission times of the pixels in the groups A and B of a third embodiment of the display driving apparatus according to the present invention.
Figure 37A:
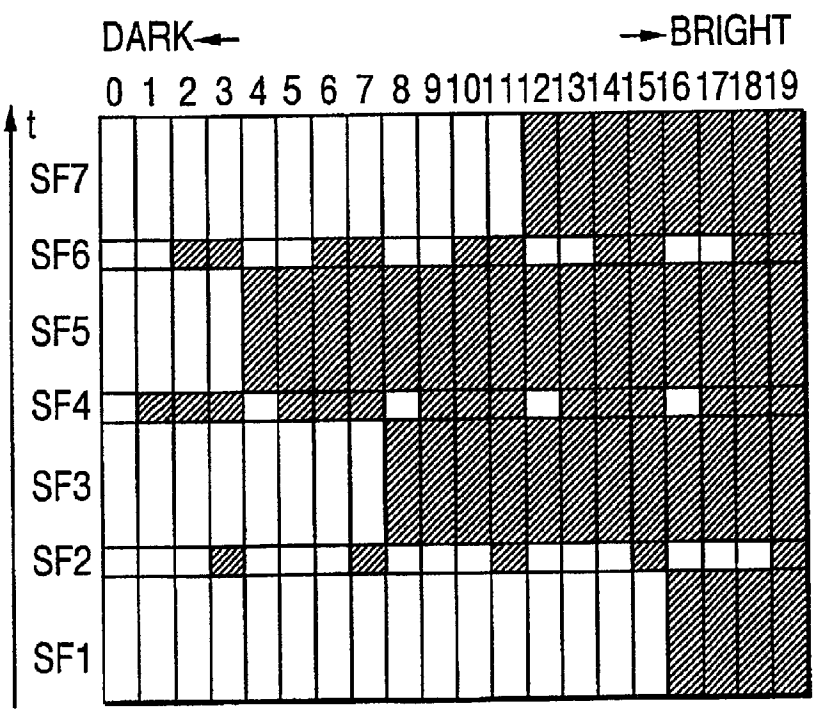

With respect to the sub fields belonging to the sub field groups described above, all of the pixels on the screen are divided into 2 groups A and B so as to have the checkerboard arrangement shown on the left hand side in FIG. 23. In this embodiment, the relationship of the light emission times of the pixels of the groups A and B and the sub fields becomes as shown in FIGS. 37A and 37B. FIG. 37A shows the sub fields which assume the light emission state for the pixel of the group A, and FIG. 37B shows the sub fields which assume the light emission state for the pixel of the group B. In FIGS. 37A and 37B, the ordinate indicates the time, and the abscissa indicates the luminance level in 20 gradation levels from the level 0 to the level 19.

Figure 38:
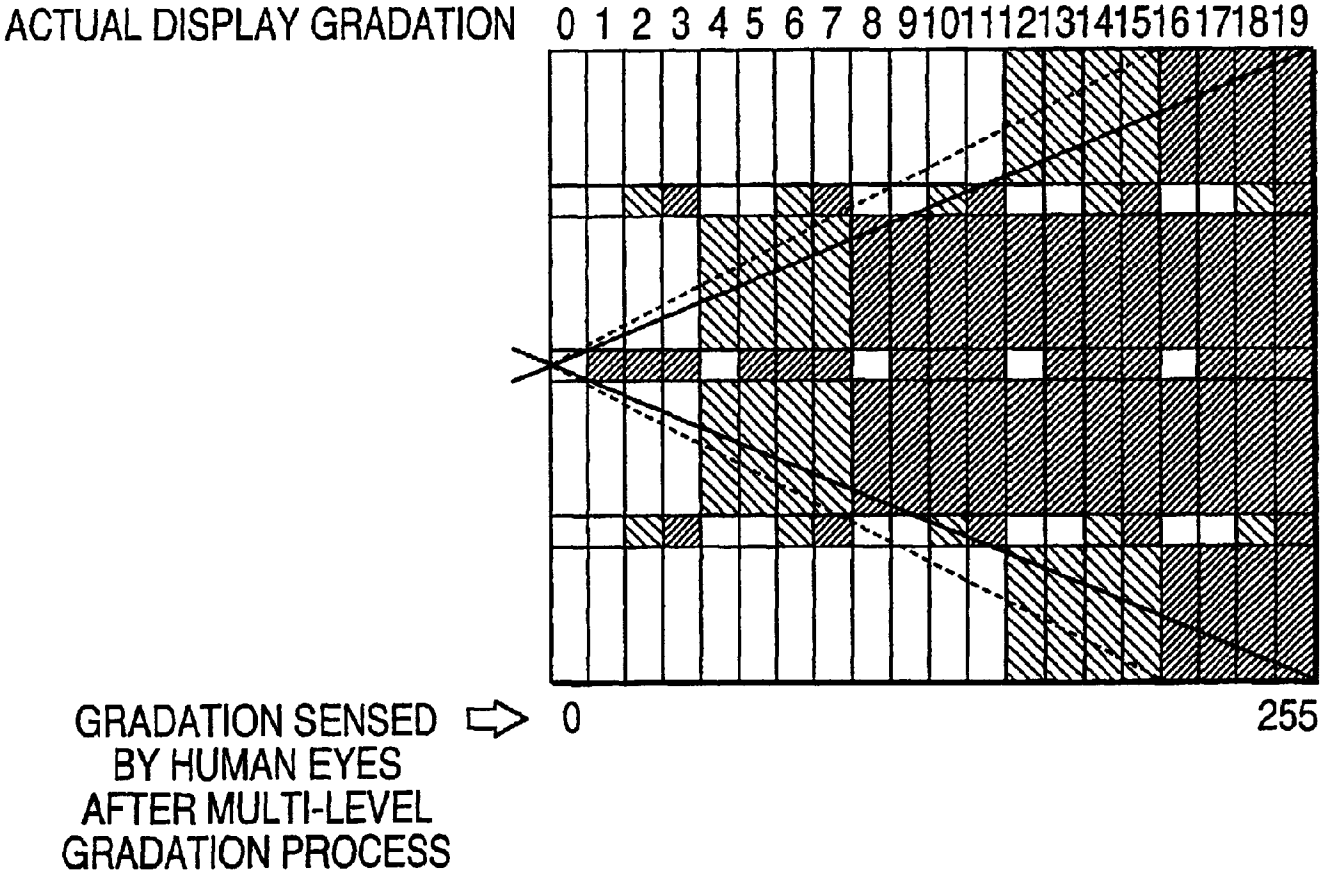
FIG. 38 is a diagram showing the display gradation characteristic of the third embodiment.

FIG. 38 is a diagram showing the display gradation characteristic of this embodiment. In FIG. 38, the ordinate indicates the time, and the abscissa indicates the luminance level of the gradation. In addition, in FIG. 38, the numerals shown at the top of the figure indicate the luminance level of the actual display gradation, and the numerals shown at the bottom of the figure indicate the luminance level of the gradation sensed by the human eyes after the error diffusion process is carried out in the multi-level gradation processing circuit 12. Furthermore, the sub fields assuming the light emission state only for the pixel of the group A are indicated by the rightwardly inclined hatching, the sub fields assuming the light emission state only for the pixel of the group B are indicated by the leftwardly inclined hatching, and the sub fields assuming the light emission state for the pixels of both the groups A and B are indicated by the cross-hatching. As may be clearly seen from FIG. 38, the light emission times are also balanced about the center point on the time base in this embodiment.

The gradation characteristic which is subjected to the gradation interpolation by the error diffusion process is indicated by a dotted line in FIG. 38. This gradation characteristic indicated by the dotted line becomes a gradation characteristic indicated by a bold line in FIG. 38 when a gain coefficient 19×8/255=152/255 is multiplied to the data in the multiplier 11 which is provided at the stage preceding the multi-level gradation processing circuit 12. Hence, this embodiment can effectively prevent the generation of the pseudo contour and the generation of the flicker, similarly to the first and second embodiments described above.

Figure 39:
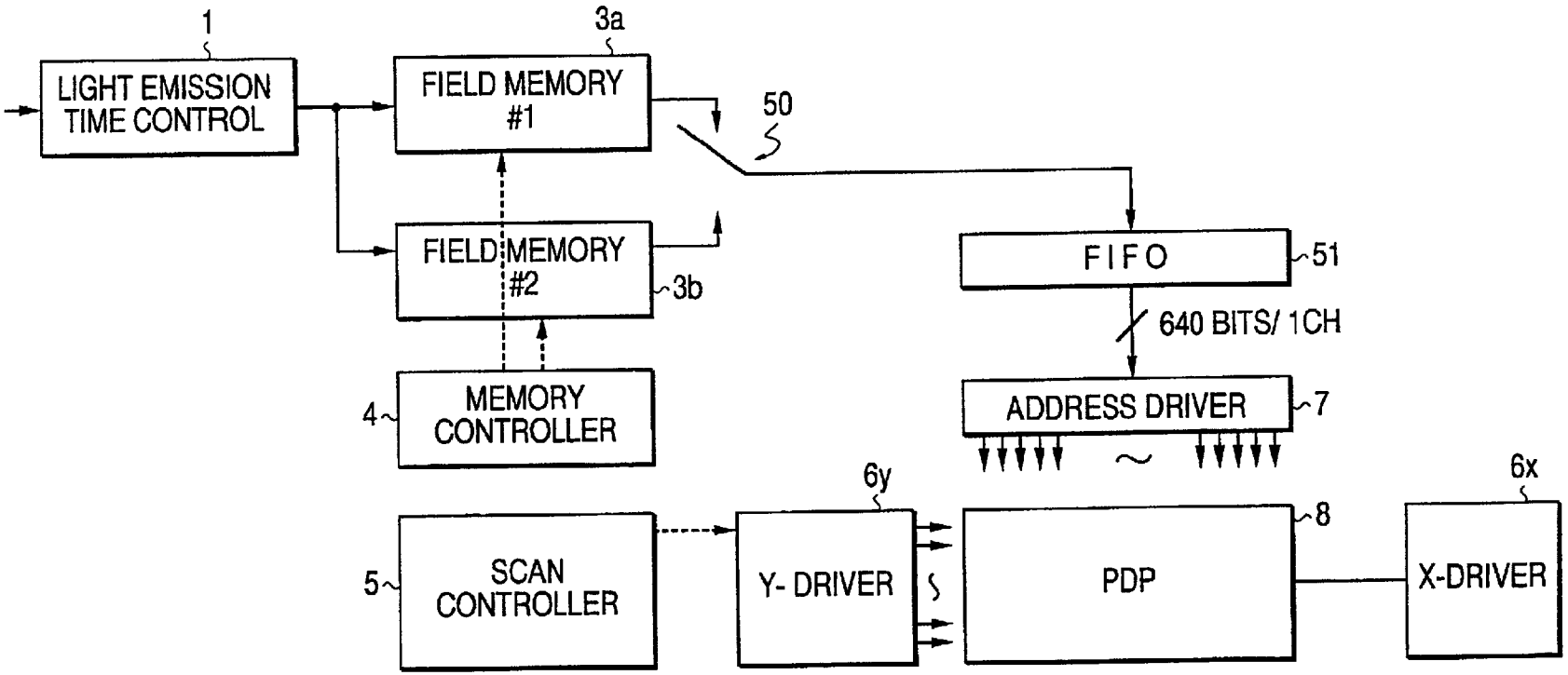
FIG. 39 is a system block diagram showing an embodiment of the construction of a PDP driving circuit together with the light emission time control circuit.

In each of the embodiments described above, the PDP driving circuit 2 itself may have a known circuit construction. However, an embodiment of the PDP driving circuit 2 will now be described with reference to FIGS. 39 through 41. FIG. 39 is a system block diagram showing the construction of the embodiment of the PDP driving circuit 2 together with the light emission time control circuit 1, and FIGS. 40 and 41 respectively are time charts for explaining the operation of the PDP driving circuit 2. In FIG. 39, those parts which are the same as those corresponding parts in FIGS. 15 and 17 are designated by the same reference numerals, and a description thereof will be omitted.

The PDP driving circuit 2 shown in FIG. 39 generally includes field memories 3*a* and 3*b* which form the field memory 3, the memory controller 4, the scan controller 5, a X-driver 6*x* and a Y-driver 6*y* which form the scan driver 6, the address driver 7, a switch 50, and a first-in-first-out (FIFO) 51. The X-driver 6*x*, the Y-driver 6*y* and the address driver 7 drive the PDP 8. The field memory 3 is made up of the 2 field memories 3*a* and 3*b*, and the data read from the field memories 3*a* and 3*b* are alternately supplied to the FIFO 51 for every field by the switching of the switch 50. An output of the FIFO 51 has 640 bits per channel, that is, with respect to one of the three primary colors, and is supplied to the address driver 7.

Figure 40:
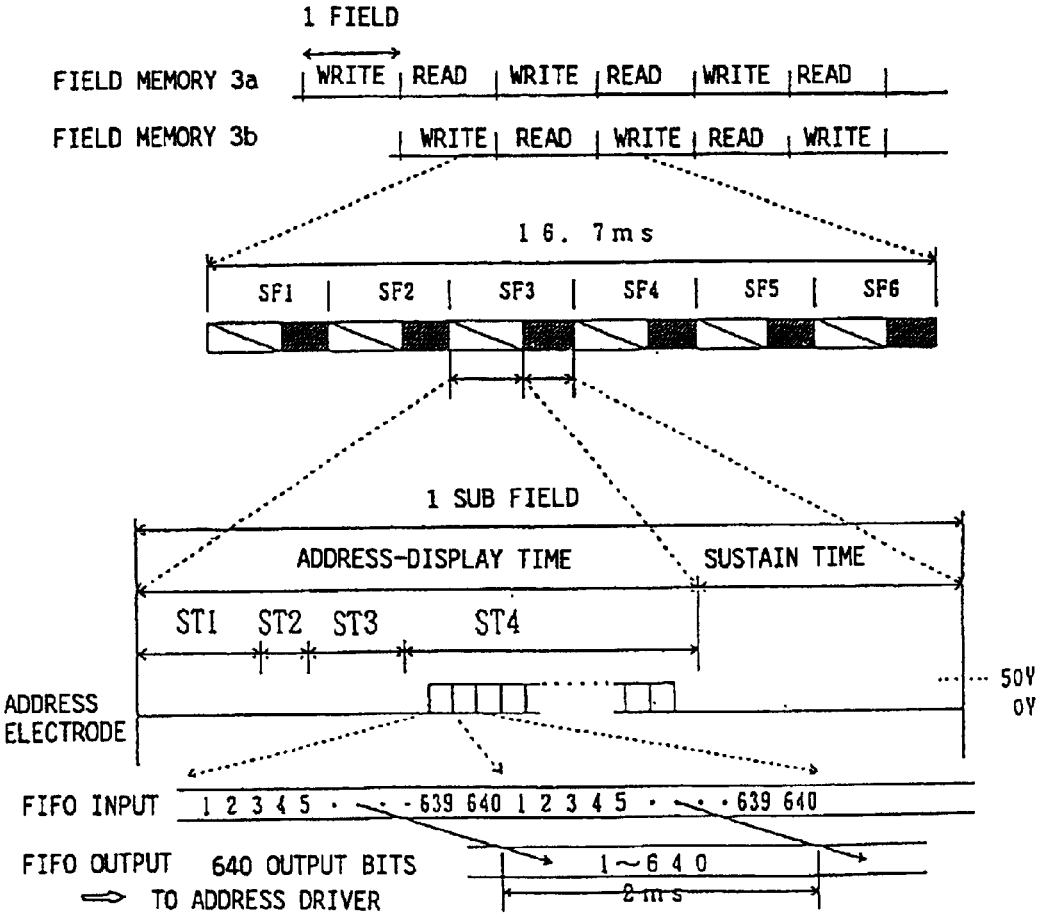
FIG. 40 is a time chart for explaining the operation of the PDP driving circuit.

The time chart shown in FIG. 40 indicates write and read periods of the field memories 3*a* and 3*b*, 1 field which is made up of 6 sub fields SF1 through SF6, a driving period of an address electrode of the PDP 8 which is driven by the address driver 7, and input and output bits of the FIFO 51. The driving period of the address electrode driven by the address driver 7 is shown with respect to the sub field SF3, for example. In the address display-time of the sub field SF3, the unwanted charge is cleared in steps ST1 through ST3, and the data write, that is, the formation of the wall charge map, is made in a step ST4 only with respect to the pixel of the PDP 8 that is to make the light emission. In other words, the entire screen is erased and initialized in the step ST1, the wall charge is formed by writing the entire screen in the step ST2, and the unwanted charge is erased by erasing the entire screen in the step ST3. In addition, the pixel which is to make the light emission within each sub field is specified in the step ST4.

Figure 41:
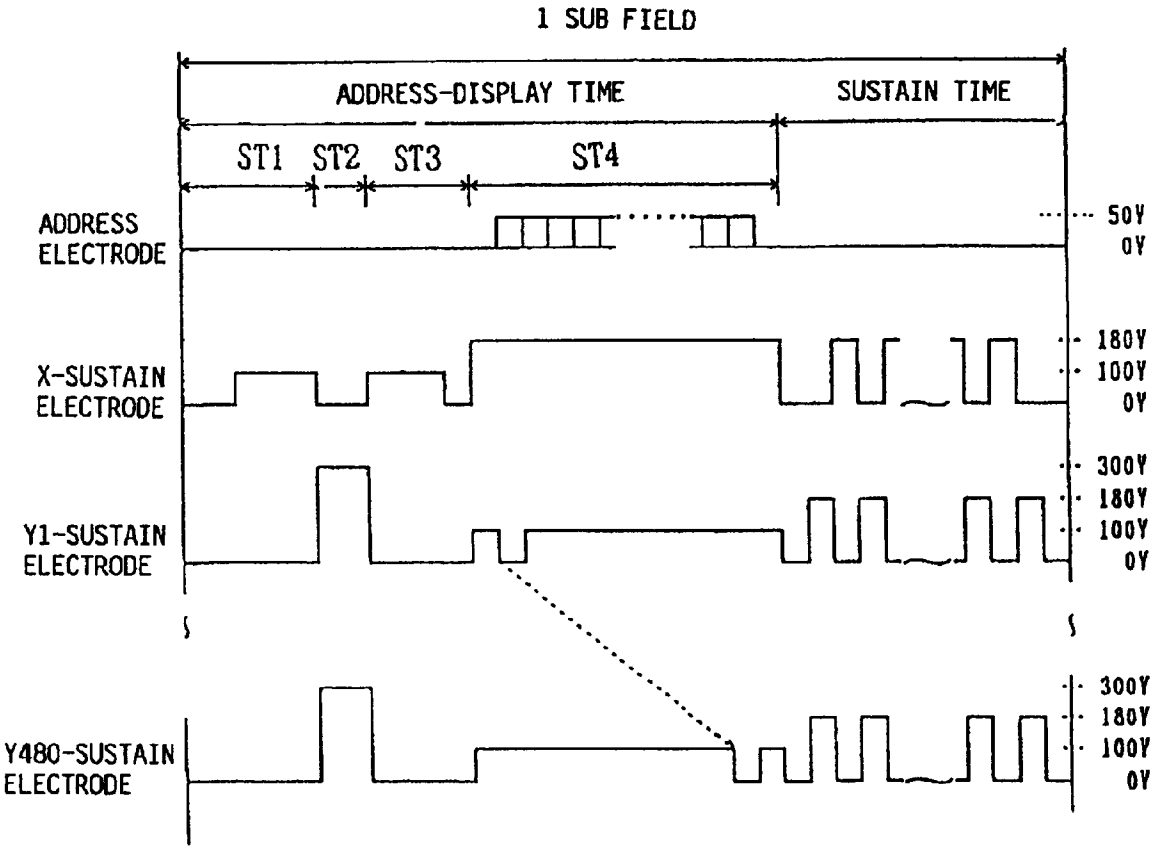
FIG. 41 is a time chart for explaining the operation of the PDP driving circuit.

With respect to the address display-time and the sustain time of the sub field SF3 shown in FIG. 40, the time chart shown in FIG. 41 indicates the driving period of the address electrode of the PDP 8 driven by the address driver 7, the driving period of X-sustain electrode of the PDP 8 driven by the X-driver 6*x*, the driving period of Y1-sustain electrode of the PDP 8 driven by the Y-driver 6*y*, and the driving time of Y480-sustain electrode of the PDP 8 driven by the Y-driver 6*y*.

By using the error diffusion technique described above, it is possible to increase the apparent number of gradation levels even when the displayable number of gradation levels is relatively small depending on the number of sub fields which form 1 field. On the other hand, the present inventors have found that the use of the error diffusion technique generates a noise (hereinafter referred to as error diffusion noise) which is similar to quantization noise and is peculiar to the case where the error diffusion technique is used. According to the image quality evaluation experiments conducted by the present inventors, it was confirmed that the error diffusion noise becomes conspicuous to the human eyes when the number of actual display gradation levels of the display becomes 40 to 50 or less. It was also found that the error diffusion noise becomes conspicuous to the human eyes particularly at a low luminance portion of the image. In other words, in the case of an image related to a scenery at night, the error diffusion noise becomes notable at the low luminance portion, that is, the entire dark image, thereby deteriorating the image quality.

Next, a description will be given of embodiments in which the apparent error diffusion noise which is peculiar to the case where the error diffusion technique is used can be reduced even when the number of actual display gradation levels is relatively small.

A description will be given of a fourth embodiment of the display driving method according to the present invention. This embodiment focuses on the fact that the error diffusion noise becomes conspicuous at the low luminance portion of the image. That is, this embodiment effectively utilizes the fact that the error diffusion noise becomes less conspicuous to the human eyes as the luminance becomes higher.

The present inventors made evaluations of the number of display gradation levels which are sensed by the human eyes as image quality deterioration due to the error diffusion noise for each luminance level. The evaluations led to the results shown in FIG. 42 which shows the necessary number of actual display gradation levels for each luminance level. The results shown in FIG. 42 were obtained by dividing the entire luminance region to be displayed into 16 equal parts, that is, assigning 16 levels to each equal part when there are 256 gradation levels, and judging the extent of the display gradation that is required for each equal part in order to obtain substantially the same display with respect to the human eyes as the case where the number of actual display gradation levels is 50. It was judged that the error diffusion noise is within a tolerable range if the display gradation for the equal part is substantially the same with respect to the human eyes as the case where the number of actual display gradation levels is 50.

As may be seen from FIG. 42, the resolution that is required for 50% or more of the luminance is only approximately ⅕ the resolution required for 6% (1/16 of the entire luminance region: region 0) of the luminance. Hence, this embodiment effectively utilizes the above evaluation results, and employs a technique which makes the error diffusion noise less conspicuous even when the number of gradation levels is limited and relatively small.

Figure 43:
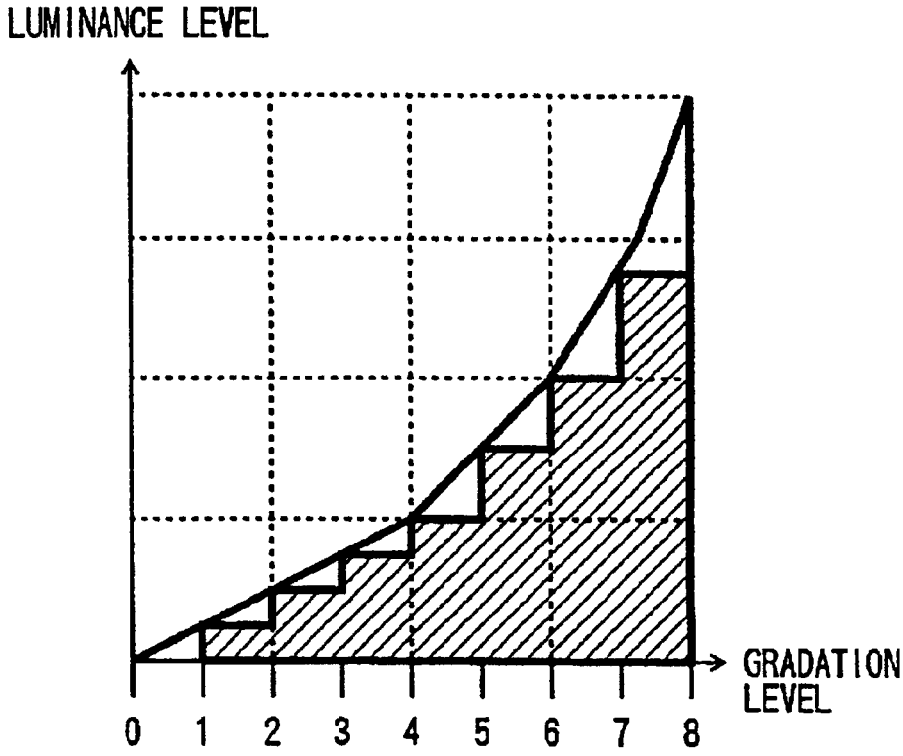
FIG. 43 is a diagram showing a display characteristic of a display.
Figure 44:
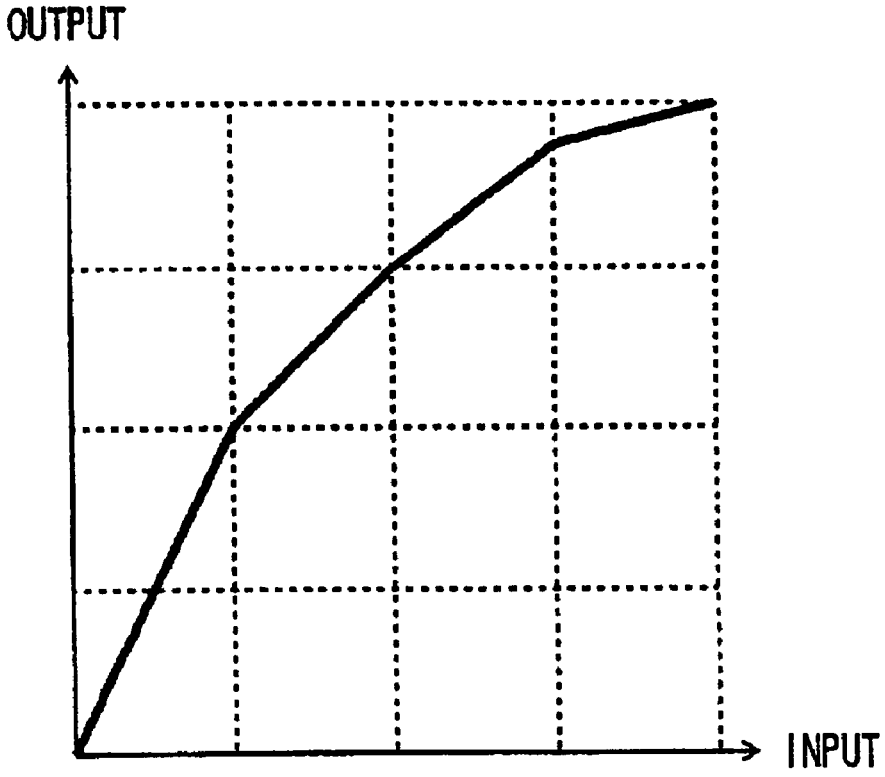
FIG. 44 is a diagram showing an inverse function correction characteristic.
Figure 45:
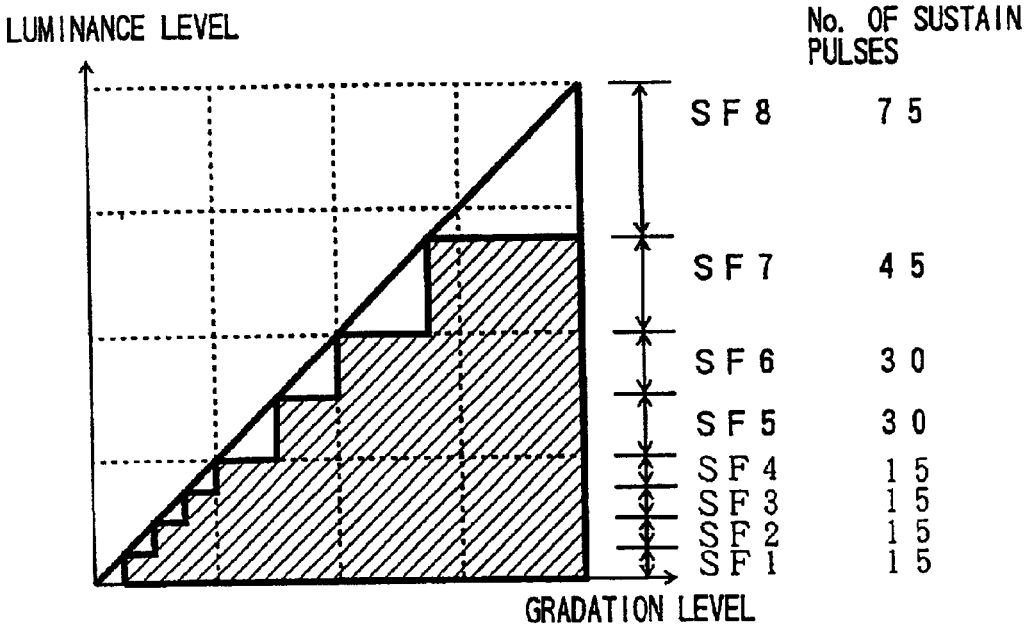
FIG. 45 is a diagram showing a combined display characteristic of the display obtained from the characteristics shown in FIGS. 43 and 44.

FIGS. 43 through 45 are diagrams for explaining the concept of this technique employed in this embodiment. FIG. 43 is a diagram showing the display characteristic of the display, FIG. 44 is a diagram showing an inverse function correction characteristic, and FIG. 45 is a diagram showing a combined display characteristic of the display obtained from the characteristics shown in FIGS. 43 and 44. In FIGS. 43 through 45, it is assumed for the sake of convenience that 1 field is made up of 8 sub fields, and that 9 gradation levels are displayable from the level 0 to the level 8.

In this embodiment, as indicated by the hatching in FIG. 43, the number of sub fields allocated for displaying the gradation steps of the low luminance portion is set greater than that allocated for displaying the gradation steps of the high luminance portion. In addition, the resolution is increased by reducing the number of sustain pulses in the sub fields allocated for displaying the gradation steps of the low luminance portion. The sustain pulse drives the PDP to make a corresponding pixel emit light. the particular case shown in FIG. 43, 4 sub fields are allocated with respect to 25% of the entire luminance region to be displayed. In other words, one-half of the total number of sub fields forming 1 field is allocated for displaying the gradation steps of the low luminance portion.

When the above described sub field allocation is employed, the number of sub fields allocated for displaying the high luminance portion relatively decreases because of the limited number of sub fields forming 1 field, and the resolution decreases by a corresponding amount. However, as may be seen from the evaluation results shown in FIG. 42, this embodiment positively utilizes the characteristic of the human eyes, that is, the fact that the error diffusion noise is inconspicuous to the human eyes even when the gradation steps in the high luminance portion become coarse compared to that of the low luminance portion.

The display characteristic for the case where the image data subjected to the error diffusion process is input to the display becomes as indicated by a solid line in FIG. 43. In FIG. 43, the ordinate indicates the luminance level, and the abscissa indicates the gradation level. The display characteristic indicated the solid line has a gradual inclination at the low luminance portion and has an abrupt inclination at the high luminance portion, thereby including distortion. For this reason, it is desirable to carry out an inverse function correction process with respect to the image data in advance at a stage preceding the error diffusion process, so as to correct the non-linear display characteristic which includes the distortion. FIG. 44 shows the inverse function correction characteristic which is to be given to the image data by the inverse function correction process. In FIG. 44, the ordinate indicates an output of a distortion correction circuit which carries out the inverse function correction process, and the abscissa indicates an input of this distortion correction circuit.

Accordingly, by giving the inverse function correction characteristic shown in FIG. 44 to the image data i advance by the inverse function correction process and then carrying out the error diffusion process to improve the resolution of the low luminance portion as shown in FIG. 43, the combined display characteristic of the display becomes a linear characteristic as indicated by a solid line in FIG. 45. In FIG. 45, the ordinate indicates the luminance level, and the abscissa indicates the gradation level. As indicated by the hatching in FIG. 45, the resolution at the low luminance portion is fine compared to that of the case shown in FIG. 43.

Figure 46:
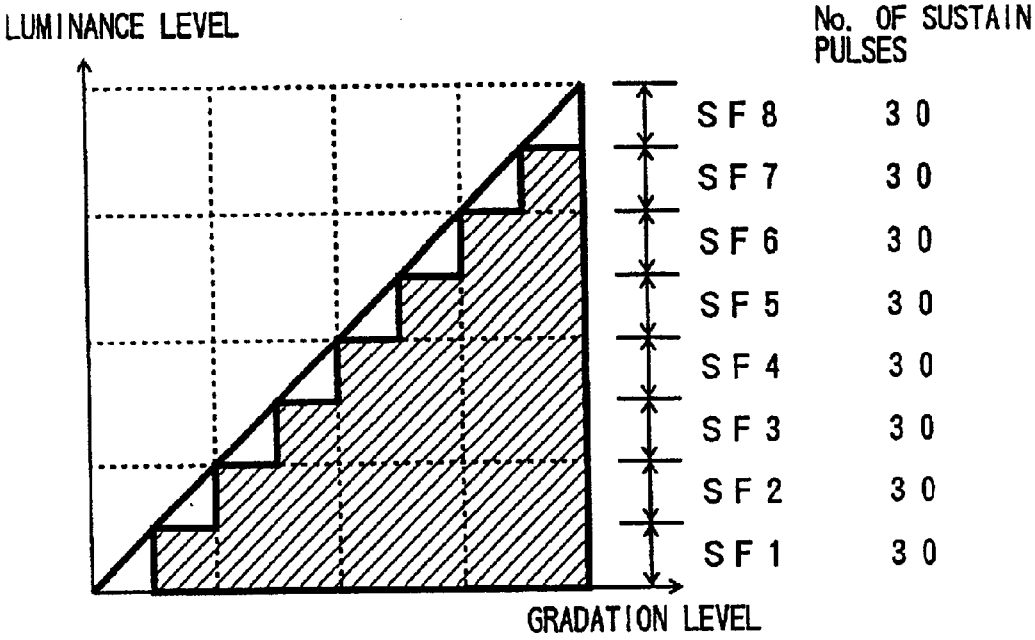
FIG. 46 is a diagram showing a display characteristic for a case where the resolution is the same for the entire region of the display gradation for comparison purposes.

For comparison purposes, FIG. 46 shows a display characteristic for a case where the resolution is made the same for the entire display gradation region. In FIG. 46, the ordinate indicates the luminance level, and the abscissa indicates the gradation level. In this case shown in FIG. 46, it is also assumed for the sake of convenience that 1 field is made up of 8 sub fields, and that 9 gradation levels from the level 0 to the level 8 are displayable. In FIGS. 45 and 46, an example of the number of sustain pulses corresponding to each of the sub fields SF1 through SF8 is shown on the right hand side of the respective figures.

As may be seen by comparing FIGS. 43 and 46, although 1 field is made up of 8 sub fields in this embodiment, the resolution at the low luminance portion is the same for the entire display gradation region, and this resolution is similar to the resolution that is obtained when 1 field is made up of 16 sub fields and 17 gradation levels are displayable. For this reason, compared to the case where the resolution is the same for the entire display gradation region, this embodiment will not generate distortion in the display characteristic of the display, and the resolution of the display gradation can be improved at the low luminance portion. As a result, the error diffusion noise becomes inconspicuous at the low luminance portion according to this embodiment.

Figure 47:
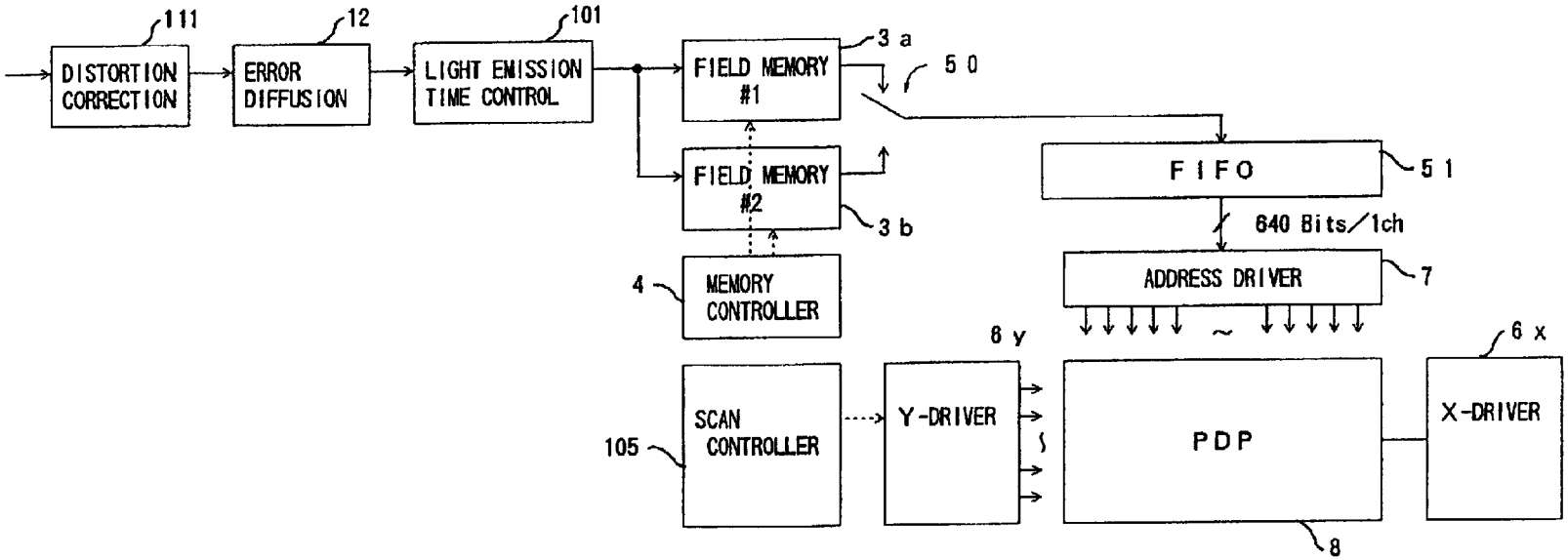
FIG. 47 is a system block diagram showing a fourth embodiment of the display driving apparatus according to the present invention.

Next, a description will be given of a fourth embodiment of the display driving apparatus according to the present invention. This embodiment of the display driving apparatus employs the fourth embodiment of the display driving method described above. FIG. 47 is a system block diagram showing the fourth embodiment of the display driving apparatus. In FIG. 47, those parts which are the same as those corresponding parts in FIGS. 17 and 39 are designated by the same reference numerals, and a description thereof will be omitted.

This embodiment of the display driving apparatus is characterized by the operations of a light emission time control circuit 101, a scan controller 105 and a distortion correction circuit 111, as described hereunder.

The scan controller 105 determines the length of the light emission time of each sub field, that is, the number of sustain pulses applied to the sustain electrode of the PDP 8, with respect to each pixel when driving the PDP 8. In this embodiment, the number of sustain pulses of each sub field is set as shown in the following Table 1.

TABLE 1

| Sub Fields | Number of Sustain Pulses |
|---|---|
| SF1 through SF4 | 15 |
| SF5 & SF6 | 30 |
| SF7 | 45 |
| SF8 | 75 |

Accordingly, the luminance ratios of the sub fields SF1 through SF8 are set to SF1:SF2:SF3:SF4:SF5:SF6:SF7:SF8=1:1:1:1:2:2:3:5.

The light emission time control circuit 101 determines which sub field is to assume the light emission state depending on each luminance level, with respect to each pixel when driving the PDP 8. In this embodiment, when the lengths of the light emission times of each of the sub fields are set as shown above, the sub fields having the light emission state are set as shown in FIG. 48 for each luminance level. In FIG. 48, the sub fields having the light emission state are indicated by a black circular mark, and the sub fields having the non-light emission state are indicated by a plain circular mark. In this embodiment, the light emission time control circuit 101 is formed by a ROM having 9 addresses, 8 bits for the data, and a memory capacity of 72 bits or greater.

Figure 49:
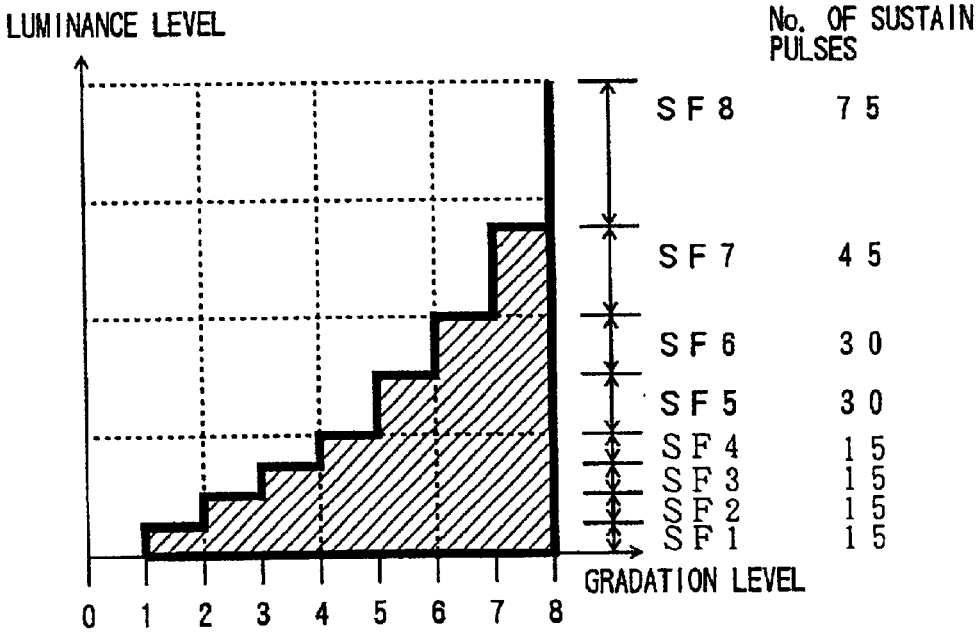
FIG. 49 is a diagram showing a display characteristic of a PDP which is driven when image data are input via a scan controller and a light emission time control circuit.
Figure 50:
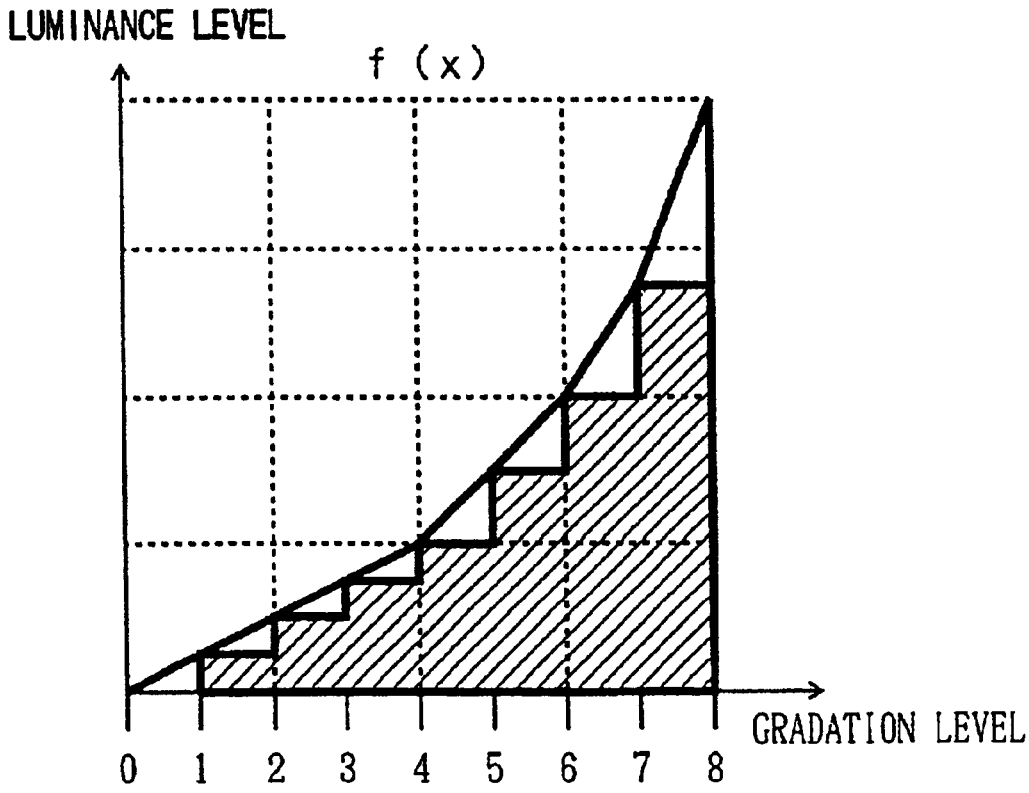
FIG. 50 is a diagram showing a display characteristic of a PDP by a bold line for a case where the image data is subjected to an error diffusion process by an error diffusion circuit (multi-level gradation processing circuit)

FIG. 49 is a diagram showing the display characteristic of the PDP 8 which is driven when the image data is input via the scan controller 105 and the light emission time control circuit 101 which are set as described above. In FIG. 49, the ordinate indicates the luminance level, and the abscissa indicates the gradation level. In addition, FIG. 50 is a diagram showing the display characteristic of the PDP 8 by a bold line for a case where the image data is subjected to the error diffusion process in the error diffusion circuit (multi-level gradation processing circuit) 12. In FIG. 50, the ordinate indicates the luminance level, and the abscissa indicates the gradation level.

Figure 51:
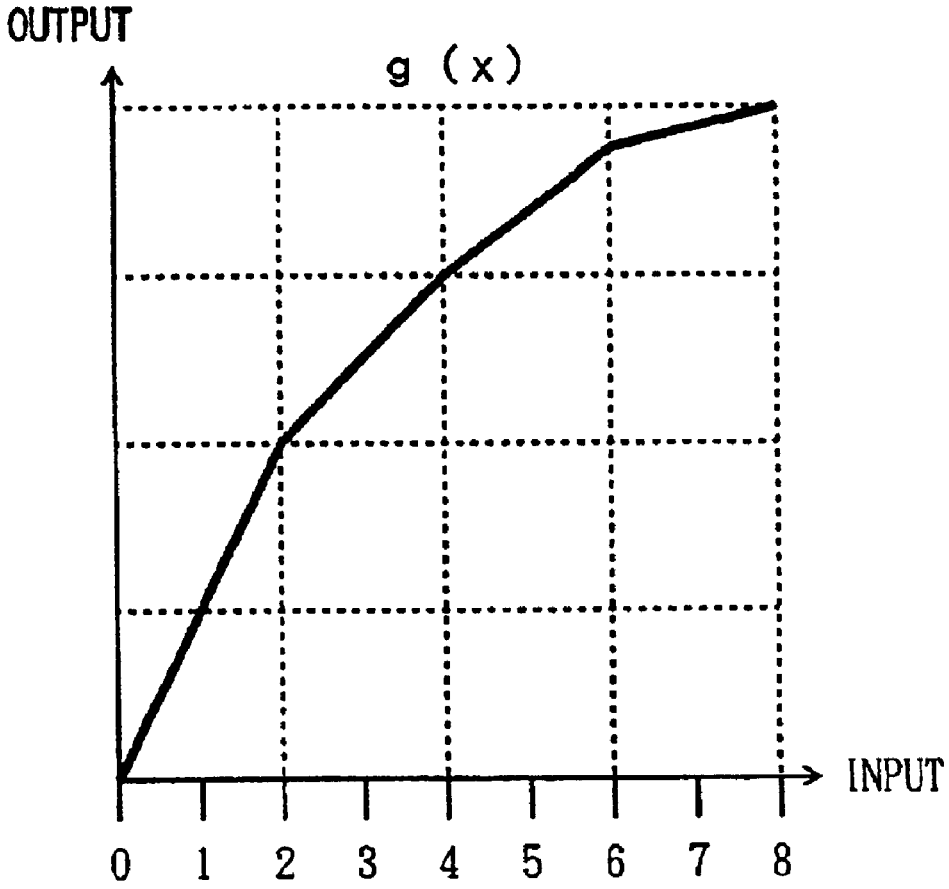
FIG. 51 is a diagram showing an inverse function g(x)

The distortion correction circuit 111 is provided to correct the non-linear characteristic which is introduced by the scan controller 105 and the light emission time control circuit 101. Because it is desirable that the display characteristic of the PDP 8 is linear, a distortion correction process is carried out with respect to the image data at a stage preceding the error diffusion circuit 12. When the display characteristic indicated by the bold line in FIG. 50 is denoted by a function f(x), the distortion correction circuit 111 carries out a distortion correction process based on an inverse function g(x) of this function f(x). FIG. 51 is a diagram showing the inverse function g(x) which is used in this case. In FIG. 51, the ordinate indicates an output of the distortion correction circuit 111, and the abscissa indicates an input of the distortion correction circuit 111.

In this embodiment, the distortion correction circuit 111 is made of a ROM. In addition, since the display characteristic indicated by the function f(x) is made up of a plurality of straight lines, the distortion correction circuit 111 may be made up of a logic circuit which realizes a straight line described by y=Ax+B.

Figure 52:
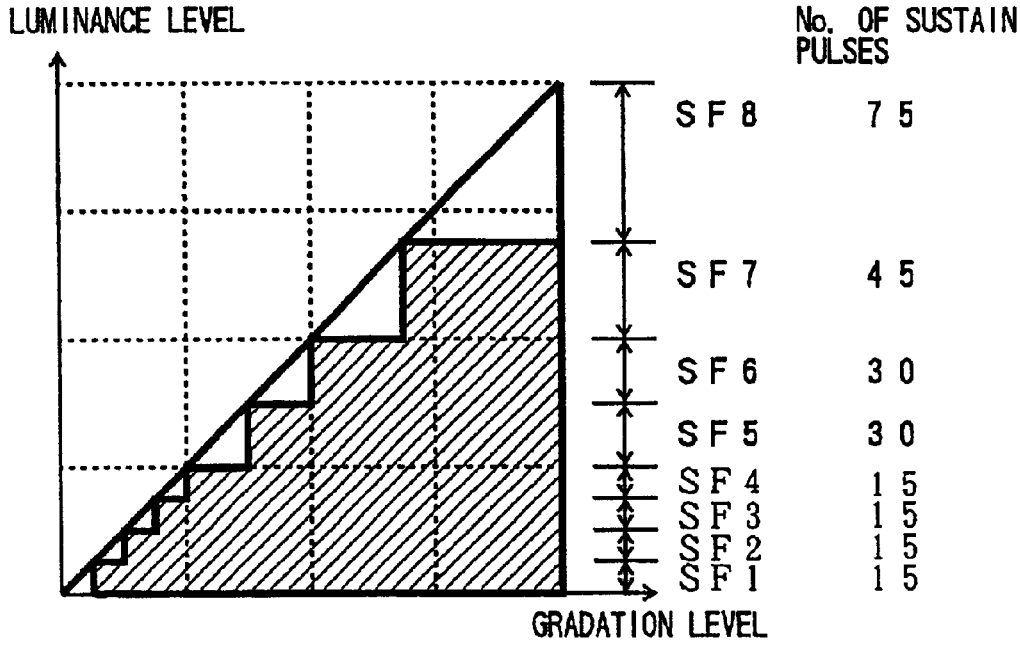
FIG. 52 is a diagram showing a combined display characteristic of the PDP.

Therefore, according to this embodiment, the combined display characteristic of the PDP 8 becomes linear as indicated by a solid line in FIG. 52. In FIG. 52, the ordinate indicates the luminance level, and the abscissa indicates the gradation level. In addition, as indicated by the hatching in FIG. 52, the actual resolution allocated for the low luminance portion is high compared to that allocated for the high luminance portion, and thus, it is possible to greatly reduce the error diffusion noise which becomes conspicuous particularly at the low luminance portion.

The setting of the sub fields which are to assume the light emission state for each luminance level in the light emission time control circuit 101 is of course not limited to the setting shown in FIG. 48. For example, the sub fields which are to assume the light emission state may be set as shown in FIGS. 53 through 56 for each luminance level. In FIGS. 53 through 56, the sub fields having the light emission state are indicated by a black circular mark, and the sub fields having the non-light emission state are indicated by a plain circular mark.

In FIG. 53, the sub fields which are to assume the light emission state are set in a reverse-relationship to that shown in FIG. 48. In FIG. 54, the sub fields which are to assume the light emission state are set so as to increase from approximately the center point on the time base within 1 field. In FIG. 55, the sub fields which are to assume the light emission state are set in a reverse relationship to that shown in FIG. 54. Furthermore, in FIG. 56, the sub fields which are to assume the light emission state are set so as to increase at random.

In other words, as may be seen from FIGS. 48 and 53 through 56, when 1 field is made up of N sub fields SF1 through SFN and the display is made in N+1 gradation levels from the luminance level 0 to the luminance level N, the light emission time control circuit 101 is constructed so as to increase the luminance quantity by adding one sub field which assumes the light emission state in addition to the sub fields which assume the light emission state for the luminance level m−1 when displaying the luminance level m, where m is an integer satisfying 0<m<N.

In addition, when 1 field is made up of N sub fields SF1 through SFN and the display is made in N+1 gradation levels from the luminance level 0 to the luminance level N, the scan controller 105 is constructed so as to satisfy the following relationship. That is, when the sub field which does not assume the light emission state for the luminance level m−1 but first assumes the light emission state for the luminance level m is denoted by SFm, the sub field which does not assume the light emission state for the luminance level m but first assumes the light emission state for the luminance level m+1 is denoted by SFm+1, the length of the light emission time of the sub field SFm is denoted by T(SFm), and the length of the light emission time of the sub field SFm+1 is denoted by T(SFm+1), the scan controller 105 is constructed so as to satisfy the relationship T(SF1) ≦T(SF2)≦ . . . ≦T(SFm)≦T(SFm+1)≦ . . . ≦T(SFN−1) ≦T(SFN).

Figure 57:
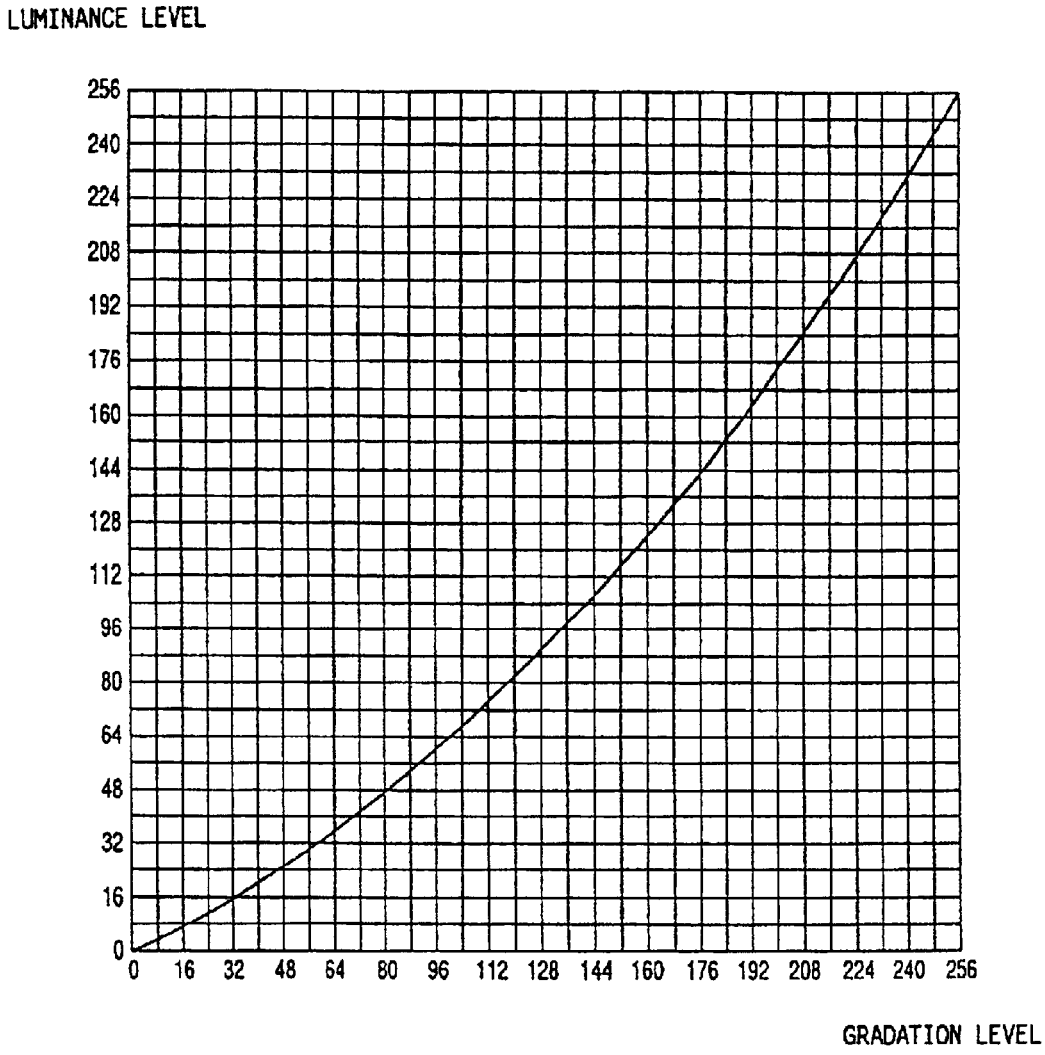
FIG. 57 is a diagram showing another example of a function f(x)

Furthermore, the display characteristic of the PDP 8 for the case where the image data is subjected to the error diffusion process in the error diffusion circuit 12 is of course not limited to the function f(x) indicated by the bold line in FIG. 50, and other appropriate functions may be used. FIG. 57 is a diagram showing another example of the function f(x). In FIG. 57, the ordinate indicates the luminance level, and the abscissa indicates the gradation level. In this case, when it is assumed for the sake of convenience that 1 field is made up of 8 sub fields, the display characteristic of the PDP 8 for the case where the image data is subjected to the error diffusion process in the error diffusion circuit 12 becomes as indicated by the hatching in FIG. 58, and the number of sub fields allocated for displaying the gradation steps at the low luminance portion is large compared to that allocated for displaying the gradation steps at the high luminance portion.

Figure 58:
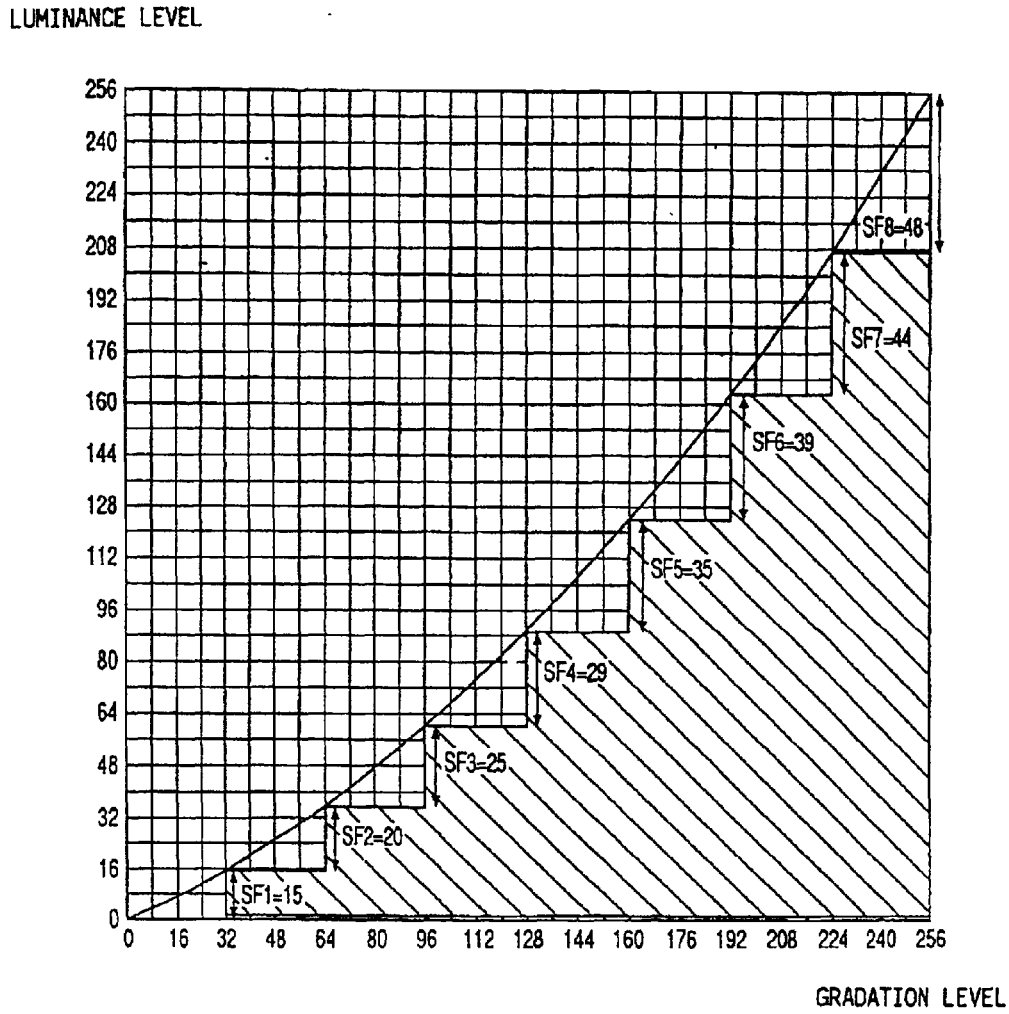
FIG. 58 is a diagram showing a display characteristic of the PDP when 1 field is made up of 8 sub fields and the image data are subjected to the error diffusion process.
Figure 59:
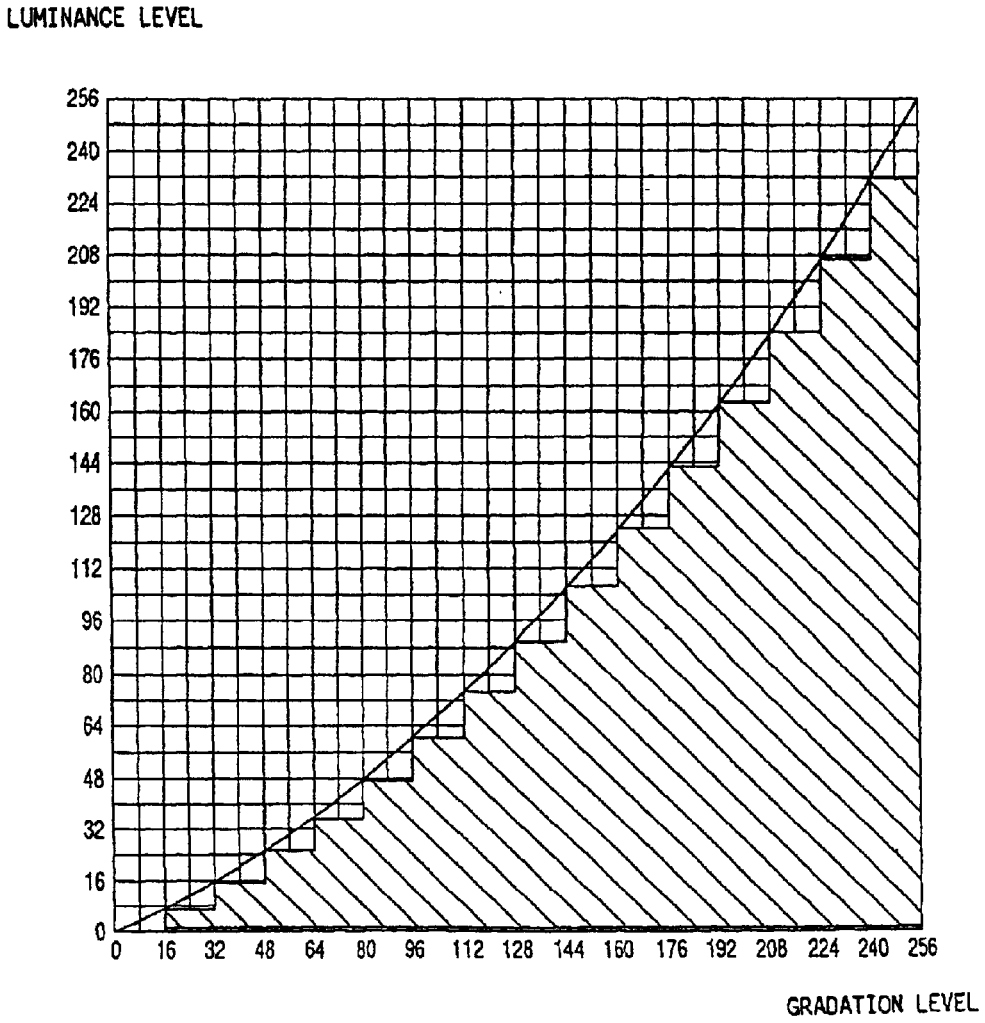
FIG. 59 is a diagram showing a display characteristic of the PDP when 1 field is made up of 16 sub fields and the image data are subjected to the error diffusion process.

On the other hand, when it is assumed for the sake of convenience that 1 field is made up of 16 sub fields, the display characteristic of the PDP 8 for the case where the image data is subjected to the error diffusion process in the error diffusion circuit 12 becomes as indicated by the hatching in FIG. 59, and the number of sub fields allocated for displaying the gradation steps at the low luminance portion is large compared to that allocated for displaying the gradation steps at the high luminance portion and is larger than that of the case shown in FIG. 58.

Figure 60:
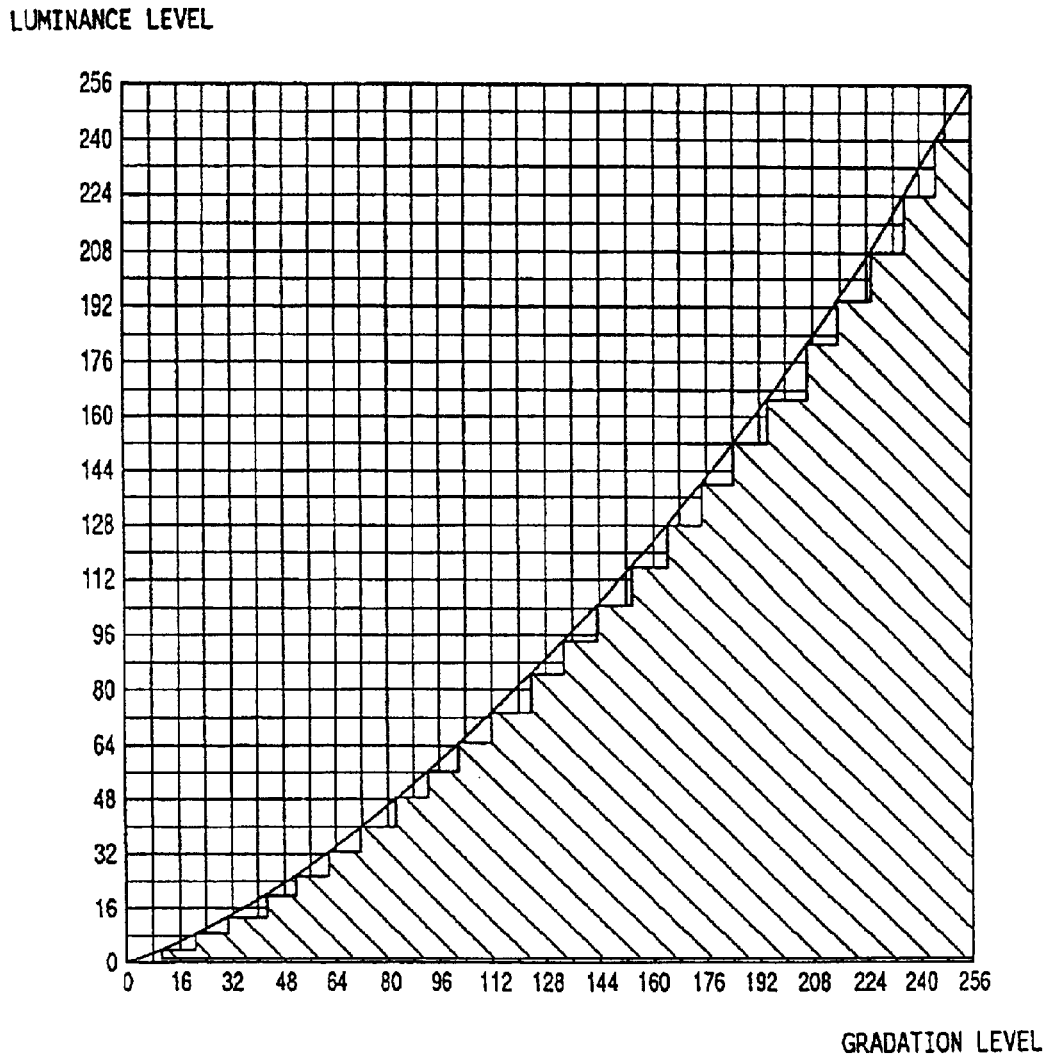
FIG. 60 is a diagram showing a display characteristic of the PDP when 1 field is made up of 25 sub fields and the image data are subjected to the error diffusion process.

Moreover, when it is assumed for the sake of convenience that 1 field is made up of 25 sub fields, the display characteristic of the PDP 8 for the case where the image data is subjected to the error diffusion process in the error diffusion circuit 12 becomes as indicated by the hatching in FIG. 60, and the number of sub fields allocated for displaying the gradation steps at the low luminance portion is large compared to that allocated for displaying the gradation steps at the high luminance portion and is even larger than that of the case shown in FIG. 59.

In FIGS. 58 through 60, the ordinate indicates the luminance level, and the abscissa indicates the gradation level. The illustration of an inverse function g(x) with respect to each of the functions f(x) indicated by the solid lines in FIGS. 58 through 60 will be omitted.

According to the first through third embodiments described above, it is possible to obtain a relatively large number of actual display gradation levels, the signal-to-noise ratio can be improved by carrying out the error diffusion process, and a satisfactory image can be displayed on the display. However, with respect to a specific image, the first through third embodiments cannot completely eliminate the pseudo contour. On the other hand, according to the fourth embodiment described above, the pseudo contour can be eliminated completely regardless of the image. However, the number of actual display gradation levels becomes relatively small according to the fourth embodiment, and the deterioration of the signal-to-noise ratio to a certain extent is inevitable even if the error diffusion process is carried out.

Next, a description will be given of embodiments which can bring out the most out of the advantageous features of the first through third embodiments and the fourth embodiment.

First, a description will be given of the operating principle of a fifth embodiment of the display driving method according to the present invention.

In this embodiment, a main path and a sub path are provided with respect to an input image signal, and the path which processes the input image signal is switched depending on the image which is indicated by the input image signal. The main path carries out a process in conformance with any of the first through third embodiments described above, while the sub path carries out a process in conformance with the fourth embodiment described above.

For example, when it is assumed for the sake of convenience that 1 field is made up of 8 sub fields, the main path processes the input image signal so that the image is displayable in 52 actual display gradation levels, and the pseudo contour is eliminated in a satisfactory manner. On the other hand, the sub path processes the input image signal so that the image is displayable in 9 actual display gradation levels, and the pseudo contour is eliminated completely.

Accordingly, if the input image signal indicates a specific image from which the pseudo contour cannot be eliminated completely by the processing carried out by the main path, this specific image is detected and the processing path is switched so that only the input image signal corresponding to the specific image is processed by the sub path. The switching of the processing path between the main path and the sub path is carried out in units of pixels based on the detection result, that is, whether or not the input image signal indicates the specific image. Hence, it is possible to make the most out of the advantageous features of both the main and sub paths depending on the input image signal. In other words, the generation of the pseudo contour can be positively prevented, and it is possible to carry out a display control in units of pixels depending on the image indicated by the input image signal.

Figure 61:
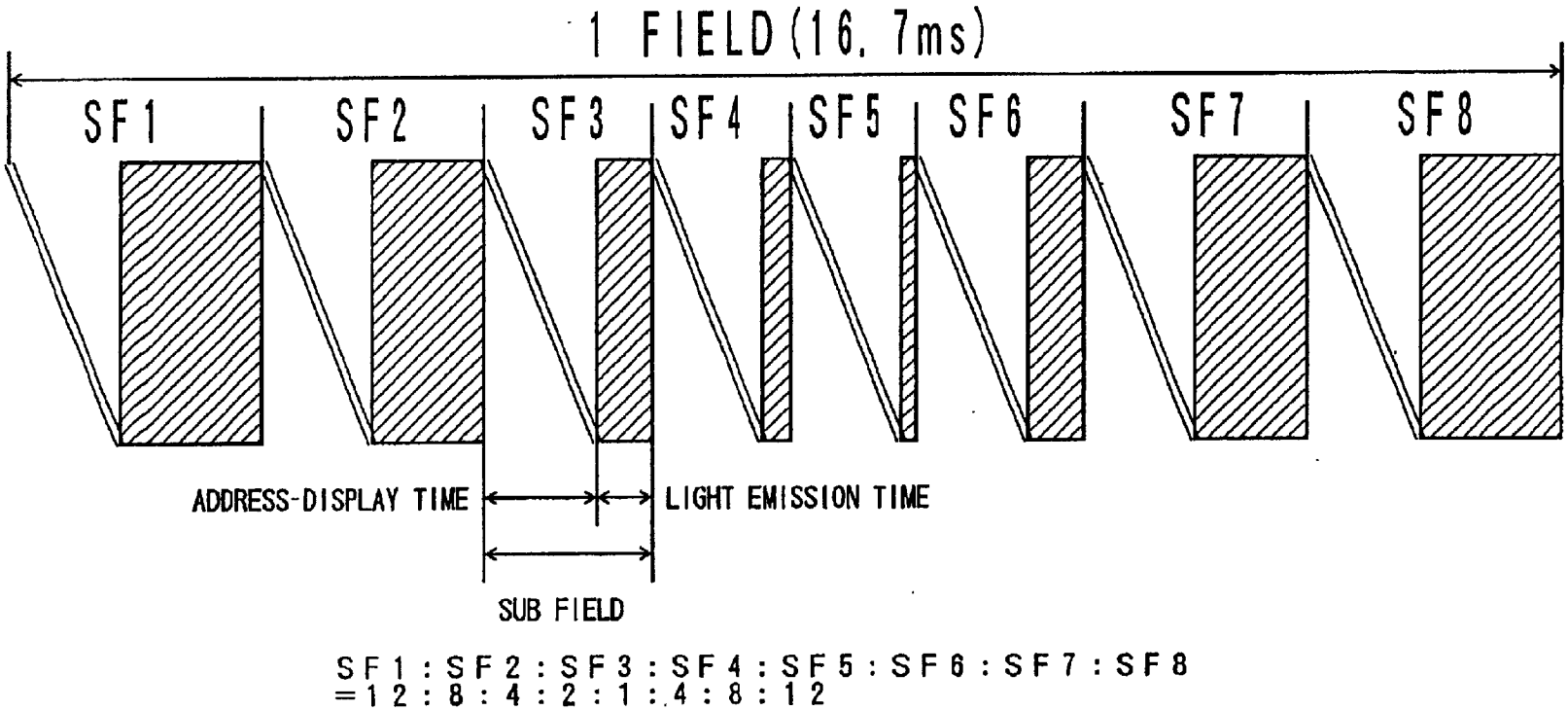
FIG. 61 is a diagram for explaining a PDP driving sequence in a fourth embodiment of the display driving method according to the present invention.

Next, a description will be given of the PDP driving sequence in this embodiment. For the sake of convenience, it is assumed that 1 field is made up of 8 sub fields SF1 through SF8. In addition, it is assumed that the ratios of the luminance levels of the sub fields SF1 through SF8 are set to satisfy SF1:SF2:SF3:SF4:SF5:SF6:SF7:SF8= 12:8:4:2:1:4:8:12. Hence, the PDP driving sequence in this case becomes as shown in FIG. 61.

Figure 62:
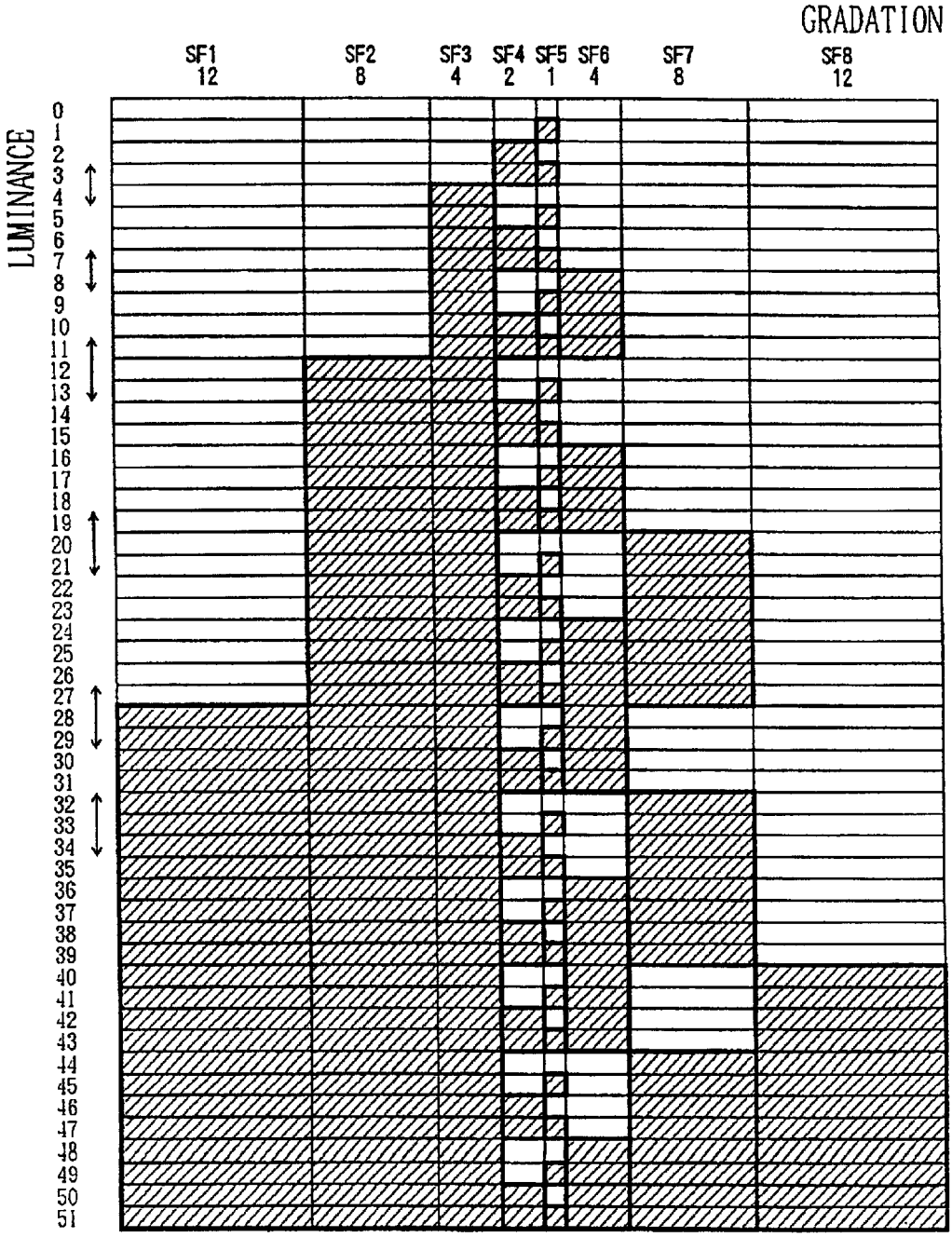
FIG. 62 is a diagram showing an arrangement of the sub fields having the light emission state for each luminance level in a main path.
Figure 63:
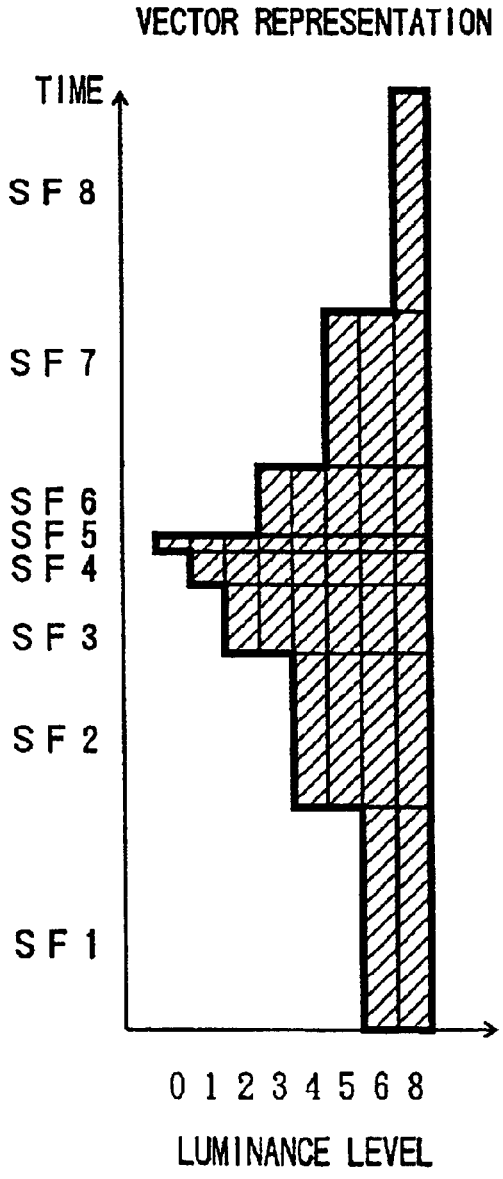
FIG. 63 is a diagram showing an arrangement of the sub fields having the light emission state for each luminance level in a sub path.

In this case, the main path can process the input image signal to be displayable in 52 actual display gradation levels, and the arrangement of the sub fields having the light emission state for each luminance level becomes as indicated by the hatching in FIG. 62. On the other hand, the sub path can process the input image signal to be displayable in 9 actual display gradation levels, and the arrangement of the sub fields having the light emission state for each luminance level becomes as indicated by the hatching in FIG. 63.

Figure 64:
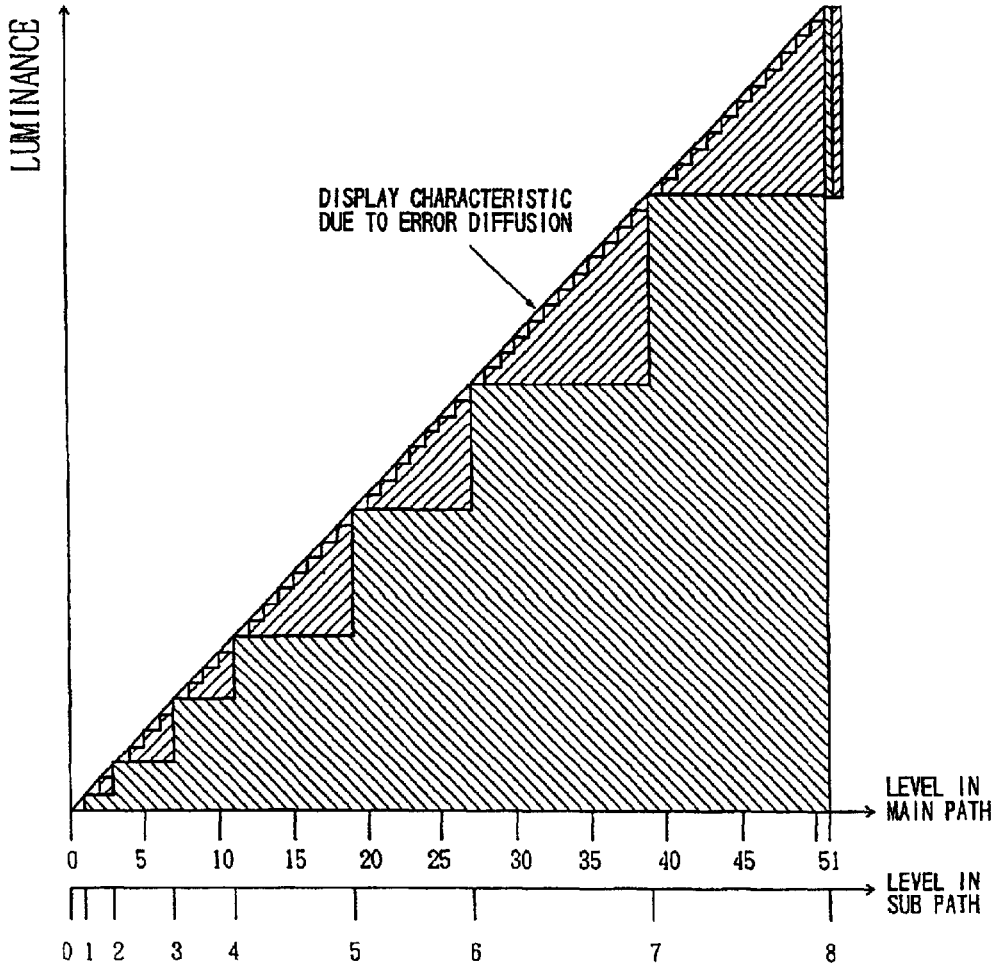
FIG. 64 is a diagram showing display characteristics of main and sub paths.

The display characteristic becomes non-linear when the input image signal is simply processed by the sub path. Thus, an inverse function correction process for correcting the non-linear characteristic and an error diffusion process are carried out, so as to correct the non-linear display characteristic into a linear display characteristic. The display characteristics of the main path and the sub path for this case are shown in FIG. 64. In FIG. 64, the display characteristic of the main path is indicated by a leftwardly declining hatching, and the display characteristic of the sub path is indicated by a rightwardly declining hatching. As may be seen from FIG. 64, a linear display characteristic is obtainable by both the main path and the sub path.

Figure 65:
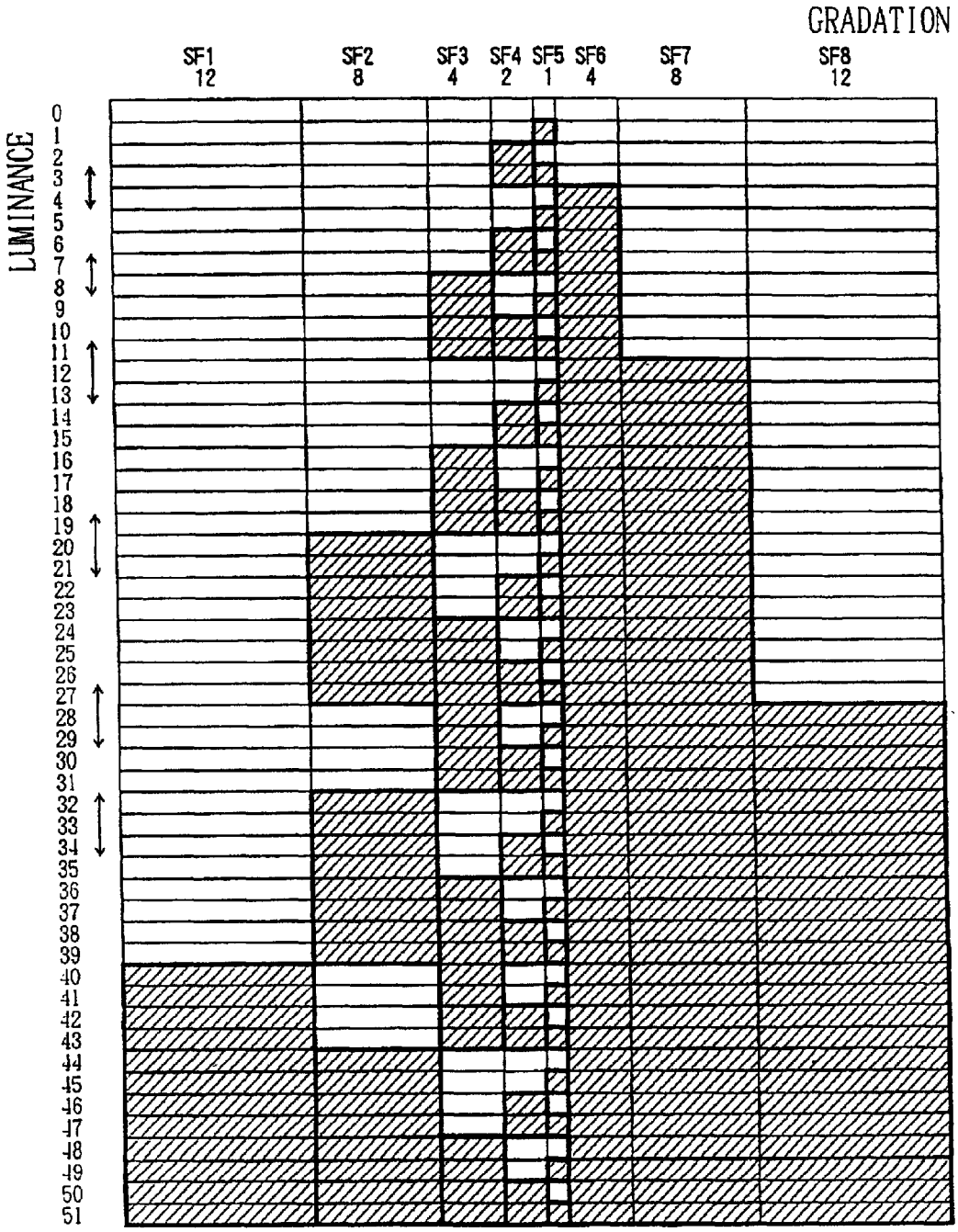
FIG. 65 is a diagram showing an arrangement of the sub fields having the light emission state for each luminance level in the main path.

FIG. 65 shows the arrangement of the sub fields having the light emission state for each luminance level with respect to the group B when it is assumed that FIG. 62 shows the arrangement of the sub fields having the light emission state for each luminance level with respect to the group A of the second embodiment described above. In FIG. 65, the sub fields having the light emission state are indicated by the hatching.

Although the input image signal processed by the main path is displayable in 52 actual display gradation levels, the input image signal processed by the sub path is only displayable in 9 actual display gradation levels. Accordingly, the luminance level of the input image signal which is processed by the sub path must be converted to match the luminance level of the input image signal which is processed by the main path. The following Table 2 is used for such a conversion of the luminance level. This Table 2 will be referred to as a luminance conversion table.

TABLE 2

| Luminance Level in Sub Path | Luminance Level in Main Path |
|---|---|
| 0 | 0 |
| 1 | 1 |
| 2 | 3 |
| 3 | 7 |
| 4 | 11 |
| 5 | 19 |
| 6 | 27 |
| 7 | 39 |
| 8 | 51 |

Figure 66:
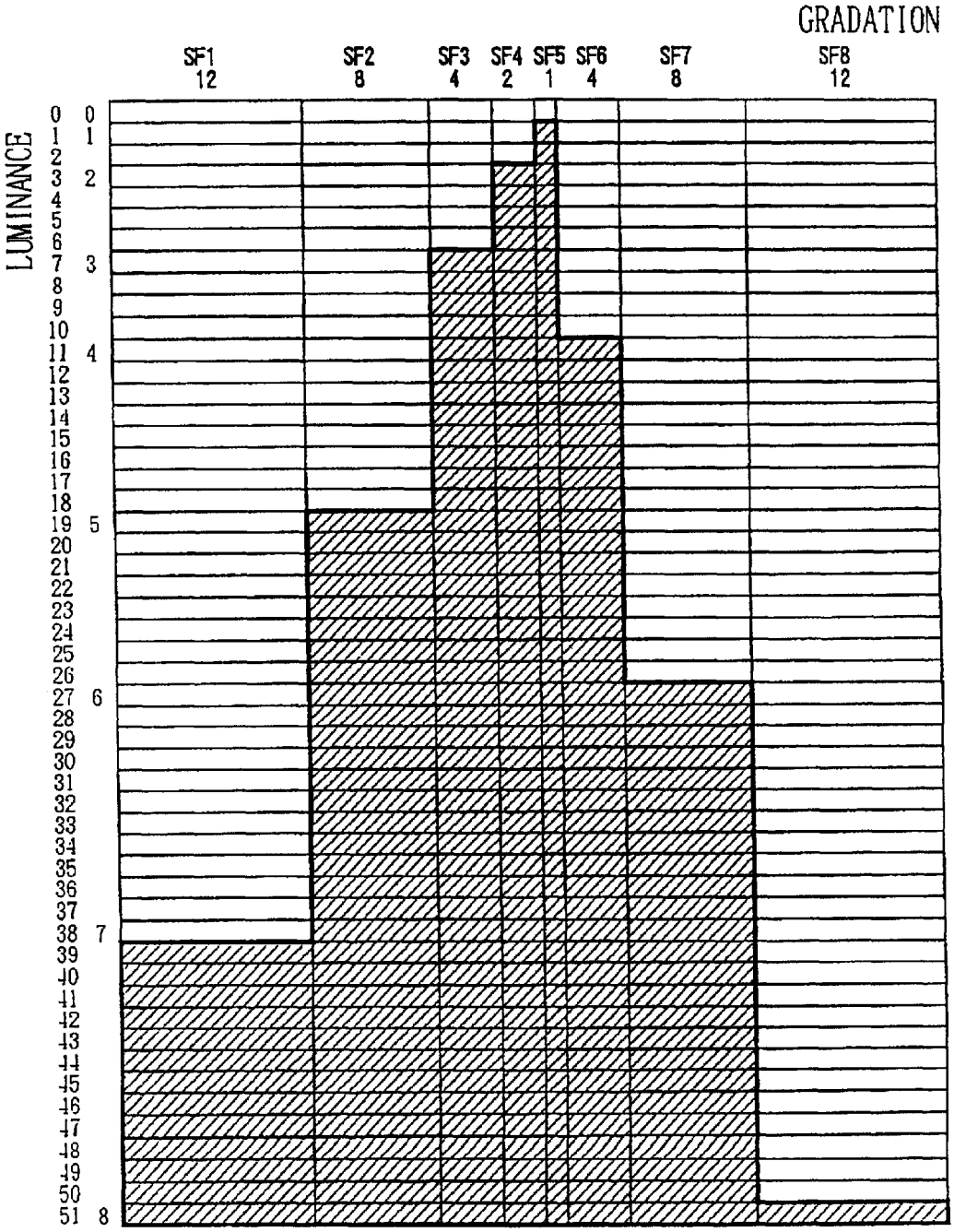
FIG. 66 is a diagram showing an arragement of the sub fields having the light emission state for each luminance level with respect to an input image signal which is processed by the sub path when a luminance level conversion is made, on a diagram which shows the arrangement of the sub fields having the light emission state for each luminance level with respect to an input image signal which is processed by the main path shown in FIG. 62.
Figure 67:
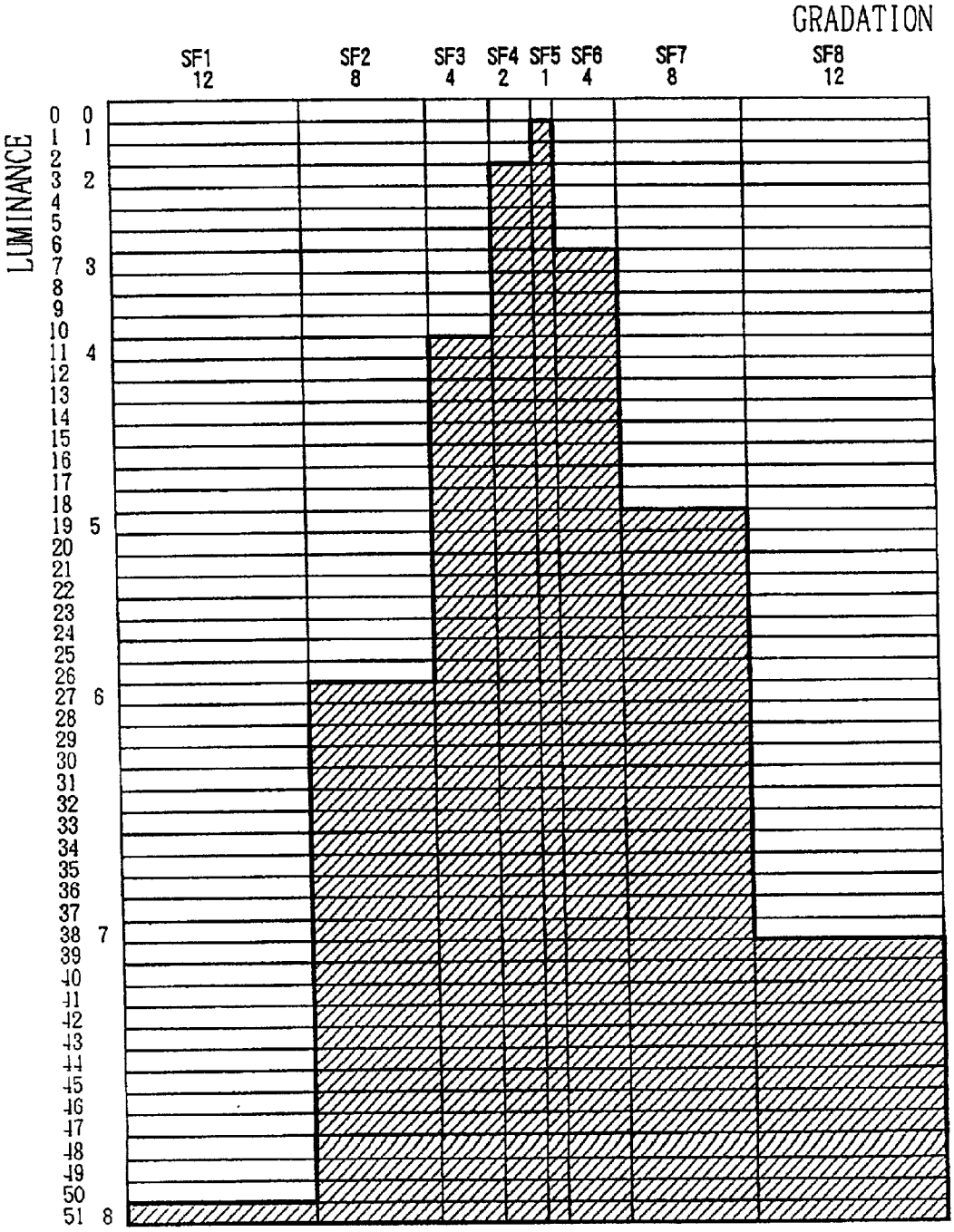
FIG. 67 is a diagram showing an arragement of the sub fields having the light emission state for each luminance level with respect to an input image signal which is processed by the sub path when a luminance level conversion is made, on a diagram which shows the arrangement of the sub fields having the light emission state for each luminance level with respect to an input image signal which is processed by the main path shown in FIG. 65.

FIG. 66 is a diagram showing the arrangement of the sub fields having the light emission state for each luminance level with respect to the input image signal which is processed by the sub path when the luminance level conversion is made, on the diagram which shows the arrangement of the sub fields having the light emission state for each luminance level with respect to the input image signal which is processed by the main path shown in FIG. 62. In addition, FIG. 67 is a diagram showing the arrangement of the sub fields having the light emission state for each luminance level with respect to the input image signal which is processed by the sub path when the luminance level conversion is made, on a diagram which shows the arrangement of the sub fields having the light emission state for each luminance level with respect to the input image signal which is processed by the main path shown in FIG. 65. FIGS. 66 and 67, the sub fields having the light emission state are also indicated by the hatching. By carrying out the luminance level conversion described above, the display on the PDP can be made with the same luminance quantity regardless of whether the input image signal is processed by the main path or by the sub path.

When the input image signal has 8 bits, the input luminance value can be represented in 256 gradation levels from level 0 to level 255. Hence, for the sake of convenience, the processing carried out by the main path and the sub path will now be described for a case where the luminance quantity is 50%, that is, the input luminance value is 128.

The main path includes a first gain control circuit which controls the gain of the input image signal, and a first error diffusion circuit (or multi-level gradation processing circuit). The first gain control circuit multiplies a gain coefficient 51·4÷255=208/255 to the input image signal, that is, the input luminance value 128. The first error diffusion circuit carries out an error diffusion process for obtaining a 6-bit output with respect to the multiplication result from the first gain control circuit. As a result, the input luminance value is represented by the levels 25 and 26 in the luminance level of the main path.

On the other hand, the sub path includes a second gain control circuit which controls the gain of the input image signal, a second error diffusion circuit, and a data matching circuit. The second gain control circuit multiplies a gain coefficient 8·16÷255=128/255 to the input image signal, that is, the input luminance value 128. The second error diffusion circuit carries out an error diffusion process for obtaining a 4-bit output with respect to the multiplication result from the second gain control circuit. As a result, the input luminance value is represented by the levels 5 and 6 in the luminance level of the sub path. These luminance levels 5 and 6 are converted into the luminance levels 19 and 27 of the main path by the data matching circuit using the luminance conversion table. Accordingly, the luminance value output from the data matching circuit is represented by the luminance levels 19 and 27 of the main path.

Figure 68:
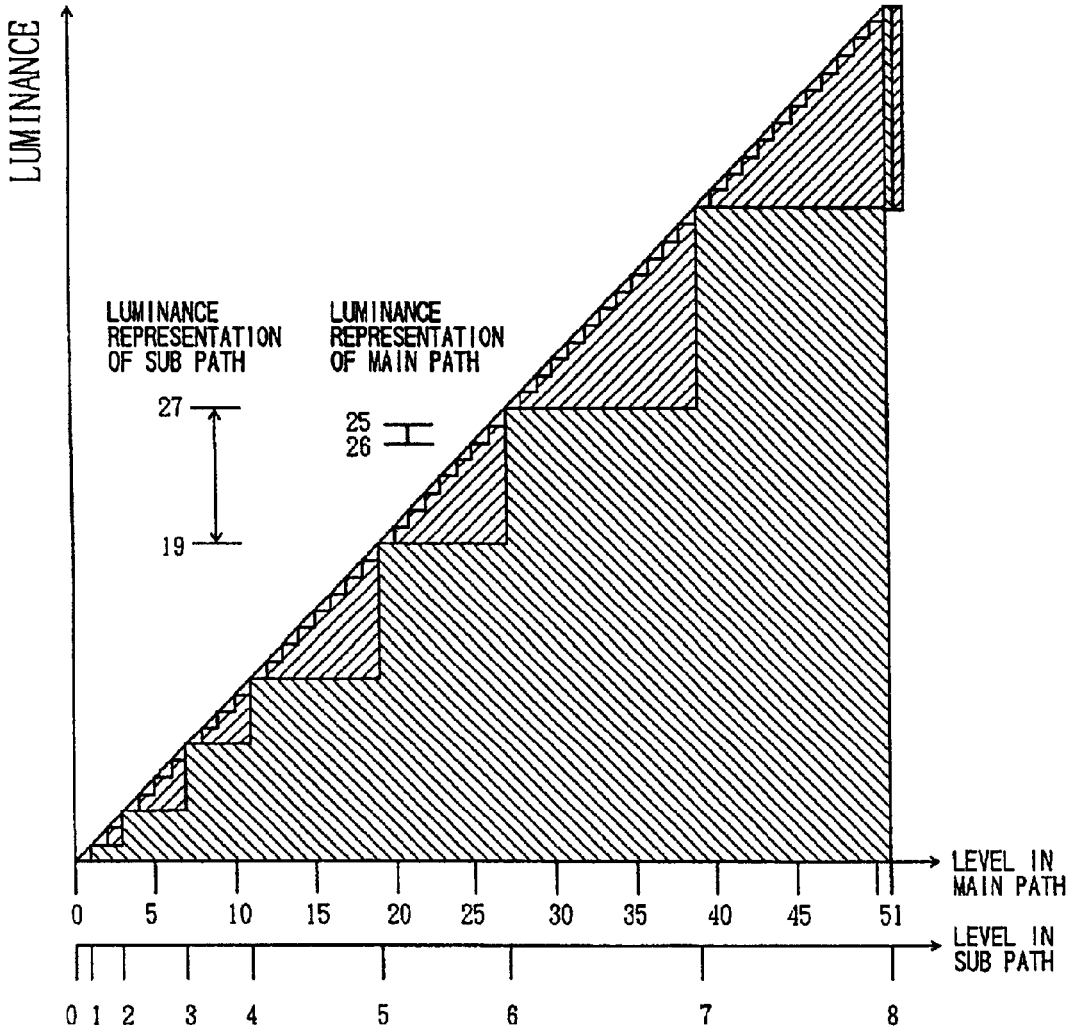
FIG. 68 is a diagram showing a luminance representation realized by the processing of the main and sub paths.

Therefore, according to this embodiment, the input image signal is displayed on the PDP with the same luminance quantity regardless of whether the input image signal is processed by the main path or the sub path. FIG. 68 is a diagram showing the luminance representation obtained by the processing carried out by the main and sub paths. In FIG. 68, the display characteristic of the main path is indicated by the leftwardly declining hatching, and the display characteristic of the sub path is indicated by the rightwardly declining hatching.

By processing the input image signal by the main path or the sub path, it is possible to obtain effects as if two different PDP driving sequences are used, even though the PDP is driven by a single PDP driving sequence. However, the input image signal displayed on the PDP is represented by the original luminance quantity of the input image signal, regardless of whether the input image signal is processed by the main path or the sub path.

An extremely good signal-to-noise ratio is obtained when the input image signal is processed by the main path. On the other hand, although an extremely good signal-to-noise ratio is obtained, the generation of the pseudo contour is completely eliminated when the input image signal is processed by the sub path. Hence, in this embodiment, the main and sub paths are switched so that the image signal related to the pixel which makes the pseudo contour conspicuous is processed by the sub path. As a result, it is possible to always completely eliminate the pseudo contour regardless of the image indicated by the input image signal. The pixel which makes the pseudo contour conspicuous or the pixel which easily generates the pseudo contour (such pixels will hereinafter be simply referred to as pixels which make the pseudo contour conspicuous) can be detected by a combination of the detection methods described below.

The pseudo contour is easily generated at a moving object within the image. According to a first detection method, a moving region within the image indicated by the input image signal is detected, so as to detect the pixels which make the pseudo contour conspicuous. More particularly, a difference is obtained between the input image signal of the present field and the input image signal of 1 field before or, a difference is obtained between the input image signal of the present field and the input image signal of 2 fields before, and the pixel in the moving region is detected based on the difference, that is, a level difference.

The pseudo contour becomes notable at a portion of the image where the gradation level smoothly or gradually changes. In other words, it is difficult to detect the pseudo contour at a portion of the image including a large number of high-frequency components. Hence, according to a second detection method, the edge component within the image indicated by the input image signal, that is, the spatial frequency characteristic, is detected, so as to detect the pixel which makes the pseudo contour conspicuous. The processing path is switched to the sub path at the portion of the image where the gradation level smoothly or gradually changes, that is, the portion including a large number of low-frequency components, so that the input image signal is processed by the sub path at such a portion, thereby increasing the sensitivity.

The edge component can also be used when detecting the moving region within the image. At the edge portion of the image, the difference between the input image signals of 2 successive fields, for example, becomes relatively large even for a region which makes an extremely small movement. Hence, in this case, the possibility of the moving quantity becoming unnecessarily large is high. For this reason, the edge component can be used by dividing the difference by the edge component when normalizing the moving quantity.

Furthermore, the pseudo contour is easily generated at specific luminance portions within the image. For example, when the arrangement of the sub fields having the light emission state shown in FIG. 62 is used in the main path, the portion which is represented by the luminance levels 3 and 4 and the portion represented by the luminance levels 11 and 12 correspond to such specific luminance portions. In the specific luminance portion, the sub fields having the light emission state greatly change on the time base, even though the gradation level only changes by an extremely small amount. The luminance levels at which the pseudo contour is conspicuous, that is, the specific luminance portions, are indicated by the ranges of the arrows shown on the left side of FIG. 62.

Hence, according to the third detection method, the specific luminance portion within the image indicated by the input image signal, that is, the luminance level in the range where the pseudo contour is conspicuous, is detected, so as to detect the pixel which makes the pseudo contour conspicuous.

Of course, the method of detecting the pixel which makes the pseudo contour conspicuous is not limited to the combination of the first through third detection methods described above.

Accordingly, a path selection/switching signal which determines which one of the main and sub paths is to be used to process the input image signal, can be generated based on the pixels which make the pseudo contour conspicuous and are detected by the method such as the first through third methods described above, depending on the image indicated by the input image signal. By use of such a path selection/switching signal, it is possible to switch the processing path to the sub path which has the higher capability of eliminating the pseudo contour, only when processing the data of the pixels which make the pseudo contour conspicuous. As described above, the pixels which make the pseudo contour conspicuous correspond to the moving object within the image, including a smooth change in the gradation level, and having the specific luminance level, that is, the luminance level where the sub fields having the light emission state greatly change with the change in the gradation level of the main path. The data related to the pixels which make the pseudo contour conspicuous and are detected from such features, are processed by the sub path before being supplied to the PDP, while the data related to other pixels are processed by the main path and supplied to the PDP.

Accordingly, the input image signal is normally processed by the main path which realizes an extremely good signal-to-noise ratio and a large number of actual display gradation levels on the PDP. On the other hand, although the signal-to-noise ratio slightly deteriorates, the input image signal at the image portion having a high possibility of generating the pseudo contour is processed by the sub path which has an extremely high pseudo contour elimination capability before being displayed on the PDP. In this case, the sub fields having the light emission state in the main path and the sub fields having the light emission state in the sub path have a close relationship to each other, and for this reason, a boundary portion where the processing path is switched is virtually inconspicuous. In addition, since the image indicated by the input image signal which is processed by the sub path is basically a moving body, the signal-to-noise ratio of the image processed by the sub path slightly deteriorates compared to that processed by the main path, but no problems are introduced from the practical point of view because the image deterioration is virtually undetectable by the human eyes. As a result, this embodiment can greatly improve the display characteristic of the moving image on the PDP.

Next, a description will be given of a fifth embodiment of the display driving apparatus according to the present invention. This fifth embodiment of the display driving apparatus employs the fifth embodiment of the display driving method described above.

Figure 69:
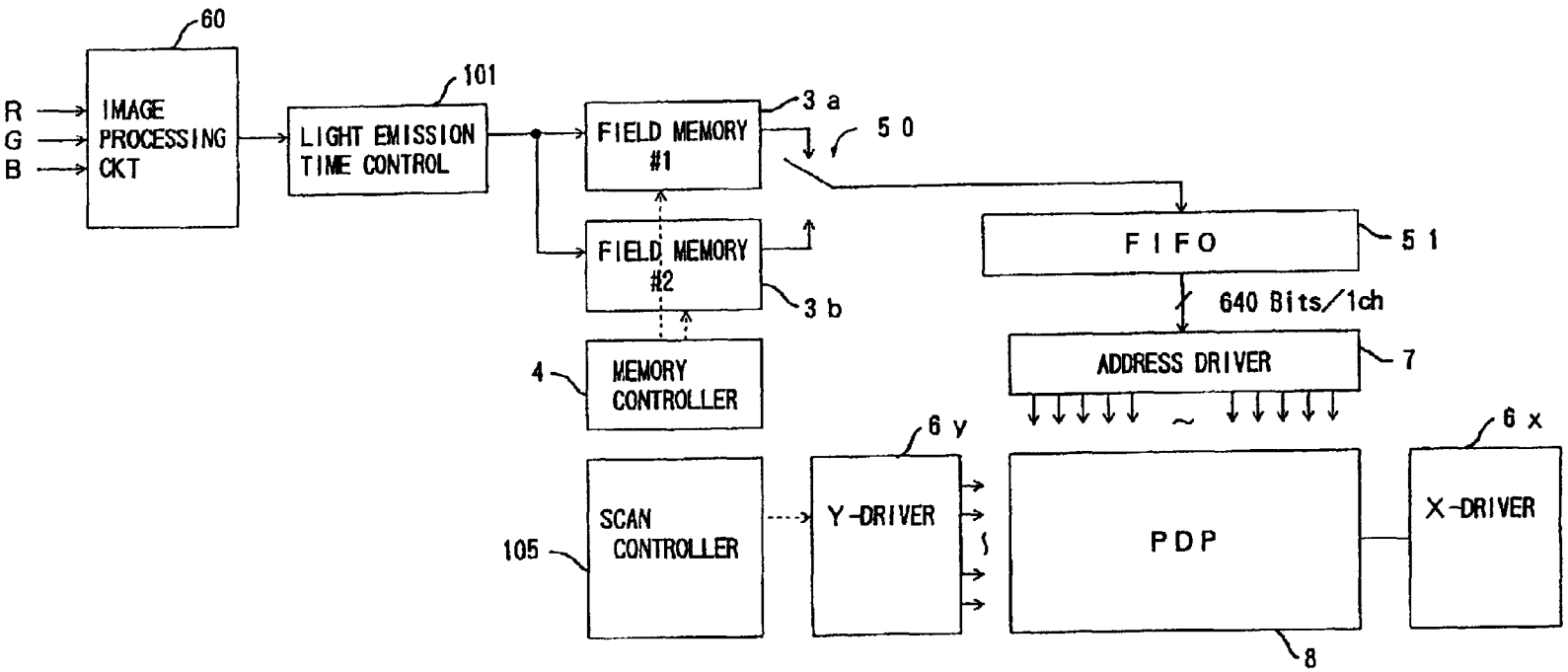
FIG. 69 is a system block diagramm showing a fifth embodiment of the display driving apparatus according to the present invention.

FIG. 69 is a system block diagram showing the general construction of the fifth embodiment of the display driving apparatus. In FIG. 69, those parts which are the same as those corresponding parts in FIG. 47 are designated by the same reference numerals, and a description thereof will be omitted. In this embodiment, an image processing circuit 60 which is input with the input image signal is provided at a state preceding the light emission time control circuit 101.

In FIG. 69, the scan controller 105 determines the length of the light emission time of each sub field, that is, the number of sustain pulses applied to the sustain electrode of the PDP 8, with respect to each pixel when driving the PDP 8. For the sake of convenience, it is assumed that ratios of the number of sustain pulses of each of the sub fields SF1 through SF8 are set to SF1:SF2:SF3:SF4:SF5:SF6:SF7:SF8=12:8:4:2:1:4:8:12. Accordingly, the driving sequence of the PDP 8 is the same as the driving sequence shown in FIG. 61.

In addition, the light emission time control circuit 101 determines which sub fields are to assume the light emission state depending on each luminance level and combined. When the table shown in FIG. 62 is formed by a ROM or RAM, the input image signal (RGB signals) becomes the input address to the ROM or RAM table forming the light emission time control circuit 101, and the output of the light emission time control circuit 101 becomes the sub fields which assume the light emission state. In other words, the input to the ROM or RAM table corresponds to the luminance level of the ordinate shown in FIG. 62, and the output of the ROM or RAM table corresponds to the abscissa shown in FIG. 62. In this embodiment, it is assumed that each of the RGB signals forming the input image signal employ the arrangement of the sub fields having the light emission state shown in FIG. 62. Hence, a total of 3 ROM or RAM tables having the same data are provided with respect to the three primary colors R, G and B.

When the image is divided into two groups A and B having the pixels arranged in the checker-board pattern and the sub fields having the light emission state are to be switched between the two groups A and B, the light emission time control circuit 101 carries out the process of overlapping the arrangement of the sub fields having the light emission state shown in FIG. 62 and the arrangement of the sub fields having the light emission state shown in FIG. 65.

Figure 70:
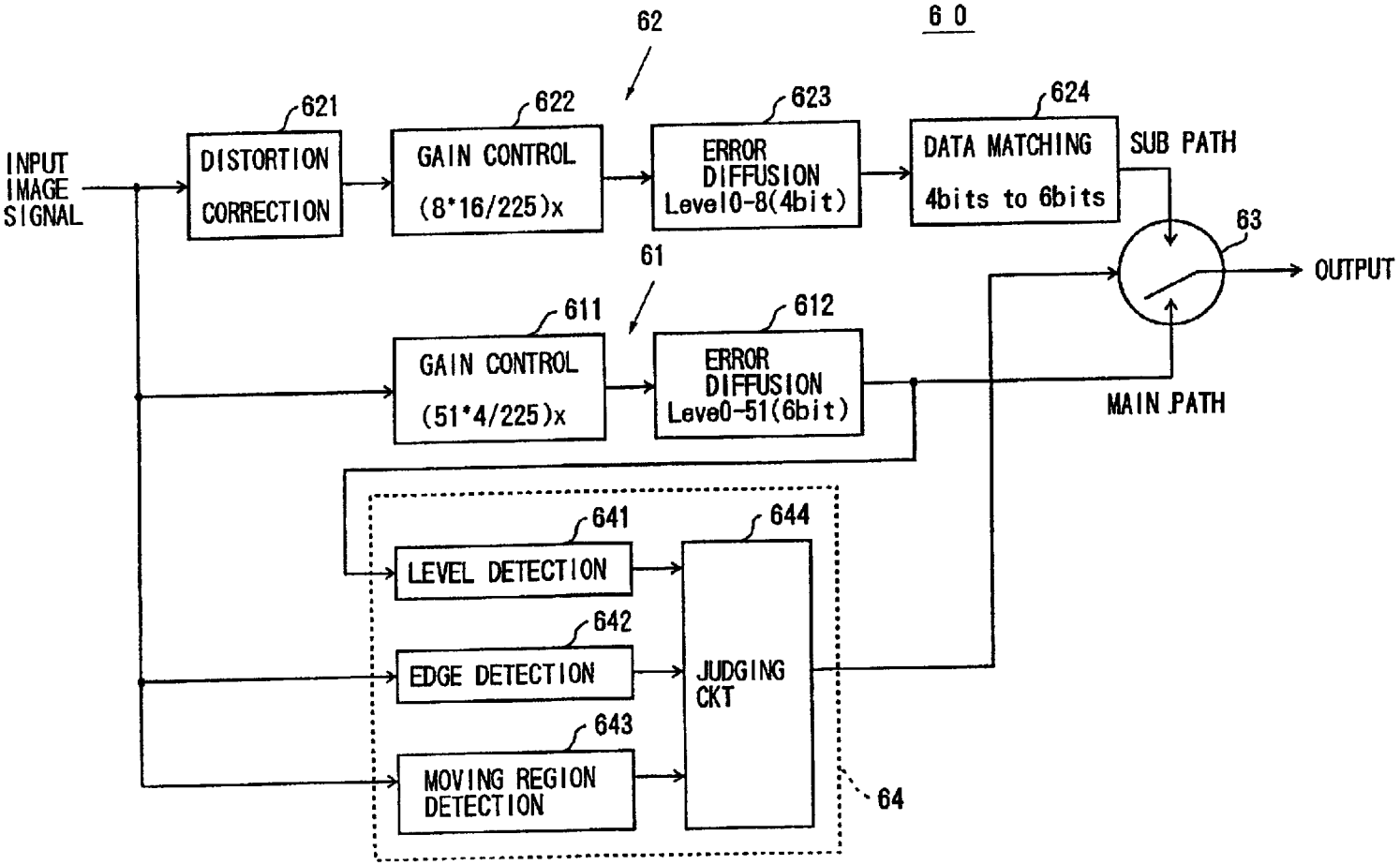
FIG. 70 is a system block diagram showing a first embodiment of an image processing circuit.

FIG. 70 is a system block diagram showing a first embodiment of the image processing circuit 60 shown in FIG. 69. In FIG. 70, the image processing circuit 60 generally includes a main path 61, a sub path 62, a switching circuit 63, and an image feature judging unit 64. The input image signal is input in parallel to the main path 61, the sub path 62, and a part of the image feature judging unit 64. An output of the main path 61 is supplied to the switching circuit 63 and a part of the image feature judging unit 64. An output of the sub path 62 is supplied to the switching circuit 63. The switching circuit 63 supplies the image signal from the main path 61 or the sub path 62 to the light emission time control circuit 101 shown in FIG. 69 based on a path selection/switching signal from the image feature judging unit 64.

The main path 61 includes a gain control circuit 611 and an error diffusion circuit 612 which are connected as shown in FIG. 70. On the other hand, the sub path 62 includes a distortion correction circuit 621, a gain control circuit 622, an error diffusion circuit 623 and a data matching circuit 624 which are connected as shown in FIG. 70. In addition, the image feature judging unit 64 includes a level detection circuit 641, an edge detection circuit 642, a moving region detection circuit 643 and a judging circuit 644 which are connected as shown in FIG. 70. In this embodiment, it is assumed that the main path 61 can represent 52 actual display gradation levels by a 6-bit output. In this case, it assumed that the arrangement of the sub fields having the light emission state for each luminance level of the RGB signals is the same as the arrangement shown in FIG. 62. Hence, the number of display gradation levels per color is 52, that is, from the level 0 to the level 51.

The maximum luminance level displayable on the PDP 8 via the main path 61 is 51 using the 6-bit output. In addition, the maximum luminance level of the input image signal is 255 using an 8-bit input. For this reason, the gain control circuit 611 multiplies a gain coefficient $51 \cdot 2^{8-6}/255=204/255$ to the input image signal. By multiplying this gain coefficient to the input image signal, it becomes possible to carry out an error diffusion process for the entire region of the input image signal in the error diffusion circuit 612 which is provided at a subsequent stage. The gain control circuit 611 can be formed by a general multiplier, a ROM, a RAM or the like.

The error diffusion circuit 612 carries out an error diffusion process with respect to the image signal which is received via the gain control circuit 611, so as to generate a pseudo-half tone, so as to give an impression as if the number of gradation levels have increased. In this embodiment, the number of display gradation levels of the main path 61 is 52, and the number of output bits of the error diffusion circuit 612 is 6.

The construction of the main path 61 and the constructions of the gain control circuit 611 and the error diffusion circuit 612 which form the main path 61 can easily be understood from the first and third embodiments described above. For this reason, a detailed description thereof will be omitted.

In this embodiment, it is assumed that the sub path 62 represents 9 actual display gradation levels by a 4-bit output. In this case, it is also assumed that the arrangement of the sub fields having the light emission state for each luminance level of the RGB signals is the same as the arrangement shown in FIG. 63. Accordingly, the number of display gradation levels per color is 9, that is, from the level 0 to the level 8.

The sub path 62 can represent the gradation in 9 steps from the level 0 to the level 8, however, the luminance quantity increases as 0, 1, 3, 7, 11, . . . , and the change in the luminance quantity is not uniform. Hence, a correction using an inverse function is carried out with respect to the display characteristic after the error diffusion process, so as to obtain a linear display characteristic as a whole. The distortion correction circuit 621 stores such an inverse function characteristic in a ROM or RAM table.

The maximum luminance level displayable on the PDP 8 via the sub path 62 is 8 using the 4-bit output. In addition, the maximum luminance level of the input image signal is 255 using the 8-bit input.

For this reason, the gain control circuit 622 multiplies a gain coefficient $8 \cdot 2^{8-4}/255=128/255$ to the input image signal. By multiplying this gain coefficient to the input image signal, it becomes possible to carry out an error diffusion process for the entire region of the input image signal in the error diffusion circuit 623 which is provided at a subsequent stage. The gain control circuit 622 can be formed by a general multiplier, a ROM, a RAM or the like.

The error diffusion circuit 623 carries out an error diffusion process with respect to the image signal which is received via the gain control circuit 622, so as to generate a pseudo-half tone, so as to give an impression as if the number of gradation levels have increased. In this embodiment, the number of display gradation levels of the sub path 62 is 9, and the number of output bits of the error diffusion circuit 623 is 4.

The construction of the sub path 62 and the constructions of the gain control circuit 622 and the error diffusion circuit 623 which form the sub path 62 can easily be understood from the fourth embodiment described above. For this reason, a detailed description thereof will be omitted.

The data matching circuit 624 is provided to match the luminance level of the sub path 62 to the luminance level of the main path 61. In this embodiment, the data matching circuit 624 is formed by a ROM or RAM table containing the information shown in the Table 2 described above.

The switching circuit 63 switches the path which is used to process the input image signal depending on the input image signal, that is, based on the path selection/switching signal received from the image feature judging unit 64. Hence, with respect to the RGB signals forming the input image signal, the path switching is carried out independently for each of the primary colors R, G and B. Thus, even in the case of the RGB signals related to the same pixel, the R signal may be processed by the main path 61 while the G signal and the B signal are processed by the sub path 62, for example.

Next, a description will be given of the operation of the image feature judging unit 64. The image feature judging unit 64 detects the image in which the pseudo contour is easily generated, and generates the path selection/switching signal which instructs the switching circuit 63 to switch the processing path so that the sub path 62 processes the pixel data of the image in which the pseudo contour is easily generated.

As described above, the pseudo contour is generated at the specific luminance. In other words, even if the gradation level only changes by an extremely small amount, the pseudo contour is easily generated at the luminance level where the sub fields having the light emission state greatly change on the time base. Hence, based on the output of the error diffusion circuit 612 of the main path 61, the level detection circuit 641 supplies to the judging circuit 644 a signal which controls the sensitivity with which the processing path is switched to the sub path 62 in response to the path selection/switching signal which is output from the judging circuit 644. More particularly, the level detection circuit 641 outputs a signal which increases the sensitivity with which the processing path is switched to the sub path 62 at the luminance level where the pseudo contour is conspicuous, and outputs a signal which decreases the sensitivity with which the processing path is switched to the sub path 62 at the luminance level where the pseudo contour is originally difficult to detect even if the image includes a portion which moves considerably.

The level detection circuit 641 detects the luminance level using the output image data of the main path 61, because the luminance level where the pseudo contour is conspicuous is approximately determined depending on the arrangement of the sub fields having the light emission state in the main path 61.

At the portion within the image including a large number of high-frequency components, that is, at the edge portion, a difference is detected between the fields even in a region which moves by an extremely small amount, and the moving quantity is detected with an unnecessarily large value. Hence, the edge detection circuit 642 detects the edge portion within the image based on the input image signal and supplies the detected edge component to the judging circuit 644. Accordingly, the judging circuit 644 can normalize the moving quantity, that is, the degree of motion, by dividing the difference by the edge component, as will be described later. As a result, the moving quantity of the edge portion is suppressed, and the judging circuit 644 generates the path selection/switching signal so that the edge portion will not be processed by the main path 61.

In addition, the pseudo contour becomes conspicuous at the portion of the image where the gradation level smoothly or gradually changes. In other words, the pseudo contour is difficult to detect at a portion of the image including a large number of high-frequency components. Such a characteristic of the pseudo contour is also an important factor to be considered when judging the path switching. The edge detection circuit 642 supplies to the judging circuit 644 a signal which controls the sensitivity with which the processing path is switched to the sub path 62 in response to the path selection/switching signal, based on the input image signal. More particularly, the sensitivity with which the processing path is switched to the sub path 62 is controlled so that the low-frequency region having a smooth change in the gradation level is more easily processed by the sub path, that is, the edge portion is more easily processed by the main path 61.

Basically, the moving region detection circuit 643 detects the region including motion within the image based on the difference between the image of the present field and the image of 1 field before, the difference between the image of the present field and the image of 2 fields before and the like. More particularly, the moving region detection circuit 643 calculates the moving quantity of each pixel based on an absolute value of the difference which is obtained from the input image signal.

The judging circuit 644 judges whether or not the pseudo contour is easily generated in the image data to be processed, based on the luminance level detected by the level detection circuit 641, the edge portion within the image detected by the edge detection circuit 642, and the region including motion within the image detected by the moving region detection circuit 643. In addition, the judging circuit 644 generates and supplies the path selection/switching signal to the switching circuit 63 so that only the image data in which the pseudo contour is easily generated is processed by the sub path 62.

Figure 71:
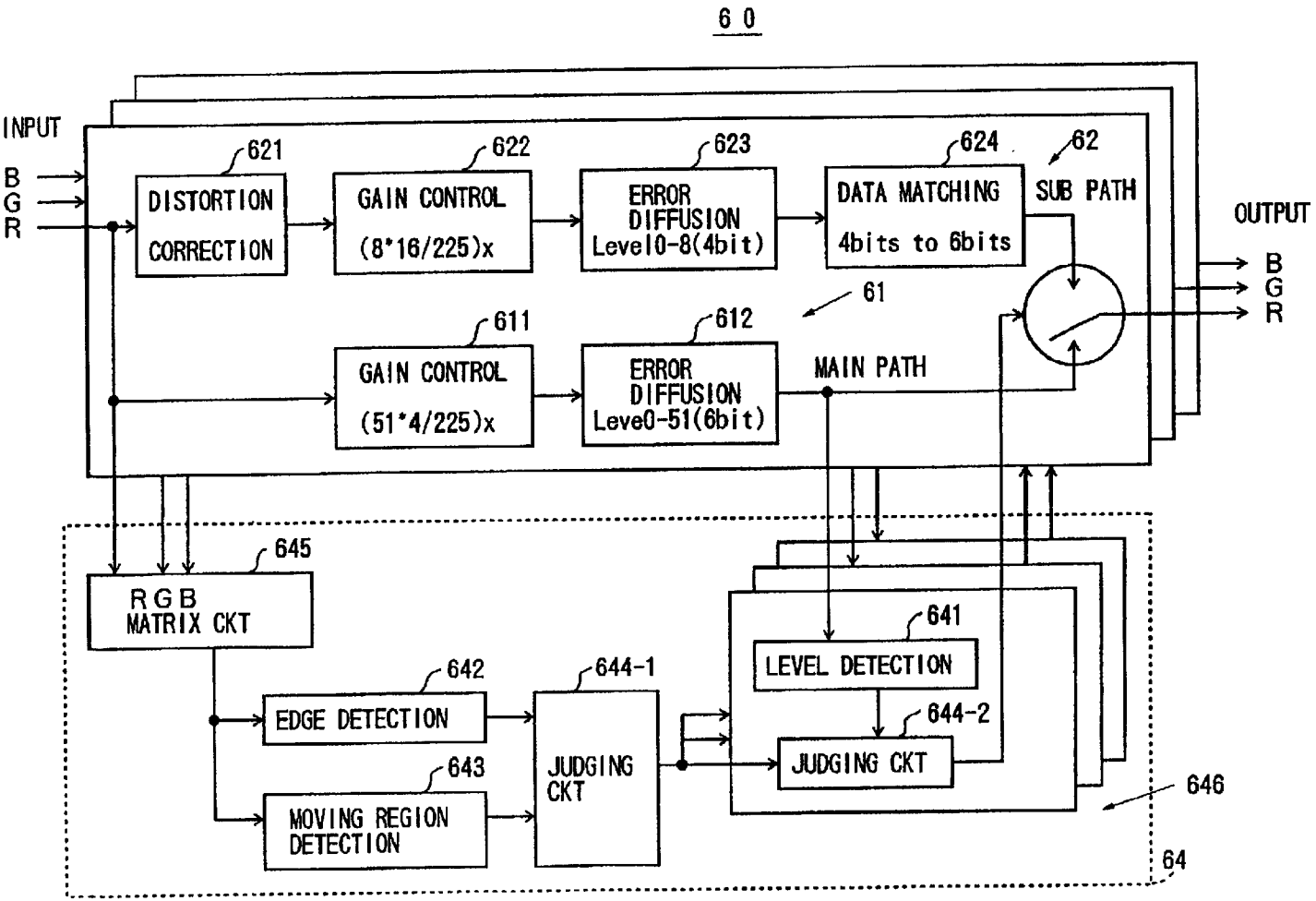
FIG. 71 is a system block diagram showing a second embodiment of the image processing circuit.

FIG. 71 is a system block diagram showing a second embodiment of the image processing circuit 60. In FIG. 71, those parts which are the same as those corresponding parts in FIG. 70 are designated by the same reference numerals, and a description thereof will be omitted. In FIG. 71, the image feature judging unit 64 has a construction different from that of FIG. 70.

The image feature judging unit 64 shown in FIG. 71 includes a RGB matrix circuit 645, the edge detection circuit 642, the moving region detection circuit 643, a judging circuit 644-1, the level detection circuit 641 and a judging circuit 644-2 which are connected as shown.

The circuit scale becomes extremely large when the motion detection and the edge detection with respect to the image is carried out independently in the three processing systems corresponding to the three primary colors R, G and B. For this reason, this embodiment generates a luminance signal in the RGB matrix circuit 645 from each of the RGB signals. Using this luminance signal as a representative signal, the moving region detection circuit 643 detects the moving region of the image, and the edge detection circuit 642 detects the edge portion of the image. In addition, a luminance signal Y is generated using a generating formula approximated by $Y=0.30R+0.59G+0.11B$, for example.

The moving region detection circuit 643 detects the region including motion within the image, based on a minimum value of the difference between the luminance signals of 1 field interval and the difference between the luminance signals of 2 field intervals. The detection result of the moving region detection circuit 643 is supplied to the judging circuit 644-1. On the other hand, the edge detection circuit 642 calculates an edge in the horizontal direction (horizontal line) and an edge in the vertical direction (vertical line) from the luminance signal, and obtains an edge quantity by mixing these calculated edges. The obtained edge quantity is supplied to the judging circuit 644-1. Accordingly, the judging circuit 644-1 judges the pixels which easily generate the pseudo contour based on output information of the moving region detection circuit 643 and the edge detection circuit 642. A judgement result of the judging circuit 644-1 is supplied to the judging circuit 644-2.

On the other hand, the level detection circuit 641 detects the luminance level based on each of the RGB signals from the main path 61. The luminance level detected by the level detection circuit 641 is supplied to the judging circuit 644-2. Hence, based on the judgement result from the judging circuit 644-1 and the luminance level detected by the level detection circuit 641, the judging circuit 644-2 generates the path selection/switching signal so that the pixel data greater than a predetermined level are processed by the sub path 62 and supplies this path selection/switching signal to the switching circuit 63. The level detection circuit 641 and the judging circuit 644-2 form a level detection unit 646.

According to this embodiment, the input image signal is normally processed by the main path 61 which secures a certain number of gradation levels, and the processing path is automatically switched to the sub path 62 only with respect to the pixel data of the pixels which easily generate the pseudo contour. For this reason, the input image signal is normally processed by the main path 61 which realizes an extremely good signal-to-noise ratio and a large number of actual display gradation levels on the PDP 8. On the other hand, although the signal-to-noise ratio slightly deteriorates, the input image signal at the image portion having a high possibility of generating the pseudo contour is processed by the sub path 62 which has an extremely high pseudo contour elimination capability before being displayed on the PDP 8. In this case, the sub fields having the light emission state in the main path 61 and the sub fields having the light emission state in the sub path 62 have a close relationship to each other, and thus, a boundary portion where the processing path is switched is virtually inconspicuous. In addition, since the image indicated by the input image signal which is processed by the sub path 62 is basically a moving body, the signal-to-noise ratio of the image processed by the sub path 62 slightly deteriorates compared to that processed by the main path 61, but no problems are introduced from the practical point of view because the image deterioration is virtually undetectable by the human eyes. As a result, this embodiment can greatly improve the display characteristic of the moving image on the PDP 8.

Figure 72:
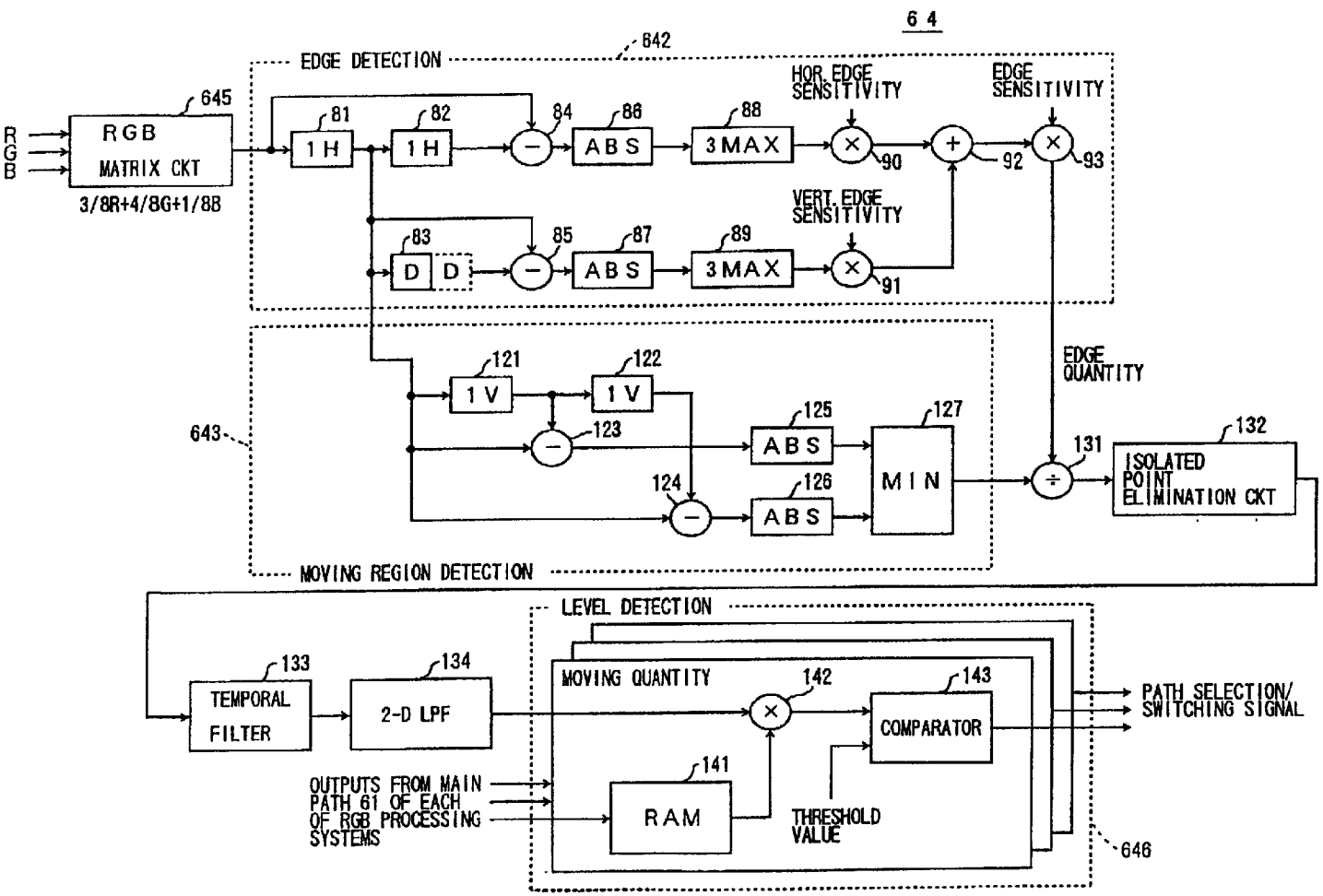
FIG. 72 is a system block diagram showing an embodiment of an image feature judging unit.

FIG. 72 is a system block diagram showing an embodiment of the image feature judging unit 64 shown in FIG. 71.

The edge detection circuit 642 includes 1H delay circuits 81 and 82, a delay circuit 83, subtracting circuits 84 and 85, absolute value circuits 86 and 87, maximum value detection circuits 88 and 89, multiplying circuits 90, 91 and 93, and an adding circuit 92 which are connected as shown in FIG. 72, where 1H denotes 1 horizontal scanning period of the input image signal. The moving region detection circuit 643 includes 1V delay circuits 121 and 122, subtracting circuits 123 and 124, absolute value circuits 125 and 126, and a minimum value detection circuit 127 which are connected as shown in FIG. 72, where 1V denotes 1 vertical scanning period of the input image signal.

In addition, the judging circuit 644-1 includes a dividing circuit 131, and in this embodiment, an isolated point elimination circuit 12, a temporal filter 133 and a two-dimensional lowpass filter 134 are coupled to the output side of the dividing circuit 131, as will be described later. Furthermore, the level detection unit 646 includes a sensitivity RAM 141, a multiplying circuit 142 and a comparator 143 which are connected as shown in FIG. 72.

In the edge detection circuit 642, the subtracting circuit 84 obtains a difference between the present input luminance signal Y and the input luminance signal Y of 2H before, and the absolute value circuit 86 obtains an absolute value of the difference obtained in the subtracting circuit 84. The maximum value detection circuit 88 detects a maximum value of the absolute value obtained in the absolute value circuit 86. For example, the maximum value detection circuit 88 obtains the three largest absolute values obtained in the absolute value circuit 86, and supplies the three values to the multiplying circuit 90. A coefficient which determines the sensitivity with which the horizontal edge extending in the horizontal direction is detected is input to the multiplying circuit 90, and an output of this multiplying circuit 90 is supplied to the adding circuit 92.

On the other hand, the delay circuit 83 delays the input luminance signal Y by a pixel unit D, and thus, the subtracting circuit 85 obtains a difference between the pixels of the input image signal. The absolute value circuit 87 obtains an absolute value of the difference that is obtained in the subtracting circuit 85. The maximum value detection circuit 89 detects a maximum value of the absolute value obtained in the absolute value circuit 87. For example, the maximum value detection circuit 89 obtains the three largest absolute values obtained in the absolute value circuit 87, and supplies the three values to the multiplying circuit 91. A coefficient which determines the sensitivity with which the vertical edge extending in the vertical direction is detected is input to the multiplying circuit 91, and an output of this multiplying circuit 91 is supplied to the adding circuit 92.

An output of the adding circuit 92 is supplied to the multiplying circuit 93 which multiplies a coefficient that determines the edge detection sensitivity as a whole. As a result, the multiplying circuit 93 outputs a signal which indicates the edge quantity, and this output signal of the multiplying circuit 93 is supplied to the dividing circuit 131 which will be described later.

In the moving region detection circuit 643, the subtracting circuit 123 obtains a difference between the input luminance signals Y of 2 mutually adjacent fields, and supplies this difference to the absolute value circuit 125. The subtracting circuit 124 obtains a difference between the input luminance signals of 1 field intervals, and supplies this difference to the absolute value circuit 126. Hence, the absolute value circuit 125 obtains an absolute value of the difference between the input luminance signal Y of the present field and the input luminance signal Y of 1 field before, and supplies this absolute value to the minimum value detection circuit 127. On the other hand, the absolute value circuit 126 obtains an absolute value of the difference between the input luminance signal Y of the present field and the input luminance signal Y of 2 fields before, and supplies this absolute value to the minimum value detection circuit 127.

The minimum value detection circuit 127 obtains a minimum value out of the absolute values obtained in the absolute value circuits 125 and 126, and supplies this minimum value to the dividing circuit 131 as a signal indicating the moving quantity. When a non-interlace system is employed, there is a possibility of a difference being detected between an odd numbered field and a following even numbered field, even if no movement actually exists within the image. For this reason, the differences are obtained between the input luminance signal Y of the present field and the input luminance signal Y of 1 field before, and between the input luminance signal Y of the present field and the input luminance signal Y of 2 fields before, and the moving quantity is obtained from the minimum value of the absolute values of these differences.

For example, the unit of the absolute values of the differences obtained in the absolute value circuits 125 and 126 is level/field, and the unit of the moving quantity obtained in the minimum value circuit 127 is dots/field. The moving quantity can be described by "Moved Quantity (dots/field)"=[(|"Difference (Minimum Value) (level/field)"|]÷[|Slope (level/dots)|].

The dividing circuit 131 divides the moving quantity obtained from the minimum value detection circuit 127 by the edge quantity obtained from the multiplying circuit 93, and normalizes the degree of motion within the image, that is, normalizes the moving quantity. The normalized moving quantity obtained in the dividing circuit 131 is supplied to the multiplying circuit 142 of the level detection unit 646 via the isolated point elimination circuit 132, the temporal filter 133 and the two-dimensional lowpass filter 134.

The isolated point elimination circuit 132 is provided to eliminate the isolated image data such as noise. For example, if 1 pixel at a central portion within a predetermined range of the image is moving although the pixels in the peripheral portion of this predetermined range do not indicate motion, this 1 pixel at the central portion may be regarded as noise. Accordingly, in such a case, the isolated point elimination circuit 132 eliminates the isolated point. More particularly, the isolated point can be eliminated by comparing the moving quantity of the pixel of each line with a threshold value and regarding that the pixel indicates no motion when the moving quantity of the pixel is less than the threshold value.

The temporal filter 133 is provided to correct the falling edge of the level of the pixel data indicating motion, so that the falling edge becomes gradual on the time base. For example, when a specific pixel within the image is moving but stops suddenly, the pixel data related to this specific pixel is stationary, but the specific pixel does not immediately appear stationary to the human eye due to the after image effect and the like. Hence, the temporal filter 133 corrects the falling edge of the level of the pixel data indicating motion to become gradual on the time base, so as to reduce the unnaturalness of the image displayed on the PDP 8 depending on the characteristic of the human eyes. More particularly, the temporal filter 133 obtains a maximum value from the moving quantity received from the isolated point elimination circuit 132 and a value read from a memory which will be described later, multiplies a coefficient which is less than 1 to this maximum value and stores the multiplication result in the memory. The obtained maximum value is supplied to the two-dimensional lowpass filter 134 as the output of the temporal filter 133. In other words, the moving quantity stored in the memory gradually decreases, and the moving quantity output from the temporal filter gradually decreases even when the actual moving quantity becomes zero.

The two-dimensional lowpass filter 134 corrects the pixel data of 1 pixel based on the pixel data of the surrounding pixels, so as to average the pixel data within a certain range. Hence, it is possible to prevent 1 pixel from having a level extremely different from the levels of the surrounding pixels. In other words, the two-dimensional lowpass filter 134 corrects the moving quantity in the two-dimensional space. The two-dimensional lowpass filter 134 itself is known, and a detailed description thereof will be omitted in this specification.

The level detection unit 646 includes a detection circuit part which is made up of a sensitivity RAM 141, a multiplying circuit 142 and a comparator 143, with respect to each of the RGB processing systems. Hence, three such detection circuit parts are provided in this embodiment. For example, the output of the main path 61 of the R-processing system is supplied to the sensitivity RAM 141 within the detection circuit part of the R-processing system, and the multiplying circuit 142 multiplies a coefficient which is read from the sensitivity RAM 141 to the moving quantity received from the two-dimensional lowpass filter 134. The multiplied result from the multiplying circuit 142 is supplied to the comparator 143 and compared with a threshold value. The comparator 143 outputs the path selection/switching signal for switching the processing path of the R-processing system to the sub path 62 when the moving quantity from the multiplying circuit 142 is greater than the threshold value. The detection circuit parts of the G-processing system and the B-processing system similarly output the path selection/switching signals for instructing the switching of the processing paths of the G-processing system and the B-processing system based on the independent outputs from the main paths 61 of the G-processing system and the B-processing system.

Accordingly, in each of the RGB processing systems, the input image signal (RGB signals) is normally processed by the main path 61 having a relatively large number of gradation levels. On the other hand, in each of the RGB processing systems, the pixel data of the pixels which easily generate the pseudo contour are processed by the sub path 62 by automatically switching the processing path to the sub path 62. In principle, the signal-to-noise ratio of the image indicated by the pixel data which are processed by the sub path 62 is slightly deteriorated when compared to that of the image indicated by the pixel data which are processed by the main path 61. However, the image indicated by the pixel data which are processed by the sub path 62 correspond to a moving image portion, and no problems are introduced from the practical point of view because such a slight deterioration in the signal-to-noise ratio of the moving image is virtually undetectable by the human eyes. In this case, the operation parameters of the various parts of the main path 61 and the sub path 62 are set so that the deterioration of the signal-to-noise ratio caused by the processing of the pixel data in the sub path 62 is inconspicuous to the human eyes. In addition, the operation parameters of the various parts of the main path 61 and the sub path 62 must of course be appropriately reset to optimum parameters every time the driving sequence of the PDP 8 is changed, the sub field structure of the PDP 8 is changed or the like.

Figure 73:
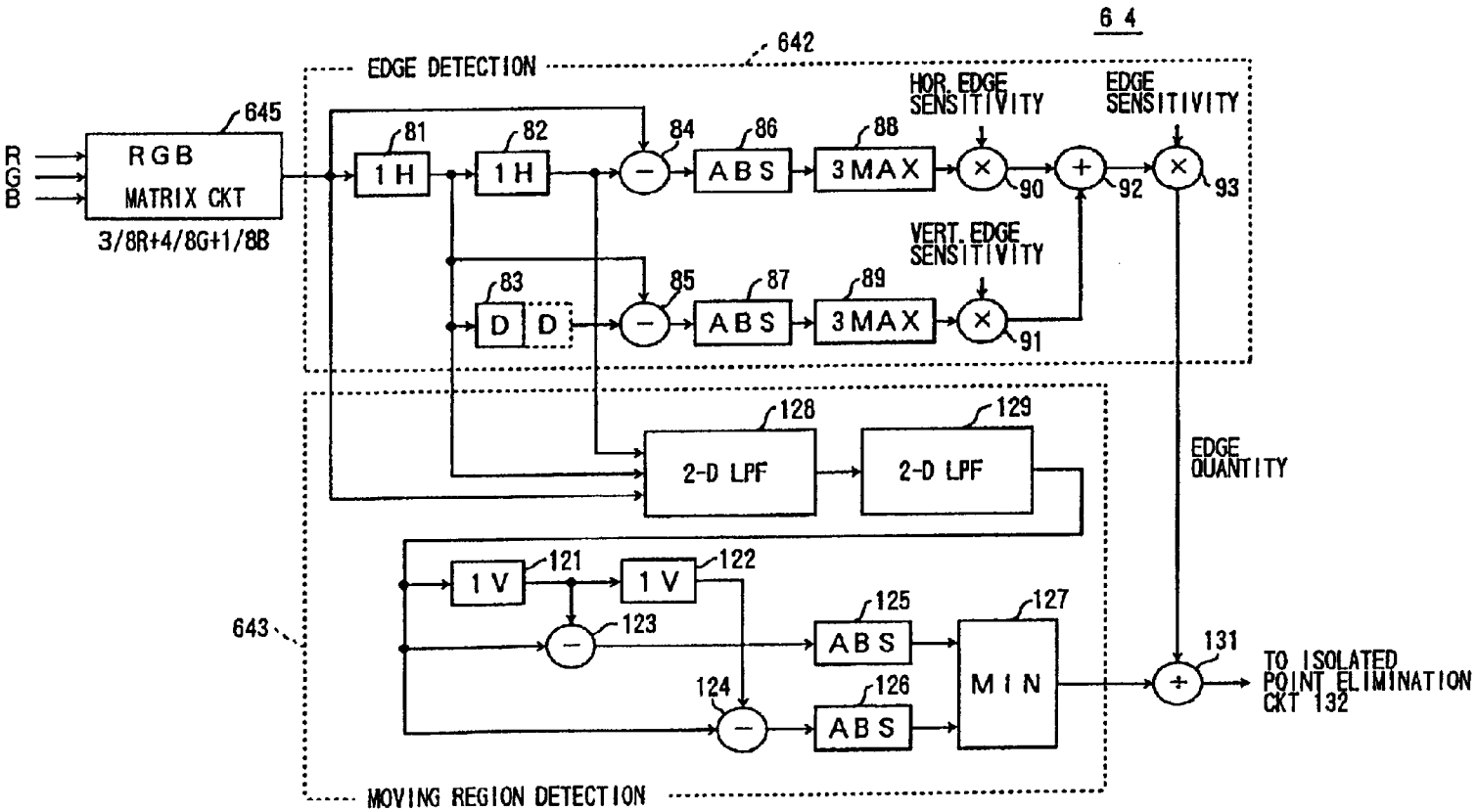
FIG. 73 is a system block diagram showing another embodiment of the image feature judging unit.

FIG. 73 is a system block diagram showing another embodiment of the image feature judging unit 64. In FIG. 73, those parts which are the same as those corresponding parts in FIG. 72 are designated by the same reference numerals, and a description thereof will be omitted. The circuit parts at the circuit stages following the isolated point elimination circuit 132 are the same as those of FIG. 72, and the illustration thereof will be omitted in FIG. 73.

In FIG. 73, two-dimensional lowpass filters 128 and 129 are connected in series at the input stage which receives the output of the edge detection circuit 642. These two-dimensional lowpass filters 128 and 129 respectively carry out a thinning process with respect to the luminance signal, so that the amount of pixel information is thinned to ½ in the horizontal direction and also thinned to ½ in the vertical direction. As a result, the amount of data of the luminance signal that is used to detect motion is thinned to ¼ the original amount, thereby making it possible to reduce the required memory capacity to ¼ when storing the pixel data in the memory within the temporal filter 133 which is provided at the following stage.

Next, a description will be given of a sixth embodiment of the display driving apparatus according to the present invention. The construction of this sixth embodiment of the display driving apparatus is the same as that shown in FIG. 69, and a description thereof will be omitted. This embodiment of the display driving apparatus employs a sixth embodiment of the display driving method according to the present invention.

Figure 74:
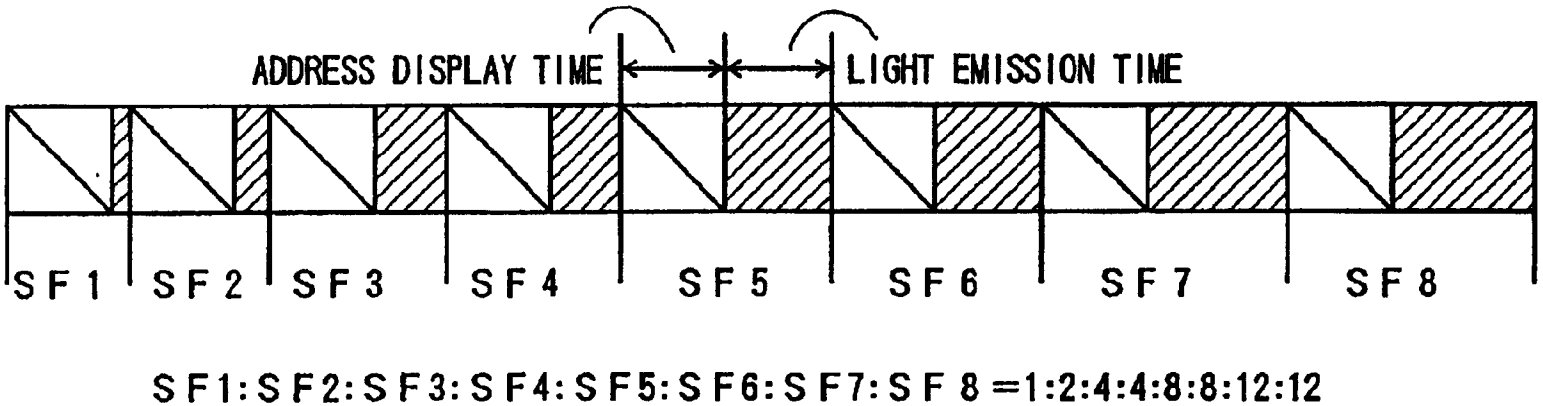
FIG. 74 is a diagram showing a PDP driving sequence in a sixth embodiment of the display driving apparatus according to the present invention.
Figure 75:
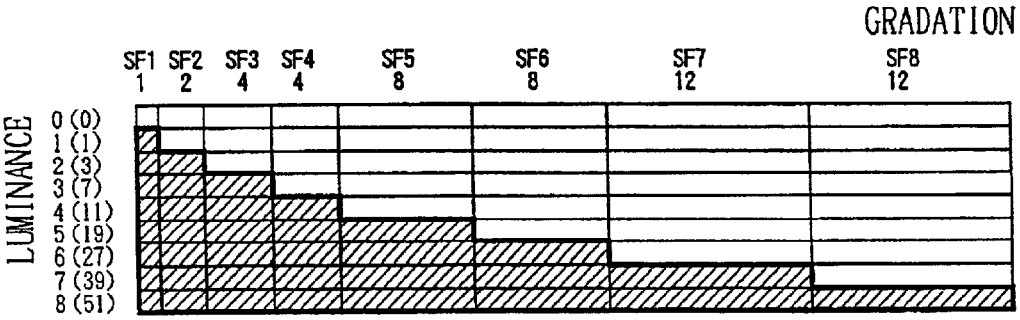
FIG. 75 is a diagram showing an arragement of the sub fields having the light emission state in the sub path of the sixth embodiment.
Figure 76:
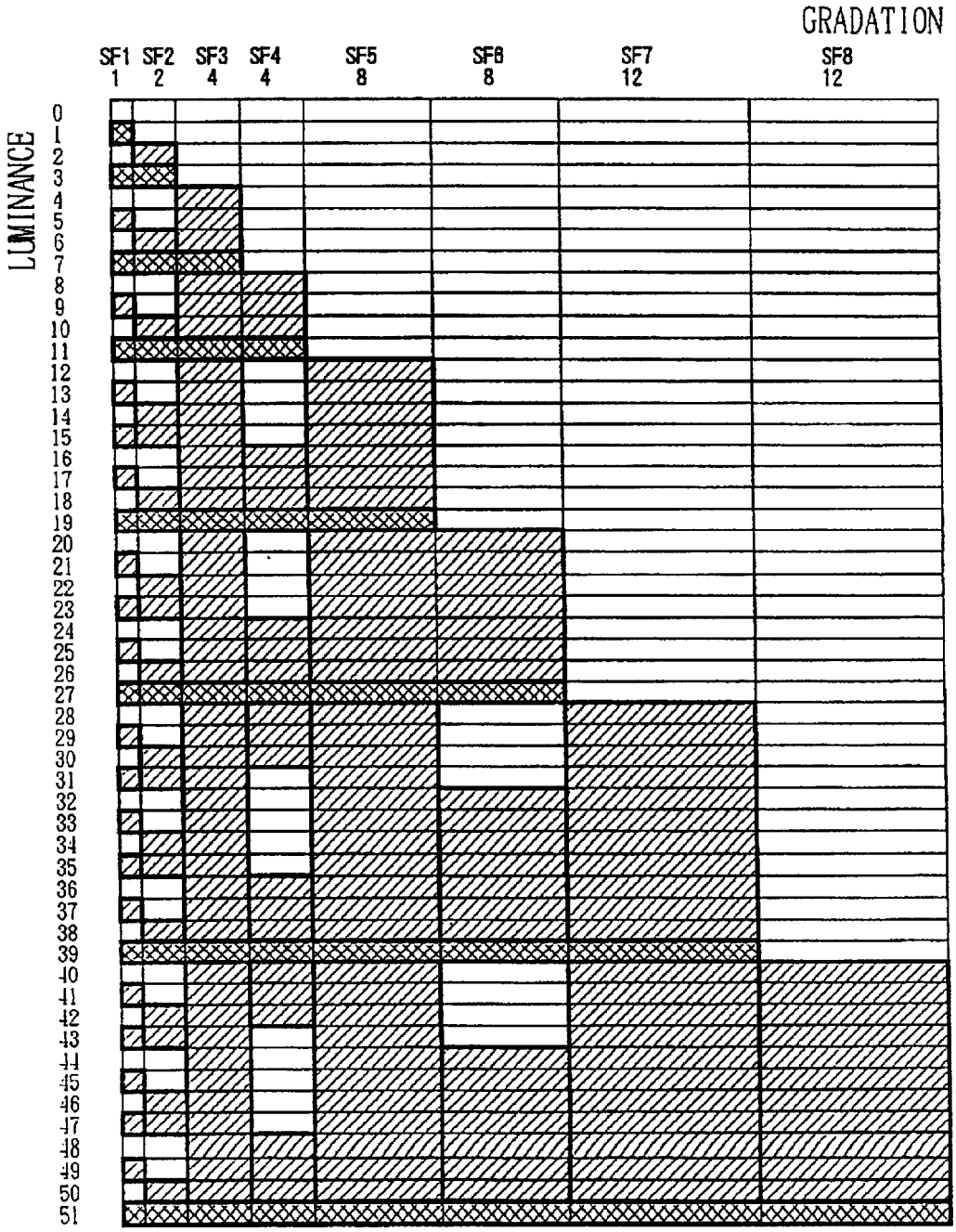
FIG. 76 is a diagram showing an arragement of the sub fields having the light emission state in the main path of the sixth embodiment.

In this embodiment, 1 field is made up of 8 sub fields SF1 through SF8, and the ratios of the number of sustain pulses in each of the sub fields are set to SF1:SF2:SF3:SF4:SF5:SF6:SF7:SF8=1:2:4:4:8:8:12:12. Accordingly, the driving sequence of the PDP 8 becomes as shown in FIG. 74. In this case, the arrangement of the sub fields having the light emission state in the sub path 62 becomes as shown in FIG. 75, and the arrangement of the sub fields having the light emission state in the main path 61 becomes as shown in FIG. 76. As may be seen from FIGS. 75 and 76, the sub fields having the light emission state are concentrated as much as possible at the beginning portion of the field. In FIG. 76, a cross-hatched portion indicates a luminance level which has the equivalent luminance quantity when each luminance level of the sub path 62 is arranged in the main path 61.

In this embodiment, the number of actual display gradation levels of the main path 61 is 52, and the number of actual display gradation levels of the sub path 62 is 9. Hence, the display characteristic of this embodiment is the same as that of the fifth embodiment described above and shown in FIG. 64.

Next, a description will be given of a seventh embodiment of the display driving apparatus according to the present invention. The construction of this seventh embodiment of the display driving apparatus is the same as that shown in FIG. 69, and a description thereof will be omitted. This embodiment of the display driving apparatus employs a seventh embodiment of the display driving method according to the present invention.

Figure 77:
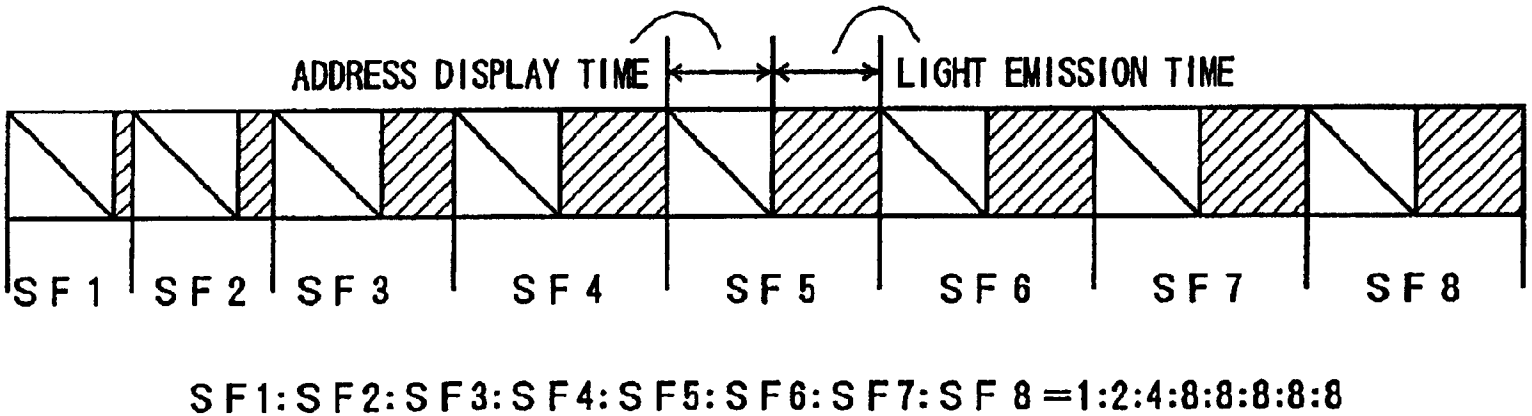
FIG. 77 is a diagram showing a PDP driving sequence in a seventh embodiment of the display driving apparatus according to the present invention.
Figure 78:
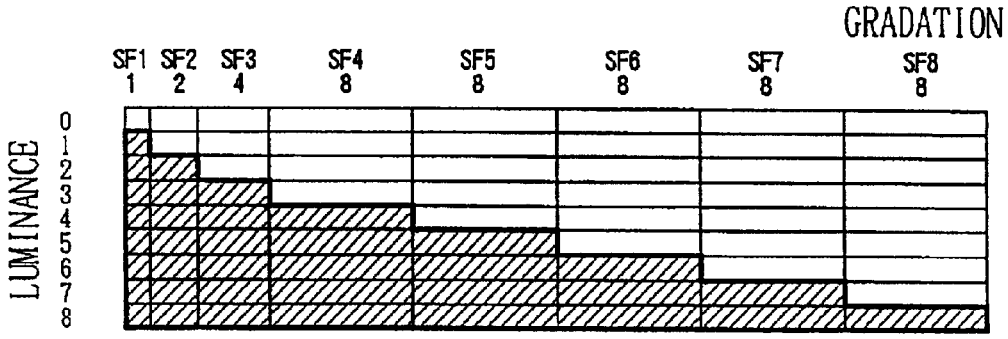
FIG. 78 is a diagram showing an arragement of the sub fields having the light emission state in the sub path of the seventh embodiment.
Figure 79:
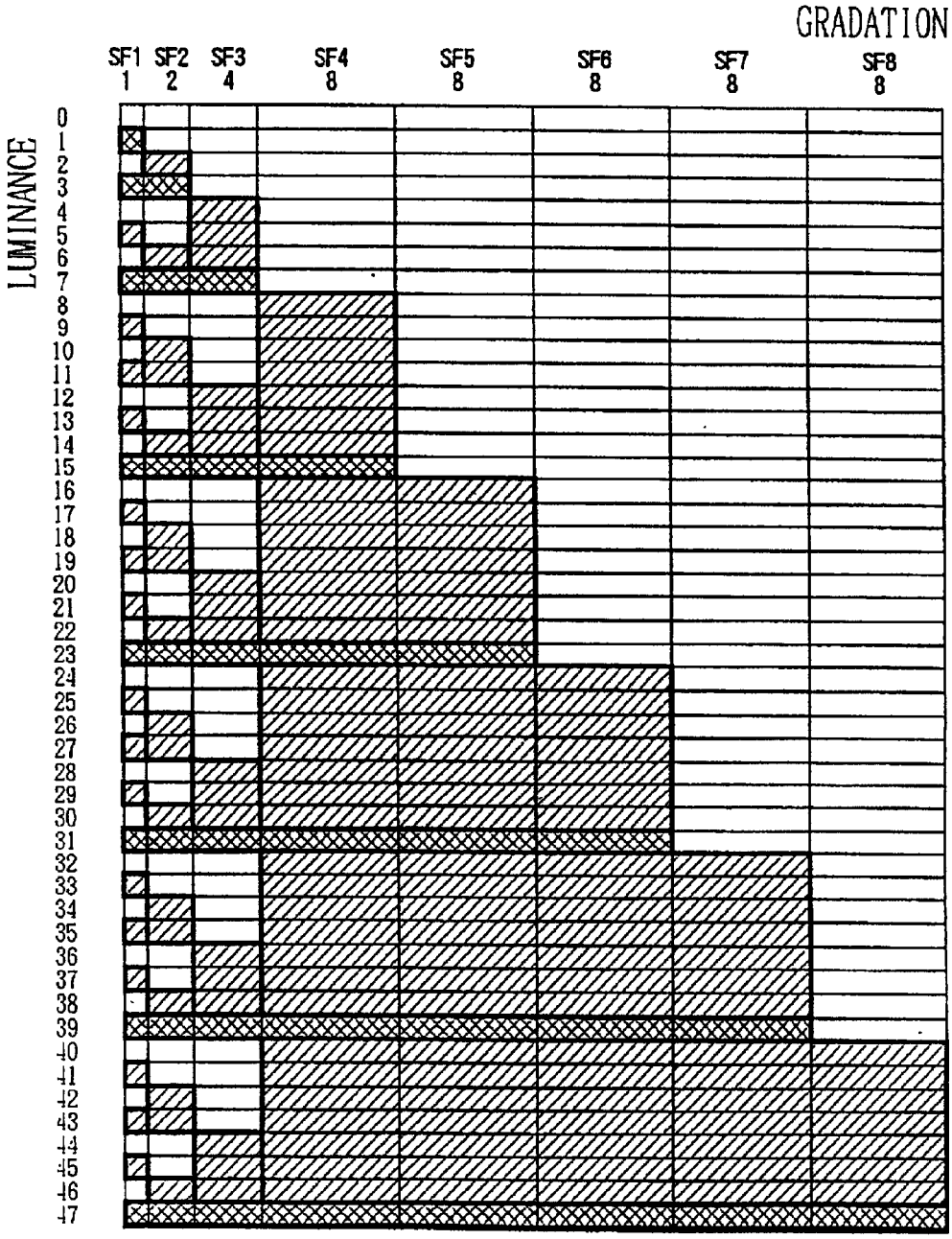
FIG. 79 is a diagram showing an arragement of the sub fields having the light emission state in the main path of the seventh embodiment.

In this embodiment, 1 field is made up of 8 sub fields SF1 through SF8, and the ratios of the number of sustain pulses in each of the sub fields are set to SF1:SF2:SF3:SF4:SF5:SF6:SF7:SF8=1:2:4:8:8:8:8:8. Accordingly, the driving sequence of the PDP 8 becomes as shown in FIG. 77. In this case, the arrangement of the sub fields having the light emission state in the sub path 62 becomes as shown in FIG. 78, and the arrangement of the sub fields having the light emission state in the main path 61 becomes as shown in FIG. 79. As may be seen from FIGS. 78 and 79, the sub fields having the light emission state are concentrated as much as possible at the beginning portion of the field. In FIG. 79, a cross-hatched portion indicates a luminance level which has the equivalent luminance quantity when each luminance level of the sub path 62 is arranged in the main path 61.

In this embodiment, the number of actual display gradation levels of the main path 61 is 48 from the level 0 to the level 47, and the number of actual display gradation levels of the sub path 62 is 9 from the level 0 to the level 8.

Next, a description will be given of an eighth embodiment of the display driving apparatus according to the present invention. The construction of this eighth embodiment of the display driving apparatus is the same as that shown in FIG. 69, and a description thereof will be omitted. This embodiment of the display driving apparatus employs an eighth embodiment of the display driving method according to the present invention.

In this embodiment, 1 field is made up of 8 sub fields SF1 through SF8, and the ratios of the number of sustain pulses in each of the sub fields are set to SF1:SF2:SF3:SF4:SF5:SF6:SF7:SF8= 1:2:4:8:16:32:64:128. In other words, the luminance ratios of the 8 sub fields SF1 through SF8 are set to satisfy $2^j$, where j is 1 less than the sub field number, that is, j=0, 1, . . . , 7. In this embodiment, the number of actual display gradation levels of the main path 61 is 256, and the number of actual display gradation levels of the sub path 62 is 9.

Figure 80:
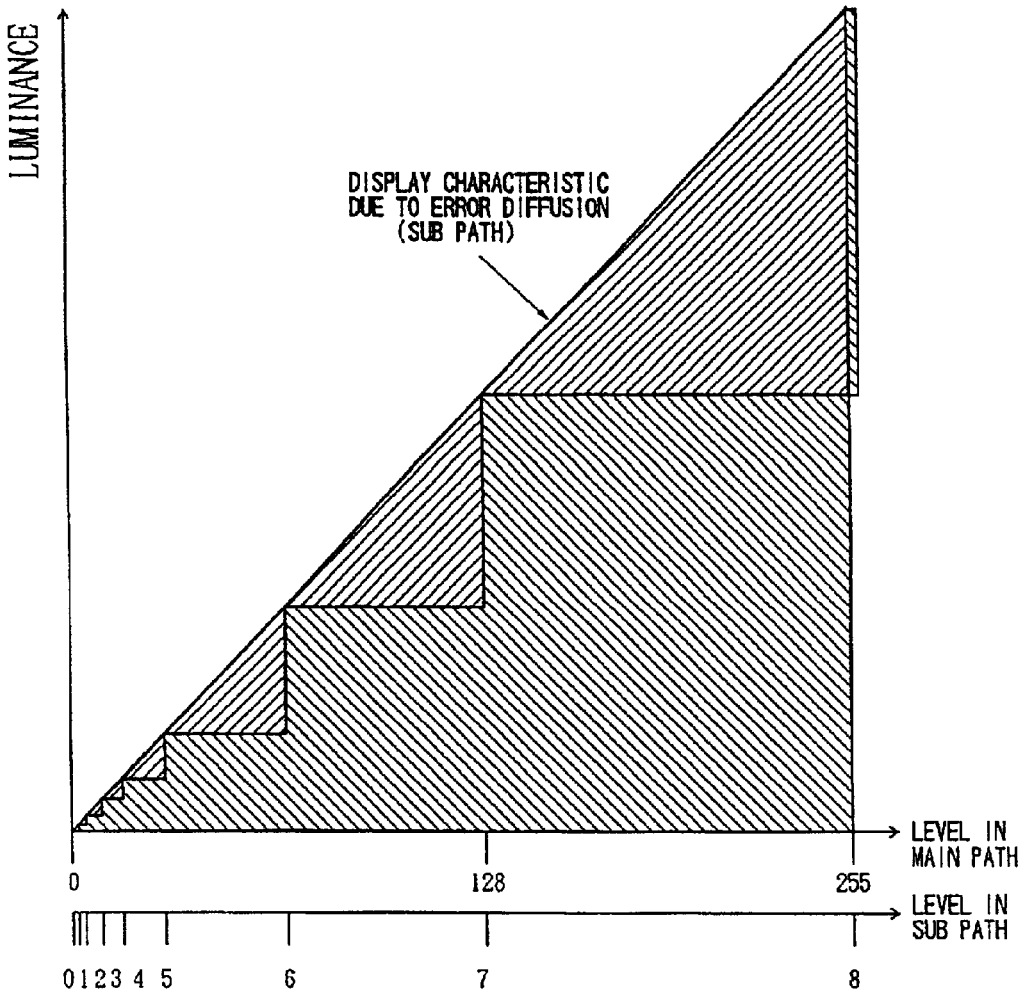
FIG. 80 is a diagram showing display characteristics of the main and sub paths in an eighth embodiment of the display driving apparatus according to the present invention.

FIG. 80 shows the display characteristics of the main path 61 and the sub path 62 for this case. In FIG. 80, the display characteristic of the main path 61 is indicated by the leftwardly declining hatching, and the display characteristic of the sub path 62 is indicated by the rightwardly declining hatching. As may be seen from FIG. 80, a linear display characteristic is obtained in both the main path 61 and the sub path 62.

In addition, FIG. 81 shows the arrangement of the sub fields having the light emission state with respect to each luminance level in the sub path 62, and the main path luminance level of the sub path 62 that is approximately equivalent to the luminance quantity in the main path 61. In FIG. 81, a black circular mark indicates a sub field having the light emission state.

Therefore, according to the fifth through eighth embodiments, it is possible to realize a display driving method and apparatus which make a luminance representation depending on a length of a light emission time, wherein a first image signal having a gradation levels is generated in a main path from an input image signal having n gradation levels while satisfying $a \leqq n$, a second image signal having b gradation levels is generated in a sub path from the input image signal independently of the first image signal while satisfying $b<a \leqq n$, and the first image signal and the second image signal are switched and output in units of pixels, where n, a and b are integers.

Similarly, according to the fifth through eighth embodiments, it is possible to realize a display driving method and apparatus which make a luminance representation depending on a length of a light emission time, wherein a first image signal having a gradation levels is generated in a main path by carrying out an error diffusion process with respect to an input image signal having n gradation levels while satisfying $a<n$, a second image signal having b gradation levels is generated in a sub path by carrying out an error diffusion process with respect to the input image signal while satisfying $b<a<n$, and the first image signal and the second image signal are switched and output in units of pixels, where n, a and b are integers.

The correction process that is carried out with respect to the image signal using an inverse function of a non-linear display characteristic of the PDP in order to correct the non-linear display characteristic into a linear display characteristic, may also be carried out in the main path in addition to being carried out in the sub path.

In each of the embodiments and modifications described above, the present invention is applied to the A.C. type PDP. However, the present invention is of course applicable to any display or display panel which makes the luminance representation depending on the length of the light emission time, that is, depending on a combination of sub fields having the light emission state by dividing a unit field into a plurality of sub fields. Hence, the present invention is similarly applicable to displays such as the D.C. type PDP and the digital micromirror device (DMD). The effect of preventing generation of the pseudo contour can also be obtained by applying the present invention to such displays.

Of course, the present invention also includes a display unit having any of the embodiments and modifications described above.

Further, the present invention is not limited to these embodiments, but various variations and modifications may be made without departing from the scope of the present invention.

What is claimed is:

1. A display driving method which drives a display to make a gradation display on a screen of the display depending on a length of a light emission time in each of N sub fields SF1 through SFN forming a field, where a field is a time interval in which an image is displayed and each sub field includes an address display, in which a wall charge is formed with respect to all pixels which are to emit light within the sub field, and a sustain time interval which is equal to the light emission time and determines a luminance level, said display driving method comprising the steps of:

setting the respective sustain time intervals of the sub fields within a field to be approximately constant; and displaying image data on the display using N+1 gradation levels, from a luminance level 0 to a luminance level N.

2. The display driving method as claimed in claim 1, wherein N is an even number, and a light emission state of each of the sub fields is set to satisfy one of (a) and (b), where (a) no sub field assumes the light emission state for the luminance level 0, the sub field SF(N/2) assumes the light emission state for the luminance level 1, the sub field SF(N/2+1) assumes the light emission state for the luminance level 2 in addition to that which assumes the light emission state for the luminance level 1, the sub field SF(N/2−1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF(N/2+1) assumes the light emission state for the luminance level 1, the sub field SF(N/2) assumes the light emission state for the luminance level 2 in addition to that which assumes the light emission state for the luminance level 1, the sub field SF(N/2+2) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

3. The display driving method as claimed in claim 1, wherein N is an odd number, and a light emission state of each of the sub fields is set to satisfy one of (a) and (b), where (a) no sub field assumes the light emission state for the luminance level 0, the sub field SF((N+1)/2) assumes the light emission state for the luminance level 1, the sub field SF((N+1)/2+1) assumes the light emission state for the luminance level 2 in addition to that which assumes the light emission state for the luminance level 1, the sub field SF((N+1)/2−1) assumes the light emission state for the luminance level, 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF((N+1)/2) assumes the light emission state for the luminance level 1, the sub field SF((N+1)/2−1) assumes the light emission state for the luminance level 2 in addition to that which assumes the light emission state for the luminance level 1, the sub field SF((N+1)/2+1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state or the luminance level N.

4. The display driving method as claimed in claim 1, wherein a light emission state of each of the sub fields is set to satisfy one of (a) and (b), where (a) no sub field assumes the light emission state for the luminance level 0, the sub field SF1 assumes the light emission state for the luminance level 1, the sub field SF2 assumes the light emission state for the luminance level 2 in addition to that which assumes the light emission state for the luminance level 1, the sub field SF3 assumes the light emission state for the luminance level 3 in addition to those which assume the light emission state for the luminance level 2, . . . , the sub field SF(N−1) assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SFN assumes the light emission state for the luminance level 1, the sub field SF(N−1) assumes the light emission state for the luminance level 2 in addition to that which assumes the light emission state for the luminance level 1, the sub field SF(N−2) assumes the light emission state for the luminance level 3 in addition to those which assume the light emission state for the luminance level 2, . . . , the sub field SF2 assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

5. The display driving method as claimed in claim 1, wherein all of the pixels displayed on the screen are divided into two groups A and B so as to have a checker-board arrangement;

a light emission state of each of the sub fields is set to satisfy (a) with respect to the pixels of the group A and to satisfy (b) with respect to the pixels of the group B; where (a) no sub field assumes the light emission state for the luminance level 0, the sub field SF(N/2) assumes the light emission state for the luminance level 1, the sub field SF(N/2+1) assumes the light emission state for the luminance level 2 in addition to that which assumes the light emission state for the luminance level 1, the sub field SF(N/2−1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF(N/2+1) assumes the light emission state for the luminance level 1, the sub-field SF(N/2) assumes the light emission state for the luminance level 2 in addition to that which assumes the light emission state for the luminance level 1, the sub field SF(N/2+2) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

6. The display driving method as claimed in claim 1, wherein all of the pixels displayed on the screen are divided into two groups A and B so as to have a checker-board arrangement;

a light emission state of each of the sub fields is set to satisfy (a) with respect to the pixels of the group A and to satisfy (b) with respect to the pixels of the group B; where (a) no sub field assumes the light emission state for the luminance level 0, the sub field SF((N+1)/2) assumes the light emission state for the luminance level 1, the sub field SF((N+1)/2+1) assumes the light emission state for the luminance level 2 in addition to that which assumes the light emission state for the luminance level 1, the sub field SF((N+1)/2−1) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF((N+1)/2) assumes the light emission state for the luminance level 1, the sub field SF((N+1)/2−1) assumes the light emission state for the luminance level 2 in addition to that which assumes the light emission state for the luminance level 1, the sub field SF((N+1)/2+1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N.

7. The display driving method as claimed in claim 1, wherein all of the pixels displayed on the screen are divided into two groups A and B so as to have a checker-board arrangement;

a light emission state of each of the sub fields is set to satisfy (a) with respect to the pixels of the group A and to satisfy (b) with respect to the pixels of the group B; where (a) no sub field assumes the light emission state for the luminance level 0, the sub field SF1 assumes the light emission state for the luminance level 1, the sub field SF2 assumes the light emission state for the luminance level 2 in addition to that which assumes the light emission state for the luminance level 1, the sub field SF3 assumes the light emission state for the luminance level 3 in addition to those which assume the light emission state for the luminance level 2, . . . , the sub field SF(N−1) assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SFN assumes the light emission state for the luminance level 1, the sub field SF(N−1) assumes the light emission state for the luminance level 2 in addition to that which assumes the light emission state for the luminance level 1, the sub field SF(N−2) assumes the light emission state for the luminance level 3 in addition to those which assume the light emission state for the luminance level 2, . . . , the sub field SF2 assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

8. A display driving apparatus which drives a display to make a gradation display on a screen of the display depending on a length of a light emission time in each of N sub fields SF1 through SFN forming a field, where a field is a time interval in which an image is displayed and each sub field includes an address display-time interval, in which a wall charge is formed with respect to all pixels which are to emit light within the sub field, and a sustain time interval which is equal to the light emission time and determines a luminance level, said display driving apparatus comprising:

means for setting the respective sustain time intervals of the sub fields within a field to be approximately constant; and means for displaying image data on the display using N+1 gradation levels, from a luminance level 0 to a luminance level N.

9. The display driving apparatus as claimed in claim 8, wherein N is an even number, and which further comprises means for setting a light emission state of each of the sub fields to satisfy one of (a) and (b), where (a) no sub field assumes the light emission state for the luminance level 0, the sub field SF(N/2) assumes the light emission state for the luminance level 1, the sub field SF(N/2+1) assumes the light emission state for the luminance level 2 in addition to that which assumes the light emission state for the luminance level 1, the sub field SF(N/2−1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF(N/2+1) assumes the light emission state for the luminance level 1, the sub field SF(N/2) assumes the light emission state for the luminance level 2 in addition to that which assumes the light emission state for the luminance level 1, the sub field SF(N/2+2) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

10. The display driving apparatus as claimed in claim 8, wherein N is an odd number, and which further comprises means for setting a light emission state of each of the sub fields to satisfy one of (a) and (b), where (a) no sub field assumes the light emission state for the luminance level 0, the sub field SF((N+1)/2) assumes the light emission state for the luminance level 1, the sub field SF((N+1)/2+1) assumes the light emission state for the luminance level 2 in addition to that which assumes the light emission state for the luminance level 1, the sub field SF((N+1)/2−1) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF((N+1)/2) assumes the light emission state for the luminance level 1, the sub field SF((N+1)/2−1) assumes the light emission state for the luminance level 2 in addition to that which assumes the light emission state for the luminance level 1, the sub field SF((N+1)/2+1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N.

11. The display driving apparatus as claimed in claim 8, which further comprises means for setting a light emission state of each of the sub fields to satisfy one of (a) and (b), where (a) no sub field assumes the light emission state for the luminance level 0, the sub field SF1 assumes the light emission state for the luminance level 1, the sub field SF2 assumes the light emission state for the luminance level 2 in addition to that which assumes the light emission state for the luminance level 1, the sub field SF3 assumes the light emission state for the luminance level 3 in addition to those which assume the light emission state for the luminance level 2, . . . , the sub field SF(N−1) assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SFN assumes the light emission state for the luminance level 1, the sub field SF(N−1) assumes the light emission state for the luminance level 2 in addition to that which assumes the light emission state for the luminance level 1, the sub field SF(N−2) assumes the light emission state for the luminance level 3 in addition to those which assume the light emission state for the luminance level 2, . . . , the sub field SF2 assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

12. The display driving apparatus as claimed in claim 8, wherein all of the pixels displayed on the screen are divided into two groups A and B so as to have a checker-board arrangement, and which further comprises means for setting a light emission state of each of the sub fields to satisfy (a) with respect to the pixels of the group A and to satisfy (b) with respect to the pixels of the group B; where (a) no sub field assumes the light emission state for the luminance level 0, the sub field SF(N/2) assumes the light emission state for the luminance level 1, the sub field SF(N/2+1) assumes the light emission state for the luminance level 2 in addition to that which assumes the light emission state for the luminance level 1, the sub field SF(N/2−1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF(N/2+1) assumes the light emission state for the luminance level 1, the sub field SF(N/2) assumes the light emission state for the luminance level 2 in addition to that which assumes the light emission state for the luminance level 1, the sub field SF(N/2+2) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

13. The display driving apparatus as claimed in claim 8, wherein all of the pixels displayed on the screen are divided into two groups A and B so as to have a checker-board arrangement, and which further comprises means for setting a light emission state of each of the sub fields to satisfy (a) with respect to the pixels of the group A and to satisfy (b) with respect to the pixels of the group B; where (a) no sub field assumes the light emission state for the luminance level 0, the sub field SF((N+1)/2) assumes the light emission state for the luminance level 1, the sub field SF((N+1)/2+1) assumes the light emission state for the luminance level 2 in addition to that which assumes the light emission state for the luminance level 1, the sub field SF((N+1)/2−1) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF((N+1)/2) assumes the light emission state for the luminance level 1, the sub field SF((N+1)/2−1) assumes the light emission state for the luminance level 2 in addition to that which assumes the light emission state for the luminance level 1, the sub field SF((N+1)/2+1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N.

14. The display driving apparatus as claimed in claim 8, wherein all of the pixels displayed on the screen are divided into two groups A and B so as to have a checker-board arrangement, and which further comprises means for setting a light emission state of each of the sub fields to satisfy (a) with respect to the pixels of the group A and to satisfy (b) with respect to the pixels of the group B; where (a) no sub field assumes the light emission state for the luminance level 0, the sub field SF1 assumes the light emission state for the luminance level 1, the sub field SF2 assumes the light emission state for the luminance level 2 in addition to that which assumes the light emission state for the luminance level 1, the sub field SF3 assumes the light emission state for the luminance level 3 in addition to those which assume the light emission state for the luminance level 2, . . . , the sub field SF(N−1) assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SFN assumes the light emission state for the luminance level 1, the sub field SF(N−1) assumes the light emission state for the luminance level 2 in addition to that which assumes the light emission state for the luminance level 1, the sub field SF(N−2) assumes the light emission state for the luminance level 3 in addition to those which assume the light emission state for the luminance level 2, . . . , the sub field SF2 assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

15. The display driving apparatus as claimed in claim 8, which further comprises:

means for carrying out at least one of an error diffusion process and a gradation distortion correction process with respect to the image data as a preparation process.

16. A display driving apparatus which drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level, said display driving apparatus comprising:

means for dividing 1 field into a first sub field group and a second sub field group and alternately arranging a sub field belonging to the first sub field group and a sub field belonging to the second sub field group within 1 field, and setting the sustain times of each of the sub fields belonging to the first sub field group approximately constant within 1 field, and setting the sustain times of each of the sub fields belonging to the second sub field group approximately constant within 1 field; and means for displaying image data on the display using $[(N-1)/2+1]^2+[(N-1)/2]+1$ gradation levels from a level 0 to a level $[(N-1)/2+1]^2+[(N-1)/2]$ by setting the ratios of luminance levels of the N sub fields SF1 through SFN to satisfy a relation SF1:SF2:SF3: . . . :SF(N−2):SF(N−1):SFN=(N−1)/2+1:1:(N−1)/2+1: . . . :(N−1)/2+1:1:(N−1)/2+1.

17. The display driving apparatus as claimed in claim 16, wherein N is an even number, and which further comprises means for setting a light emission state of each of the sub fields to satisfy one of (a) and (b), where (a) no sub field assumes the light emission state for the luminance level 0, the sub field SF(N/2) assumes the light emission state for the luminance level 1, the sub field SF(N/2+1) assumes the light emission state for the luminance level 2 in addition to that which assumes the light emission state for the luminance level 1, the sub field SF(N/2−1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF(N/2+1) assumes the light emission state for the luminance level 1, the sub field SF(N/2) assumes the light emission state for the luminance level 2 in addition to that which assumes the light emission state for the luminance level 1, the sub field SF(N/2+2) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

18. The display driving apparatus as claimed in claim 16, wherein N is an odd number, and which further comprises means for setting a light emission state of each of the sub fields to satisfy one of (a) and (b), where (a) no sub field assumes the light emission state for the luminance level 0, the sub field SF((N+1)/2) assumes the light emission state for the luminance level 1, the sub field SF((N+1)/2+1) assumes the light emission state for the luminance level 2 in addition to that which assumes the light emission state for the luminance level 1, the sub field SF((N+1)/2−1) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF((N+1)/2) assumes the light emission state for the luminance level 1, the sub field SF((N+1)/2−1) assumes the light emission state for the luminance level 2 in addition to that which assumes the light emission state for the luminance level 1, the sub field SF((N+1)/2+1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N.

19. The display driving apparatus as claimed in claim 16, which further comprises means for setting a light emission state of each of the sub fields to satisfy one of (a) and (b), where (a) no sub field assumes the light emission state for the luminance level 0, the sub field SF1 assumes the light emission state for the luminance level 1, the sub field SF2 assumes the light emission state for the luminance level 2 in addition to that which assumes the light emission state for the luminance level 1, the sub field SF3 assumes the light emission state for the luminance level 3 in addition to those which assume the light emission state for the luminance level 2, . . . , the sub field SF(N−1) assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SFN assumes the light emission state for the luminance level 1, the sub field SF(N−1) assumes the light emission state for the luminance level 2 in addition to that which assumes the light emission state for the luminance level 1, the sub field SF(N−2) assumes the light emission state for the luminance level 3 in addition to those which assume the light emission state for the luminance level 2, . . . , the sub field SF2 assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

20. The display driving apparatus as claimed in claim 16, wherein all of the pixels displayed on the screen are divided into two groups A and B so as to have a checker-board arrangement, and which further comprises means for setting a light emission state of each of the sub fields to satisfy (a) with respect to the pixels of the group A and to satisfy (b) with respect to the pixels of the group B; where (a) no sub field assumes the light emission state for the luminance level 0, the sub field SF(N/2) assumes the light emission state for the luminance level 1, the sub field SF(N/2+1) assumes the light emission state for the luminance level 2 in addition to that which assumes the light emission state for the luminance level 1, the sub field SF(N/2−1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF(N/2+1) assumes the light emission state for the luminance level 1, the sub field SF(N/2) assumes the light emission state for the luminance level 2 in addition to that which assumes the light emission state for the luminance level 1, the sub field SF(N/2+2) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

21. The display driving apparatus as claimed in claim 16, wherein all of the pixels displayed on the screen are divided into two groups A and B so as to have a checker-board arrangement, and which further comprises means for setting a light emission state of each of the sub fields to satisfy (a) with respect to the pixels of the group A and to satisfy (b) with respect to the pixels of the group B; where (a) no sub field assumes the light emission state for the luminance level 0, the sub field SF((N+1)/2) assumes the light emission state for the luminance level 1, the sub field SF((N+1)/2+1) assumes the light emission state for the luminance level 2 in addition to that which assumes the light emission state for the luminance level 1, the sub field SF((N+1)/2−1) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF((N+1)/2) assumes the light emission state for the luminance level 1, the sub field SF((N+1)/2−1) assumes the light emission state for the luminance level 2 in addition to that which assumes the light emission state for the luminance level 1, the sub field SF((N+1)/2+1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N.

22. The display driving apparatus as claimed in claim 16, wherein all of the pixels displayed on the screen are divided into two groups A and B so as to have a checker-board arrangement, and which further comprises means for setting a light emission state of each of the sub fields to satisfy (a) with respect to the pixels of the group A and to satisfy (b) with respect to the pixels of the group B; where (a) no sub field assumes the light emission state for the luminance level 0, the sub field SF1 assumes the light emission state for the luminance level 1, the sub field SF2 assumes the light emission state for the luminance level 2 in addition to that which assumes the light emission state for the luminance level 1, the sub field SF3 assumes the light emission state for the luminance level 3 in addition to those which assume the light emission state for the luminance level 2, . . . , the sub field SF(N−1) assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SFN assumes the light emission state for the luminance level 1, the sub field SF(N−1) assumes the light emission state for the luminance level 2 in addition to that which assumes the light emission state for the luminance level 1, the sub field SF(N−2) assumes the light emission state for the luminance level 3 in addition to those which assume the light emission state for the luminance level 2, . . . , the sub field SF2 assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

23. The display driving apparatus as claimed in claim 16, which further comprises:

means for carrying out at least one of an error diffusion process and a gradation distortion correction process with respect to the image data as a preparation process.

24. A display driving method which drives a display to make a gradation display on a screen of the display depending on a length of a light emission time in each of sub fields forming 1 field, where 1 field is a time in which an image is displayed, N sub fields SF1 through SFN form 1 field, and each sub field includes an address display-time in which a wall charge is formed with respect to all pixels which are to emit light within the sub field and a sustain time which is equal to the light emission time and determines a luminance level, said display driving method comprising the steps of:

dividing 1 field into a first sub field group and a second sub field group and alternately arranging a sub field belonging to the first sub field group and a sub field belonging to the second sub field group within 1 field;

setting the sustain times of each of the sub fields belonging to the first sub field group approximately constant within 1 field, and setting the sustain times of each of the sub fields belonging to the second sub field group approximately constant within 1 field; and displaying image data on the display using [(N1)/2+1]2+[(N−1)/2]+1 gradation levels from a level 0 to a level [(N−1)/2+1]2+[(N−1)/2] by setting the ratios of luminance levels of the N sub fields SF1 through SFN to satisfy a relation SF1:SF2:SF3: . . . :SF(N−2):SF(N−1):SFN=(N−1)/2+1:1:(N−1)/2+1: . . . :(N1)/2+1:1:(N−1)/2+1.

25. The display driving method as claimed in claim 24 wherein N is an even number, and a light emission state of each of the sub fields is set to satisfy one of (a) and (b), where (a) no sub field assumes the light emission state for the luminance level 0, the sub field SF(N/2) assumes the light emission state for the luminance level 1, the sub field SF(N/2+1) assumes the light emission state for the luminance level 2 in addition to that which assumes the light emission state for the luminance level 1, the sub field SF(N/2−1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF(N/2+1) assumes the light emission state for the luminance level 1, the sub field SF(N/2) assumes the light emission state for the luminance level 2 in addition to that which assumes the light emission state for the luminance level 1, the sub field SF(N/2+2) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

26. The display driving method as claimed in claim 24, wherein N is an odd number, and a light emission state of each of the sub fields is set to satisfy one of (a) and (b), where (a) no sub field assumes the light emission state for the luminance level 0, the sub field SF((N+1)/2) assumes the light emission state for the luminance level 1, the sub field SF((N+1)/2+1) assumes the light emission state for the luminance level 2 in addition to that which assumes the light emission state for the luminance level 1, the sub field SF((N+1)/2−1) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF((N+1)/2) assumes the light emission state for the luminance level 1, the sub field SF((N+1)/2−1) assumes the light emission state for the luminance level 2 in addition to that which assumes the light emission state for the luminance level 1, the sub field SF((N+1)/2+1) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N.

27. The display driving method as claimed in claim 24, wherein a light emission state of each of the sub fields is set to satisfy one of (a) and (b), where (a) no sub field assumes the light emission state for the luminance level 0, the sub field SF1 assumes the light emission state for the luminance level 1, the sub field SF2 assumes the light emission state for the luminance level 2 in addition to that which assumes the light emission state for the luminance level 1, the sub field SF3 assumes the light emission state for the luminance level 3 in addition to those which assume the light emission state for the luminance level 2, . . . , the sub field SF(N−1) assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SFN assumes the light emission state for the luminance level 1, the sub field SF(N−1) assumes the light emission state for the luminance level 2 in addition to that which assumes the light emission state for the luminance level 1, the sub field SF(N−2) assumes the light emission state for the luminance level 3 in addition to those which assume the light emission state for the luminance level 2, . . . , the sub field SF2 assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

28. The display driving method as claimed in claim 24, wherein all of the pixels displayed on the screen are divided into two groups A and B so as to have a checker-board arrangement;

a light emission state of each of the sub fields is set to satisfy (a) with respect to the pixels of the group A and to satisfy (b) with respect to the pixels of the group B; where (a) no sub field assumes the light emission state for the luminance level 0, the sub field SF(N/2) assumes the light emission state for the luminance level 1, the sub field SF (N/2+1) assumes the light emission state for the luminance level 2 in addition to that which assumes the light emission state for the luminance level 1, the sub field SF (N/−2) assumes the light emission state for the luminance level 3 in addition to those which assume the light emission state for the luminance level 2, . . . , the sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF(N/2+1) assumes the light emission state for the luminance level I, the sub field SF(N/2) assumes the light emission state for the luminance level 2 in addition to that which assumes the light emission state for the luminance level 1, the sub field SF(N/2+2) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

29. The display driving method as claimed in claim 24, wherein all of the pixels displayed on the screen are divided into two groups A and B so as to have a checker-board arrangement;

a light emission state of each of the sub fields is set to satisfy (a) with respect to the pixels of the group A and to satisfy (b) with respect to the pixels of the group B; where (a) no sub field assumes the light emission state for the luminance level 0, the sub field SF((N+1)/2+1) assumes the light emission state for the luminance level 1, the sub field SF((N+1)/2+1) assumes the light emission state for the luminance level 2 in addition to that which assumes the light emission state for the luminance level 1, the sub field SF((N+1)/2−1) assumes the light emission state for the luminance level 3 in addition to those which assume the light emission state for the luminance level 2, . . . , the sub field SFN assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SF((N+1)/2) assumes the light emission state for the luminance level 1, the sub field SF((N+1)/2−1) assumes the light emission state for the luminance level 2 in addition to that which assumes the light emission state for the luminance level 1, the sub field SF((N+1)/2+1) assumes the light emission state for the luminance level 3 in addition to those which assume the light emission state for the luminance level 2, . . . , the, sub field SF1 assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N.

30. The display driving method as claimed in claim 24, wherein all of the pixels displayed on the screen are divided into two groups A and B so as to have a checker-board arrangement;

a light emission state of each of the sub fields is set to satisfy (a) with respect to the pixels of the group A and to satisfy (b) with respect to the pixels of the group B; where (a) no sub field assumes the light emission state for the luminance level 0, the sub field SF1 assumes the light emission state for the luminance level 1, the sub field SF2 assumes the light emission state for the luminance level 2 in addition to that which assumes the light emission state for the luminance level 1, the sub field SF3 assumes the light emission state for the luminance level 3 in addition to those which assume the light emission state for the luminance level 2, . . . , the sub field SF(N−1) assumes the light emission state for the luminance level N−1 in addition to those which assume the light emission state for the luminance level N−2, and the sub field SFN assumes the light emission state for the luminance level N in addition to those which assume the light emission state for the luminance level N−1 so that all sub fields within 1 field assume the light emission state for the luminance level N; and (b) no sub field assumes the light emission state for the luminance level 0, the sub field SFN assumes the light emission state for the luminance level 1, the sub field SF(N−1) assumes the light emission state for the luminance level 2 in addition to that which assumes the light emission state for the luminance level 1, the sub field SF(N−2) assumes the light emission state for the luminance level 3 in addition to those which assume the light emission state for the luminance level 2, . . . , the sub field SF2 assumes the light emission state for the luminance level N−1 in addition to those which assume the light emission state for the luminance level N−2, and the sub field SF1 assumes the light emission state for the luminance level N in addition to those which assume the light emission state for the luminance level N−1 so that all sub fields within 1 field assume the light emission state for the luminance level N.

* * * * *

UNITED STATES PATENT AND TRADEMARK OFFICE

CERTIFICATE OF CORRECTION

PATENT NO. : 7,095,390 B2
APPLICATION NO. : 09/548362
DATED : August 22, 2006
INVENTOR(S) : Yukio Otobe et al.

It is certified that error appears in the above-identified patent and that said Letters Patent is hereby corrected as shown below:

Column 48, Line 61, “display,” to --display-time interval,--.

Column 49, Line 52, “level, 3” to --level 3--.

Column 50, Line 12, change “or” to --for--.

Column 51, Line 12, change “sub-field” to --sub field--.

Column 60, Line 64, change “[(N1)/2” to --[(N-1)/2--.

Column 61, Line 2, change “(N1)/2+1” to --(N-1)/2+1--.

Column 61, Line 4, after “claim 24” insert --,--.

Column 62, Line 66, change “SF (N/-2)” to --SF (N/2-1)--.

Column 63, Line 12, change “level I,” to --level 1,--.

Column 63, Line 36, change “SF((N+1)/2+1)” to --SF((N+1)/2)--.

Column 64, Line 5, change “the, sub” to --the sub--.

Signed and Sealed this

Thirteenth Day of February, 2007

JON W. DUDAS
*Director of the United States Patent and Trademark Office*